US005893011A

United States Patent [19]

Yoshida et al.

[11] Patent Number: 5,893,011

[45] Date of Patent: Apr. 6, 1999

[54] IMAGE FORMING APPARATUS FOR COPYING A DOCUMENT BY MOVING AN EXPOSURE UNIT AND FOR MOVING A DOCUMENT THAT IS TO BE COPIED

[75] Inventors: Akimaro Yoshida, Yokohama; Chikara Sato, Hachioji; Yoshinori Isobe, Tokyo, all of Japan

[73] Assignee: Canon Kabushiki Kaisha, Tokyo, Japan

[21] Appl. No.: 550,985

[22] Filed: Oct. 31, 1995

[30] Foreign Application Priority Data

Nov. 2, 1994 [JP] Japan ..... 6-269682
Nov. 2, 1994 [JP] Japan ..... 6-269683

[51] Int. Cl.[6] ..... G03G 15/30

[52] U.S. Cl. ..... 399/203; 399/368

[58] Field of Search ..... 399/203–205, 399/215, 367, 368, 373, 82; 358/496, 497

[56] References Cited

U.S. PATENT DOCUMENTS

| | | | |
|---|---|---|---|
| 4,860,057 | 8/1989 | Saeki et al. | 355/23 |
| 4,866,484 | 9/1989 | Murai | 355/313 |
| 4,912,518 | 3/1990 | Matsuo et al. | 355/317 |
| 4,992,827 | 2/1991 | Kobayashi et al. | 355/202 |
| 5,017,971 | 5/1991 | Yamada | 355/313 |
| 5,018,714 | 5/1991 | Honjo et al. | 271/3.1 |
| 5,041,874 | 8/1991 | Nishimori et al. | 355/233 |
| 5,055,880 | 10/1991 | Fujiwara | 355/235 |
| 5,119,145 | 6/1992 | Honjo et al. | 355/308 |
| 5,132,741 | 7/1992 | Kitajima et al. | 355/309 |
| 5,351,112 | 9/1994 | Naito et al. | 355/233 |
| 5,579,083 | 11/1996 | Naito et al. | 355/50 |
| 5,629,763 | 5/1997 | Isobe et al. | 399/371 |

FOREIGN PATENT DOCUMENTS 03-100671 4/1991 Japan .

*Primary Examiner*—Robert Beatty
*Attorney, Agent, or Firm*—Fitzpatrick, Cella, Harper & Scinto

[57] ABSTRACT

An image forming apparatus includes a feeding unit for sequentially feeding a plurality of originals to an exposure plate, an exposure unit, which is movable along the exposure plate, for exposing the original on the exposure plate, an image forming unit for forming on a sheet an image on the original that is exposed by the exposure unit, and a control unit for providing either a first copying operation, in which the original is shifted by the feeding unit while the exposure unit is halted to perform copying, or a second copying operation, in which the exposure unit is shifted while the originals that are fed by the feeding unit are halted on the exposure plate. When the control unit executes a first mode in (e.g. copies>1) which the second copying operation is performed following the first copying operation, the feeding unit feeds the originals while maintaining a first constant distance between a leading end of a preceding original and a leading end of a succeeding original, and wherein, when the control unit executes a second mode (e.g. copies=1) in which only the first copying operation is performed, the feeding unit feeds the originals while maintaining a second constant distance between a trailing end of a preceding original and a leading end of a succeeding original.

10 Claims, 43 Drawing Sheets

CL:ABBREVIATION OF CLUTCH, SL:ABBREVIATION OF SOLENOID, D:ABBREVIATION OF DRIVER, PLL:ABBREVIATION OF PLL CIRCUIT
AR:ABBREVIATION OF SWICHBACK, CP:ABBREVIATION OF CLOSED LOOP, IRQ:ABBREVIATION OF INTERRUPTION TERMINAL,
SPC:ABBREVIATION OF STEPPING MOTOR PATTERN CONTROLLER

NORMAL SWITCHBACK MODE

TRAY UP PROCESSING

IMAGE FORMING APPARATUS FOR COPYING A DOCUMENT BY MOVING AN EXPOSURE UNIT AND FOR MOVING A DOCUMENT THAT IS TO BE COPIED

BACKGROUND OF THE INVENTION

1.Field of the Invention

The present invention relates to an image forming apparatus that can copy a document by moving an exposure unit, and that can move a document that is to be copied.

2. Related Background Art

There are two types of automatic paper feeding devices: a recirculating document feeding (RDF) type and an automatic document feeding (ADF) type. An RDF device completes an exposure as a document is passing through an exposure unit, and discharges it upward (or downward) of the location of a portion for positioning an original, so that the device is capable of copying multiple sets by sequentially recirculating the document.

Compared with in a fixation reading mode in which the movement of a document is temporarily halted and the exposure position is shifted along the document area, there is no time loss, which is equivalent to the time required for shifting the exposure unit, for the RDF system in a flow reading mode in which an exposure is completed while a document is moving. This contributes the reduction of the time required for the exchange of a document, and constitutes a technical improvement for a high speed copying system that provides higher productivity. Further, when the above described mode is compared with the fixation mode at a predetermined time required for the exchange of a document, the RDF system in the flow reading mode can circulate a document at a lower shifting speed and can cause less noise.

By referring to the example of the employment of the flow reading mode and the RDF apparatus, there is also a system that performs high speed copying and provides high productivity by employing a flash exposure technique and the flow reading mode. Although a detailed explanation for the flash exposure technique is not given here, unlike the above exposure unit, an exposure unit that employs this technique is so designed that it completes the exposure of all the faces of a document at the same time, and requires a high power light source and a belt-shaped photosensitive body, which increases the size and the manufacturing cost of, and the power that is consumed by the apparatus. An apparatus that employs this technique is therefore limited to only certain of the large apparatus that performs high speed processing.

The second type, the ADF apparatus, fixes an original document in a predetermined position on a platen, and an exposure unit reciprocates above the document several times to expose the area to be copied and then discharges the document into a discharge tray. The ADF apparatus provides multiple copies of a document by repeating the above described process. Since such a copying system is employed together with a sorter that is provided on the output side, and as a document does not have to be repeatedly circulated, the document will not be heavily damaged.

While the above described conventional techniques are presently employed, various other techniques have been proposed that will provide higher speed processing with less noise production. As a first example, a sheet feeding device automatically selects, in consonance with a document size or a mode, one of two paper feeding means, which are provided at both ends of a glass plate, and feeds a document that is positioned on the glass plate to an image reader of a copying apparatus in order to form an image (U.S. Pat. No. 5,629,763).

According to a system in which a document can be recirculated, as is shown in FIG. 21, in a document fixation reading mode (in which paper is fed from a first paper feeding means), a plurality of originals P that are stacked on a sheet tray 304 are separated into individual sheets by a first separation means 306 and are fed by a feeding means 338. Thereafter they are sequentially mounted at an arbitrary position on a platen 303. Then, an image reader 380 (optical system) in a copying apparatus 301 moves in the directions indicated by the double-ended "a" arrow to read an image. Following that, the original P is mounted on a discharge means 311. In a document flow reading mode (in which paper is fed from a second paper feeding means), a plurality of originals P that are stacked on the document tray 304 are separated into individual sheets by a second separation means 314 and are fed by a paper feeding means 315. The optical system 380 is fixed at a position at a distance L from its home position (indicated by broken line), and an image on the original P is read while the original P is being fed at a constant speed along a wide belt 307 above the platen 303. The original P is then discharged by the discharge means and stacked on the sheet tray 304.

To select and to perform the flow reading mode process, a user mounts originals having a small size (A4, B5, LTR, etc.) on the document tray 304, and depresses a start key (not shown) of a copying apparatus to set a first entrance sensor 323 on and to set a sheet material length detector 368 off. First, the document tray 304 descends to a predetermined position by rotating around a support point 340. The bundle of originals P are transferred to the second separation means 314 side and are shifted until they are positioned at a bundle conveying position sensor 328 (the sensor 328 is turned on). The feeding of the original P to the platen 303 is begun by the second paper feeding means 315. The copying of the original P is performed according to the above described flow reading mode, and the original P is then discharged by a discharge roller 311 onto the document tray 304. As each of the originals P is discharged, its trailing end is pushed toward the second separation means 314 side by a stopper 321 to align the edges of the stacked originals. When the document is circulated once more, a bundle consisting of all the originals that were discharged is moved into position and the feeding and copying processes are again performed.

As a second example, there are patents (e.g. U.S. Pat. No. 5,799,237) for an automatic feeding apparatus, i.e., an ADF apparatus. This apparatus is so designed that an exposure unit is fixed at a predetermined position below a platen to perform flow reading while a document is conveyed above the platen and is then discharged onto a discharge tray. To make multiple copies, the document is not discharged after the flow reading is over, but is temporarily held at a position where the flow reading is completed. The exposure unit reciprocates a number of times that is equivalent to a required copy count, and thereafter the document is discharged to a discharge tray. In this manner, an apparatus of this type employs a mixed mode of flow reading and fixation reading to provide multiple copies.

Since the first conventional apparatus example is an image forming apparatus of a document recirculating type, high speed changing of documents is possible in the flow reading mode, and this apparatus is appropriate for attaining a high productivity and for reducing noise. However, the document must circulate a number of times that is the equivalent of a copy set count in order to prepare multiple copies. Thus, this apparatus causes heavy damage to an original document: stress acts on the document while it is passing through a separation means, and paper is curled while it is transferred along a curved path. In addition, feeding errors during the handling of the originals tend to occur, so that the above apparatus is not desired as a system that has high reliability.

The second conventional apparatus example is a type where a document does not recirculate, and does not cause damage to a document. However, taking into consideration the higher speed that is required for changing the originals and the accuracy in positioning (registration) of a document and a transfer sheet, during the use of the apparatus many problems arise.

For example, in the second apparatus example shown in FIG. 19, the reading locations in the flow reading mode are provided at a position 1002 or 1003. When the flow reading is to be performed for a sheet of paper having a small size, and when a copy set count is "1", distance Lx between an leading edge sensor 1004 and a flow reading position is long, so that the time that is required for changing the document is extended.

More specifically, since, in a mixed mode for flow reading and fixation reading, a wide belt 1005 cannot move while a preceding original is fixed in a position and is being read by the shifting of an optical system, the leading edge of a succeeding original must be held upstream from the leading edge sensor 1004. Therefore, the distance Lx is increased and more time is required to change a document. If the distance Lx between the leading edge sensor 1004 and the flow reading position is shortened in order to improve productivity, the rear edge of the document is affected by the turning off or on of the clutch of an upstream drive system (at the time of the paper separation or the paper feeding) while the flow reading is performed. This causes image blurring and the reliability of image forming is degraded. Scanning of a large size sheet of paper cannot be performed, and the apparatus will not function satisfactorily as a copying system. The apparatus shown in FIG. 20 has the same problems.

SUMMARY OF THE INVENTION

It is therefore one object of the present invention to provide an image forming apparatus that overcomes the above described shortcomings.

It is another object of the present invention to provide an image forming apparatus that can separately perform flow reading and fixation reading of documents to prevent documents from being damaged and to increase productivity.

Other objects and features of the present invention will become obvious during the course of the following explanation that is given while referring to the specification and accompanying drawings.

DETAILED DESCRIPTION OF THE PREFERRED EMBODIMENT

Figure 1:
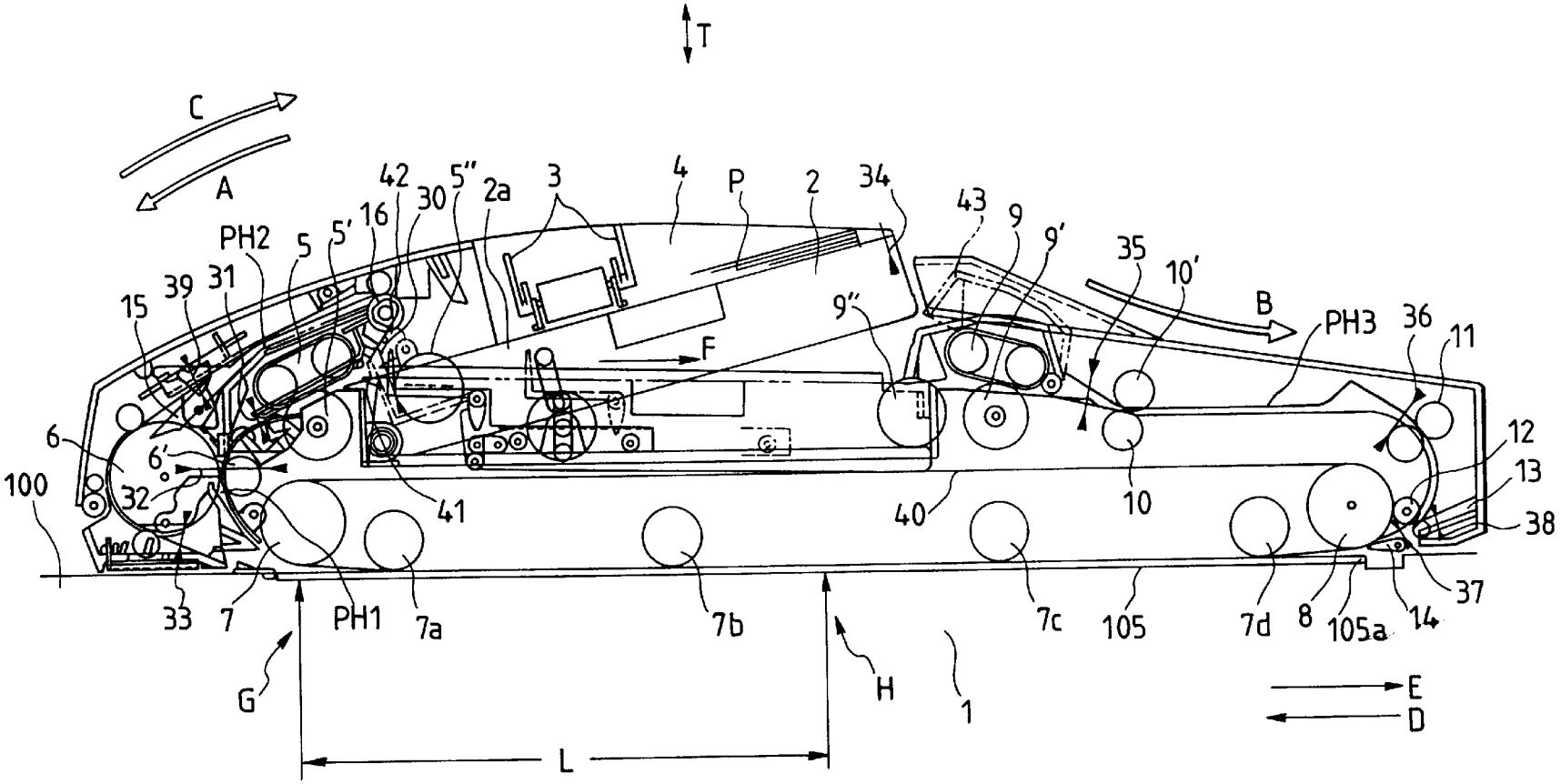
FIG. 1 is a cross sectional view of an automatic document feeding device (RDF) that is attached to an image forming apparatus according to the present invention.

The preferred embodiment of the present invention will now be described while referring to the accompanying drawings. FIG. 1 is a cross sectional view of an automatic document feeding device (hereafter referred to as an "RDF" device because a sheet recirculating RDF is employed for this embodiment), which an image forming apparatus of this embodiment comprises.

The basic flow for an original in the RDF of the embodiment will now be described. In consonance with the mode that is set and the document size, the feeding direction for originals P that are stacked on a tray 2 of an RDF 1 varies: the feeding direction toward A (switchback path) or the feeding direction toward B (closed loop path). As one example, when a large sheet size (e.g., B4 or A3) is set or when a double-side copying mode is set, the original is fed in the direction A (the switchback path) along a given path PH1 (an explanation for which is not given), and is positioned at a predetermined location on a platen 105 of an image forming apparatus 100. When an exposure process by an optical system is completed, the original is discharged in the direction C (a discharge path PH2) onto the tray 2.

Recycle levers 3 on the tray 2 are separation members that separate originals that have been copied from originals that have not yet copied. Upon the depression of a copy start button (not shown), the recycle levers 3 are placed on the topmost original. Since the separation and the feeding are begun with the bottom original, the recycle levers 3, which are placed on the topmost original upon the depression of the copy button, descend lower than a document mounting face 2*a* when all the originals under the recycle levers 3 have been transferred onto the platen 105, and they thus confirm that the document circulation for one cycle has been completed. Although the detailed arrangement will not be explained here, separation and feeding means 5, 5' and 5" and a feed roller 6' are employed to guide an original to the platen 105, and a reverse roller 6 and a discharge roller 16 are employed to guide a document, which has been discharged from the platen 105, to the platen 105 again or to the tray 2.

In a single-side copy mode for small sheet sizes, the original is fed in direction B along a predetermined path PH3 (an explanation for which will not be given), and is positioned at a predetermined location on the platen 105 of the RDF 1. When the exposure process is completed, the original is discharged in the direction C (the discharge path PH2) onto the tray 2. Reference numbers 9, 9' and 9" denote separation feeding means as well, and reference number 10 denotes a feed roller. Registration rollers 11 are provided along the direction B (the closed loop path). A backup roller 12 is located at a path turn portion so that thick paper can be handled more effectively. At this time, the tray 2 descends until it is almost horizontal. Reference number 13 denotes a manual insertion path feed port, and the backup roller 12 also serves as a feed roller for a manually inserted original. A turn flapper 14 is positioned upward from a platen edge 105*a* during paper feeding in the direction B and guides the original so that it is not caught at the platen edge 105*a*. During the feeding of an original through the manual insertion port 13 in a manual insertion mode, the turn flapper 14 is positioned upward from the platen edge 105*a*. When copying is completed and the original is returned again in direction E, the turn flapper 14 is then positioned lower then the platen edge 105*a*.

Figure 2:
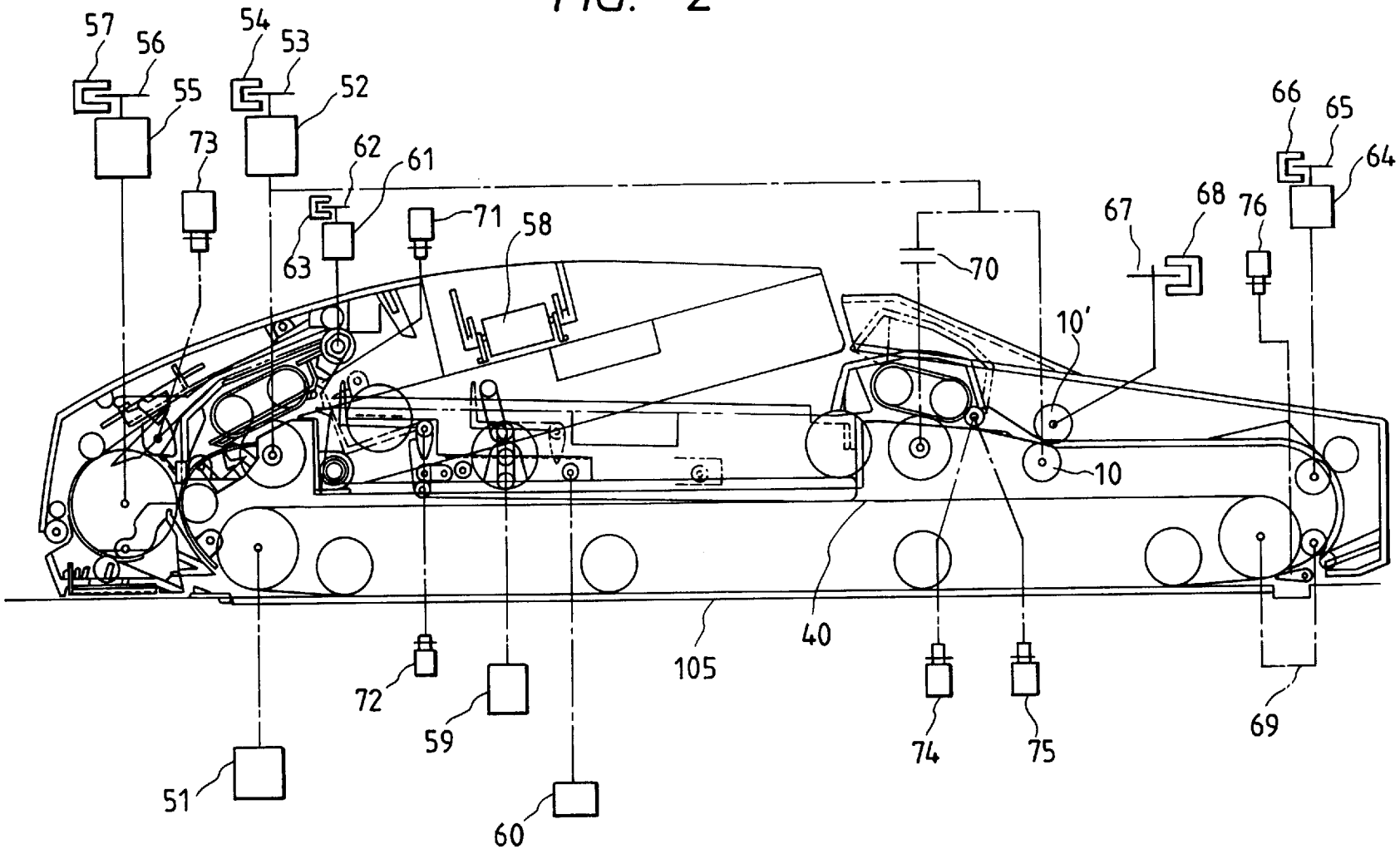
FIG. 2 is a diagram illustrating the arrangement of a drive system of the RDF.

FIG. 2 is a cross sectional view of the structure of a drive system in the RDF according to this embodiment.

In this embodiment, a stepping motor 51 serves as drive means for a conveying belt 40 (means for transferring an original to the platen 105) of the platen 105. The stepping motor 51 is used because it provides excellent control, i.e., excellent control response for activating and halting, and because equal peripheral velocities for the conveying belt 40 (the backup roller 12 that is driven with the belt 40) and the registration rollers 11 must be highly accurately provided (a detailed explanation will be given later).

Further, the backup roller 12 is driven by a turn roller 8 that is coupled with the conveying belt 40 and rotated, so that the peripheral velocity of the backup roller 12 equals the moving velocity of the conveying belt 40. The registration roller 11 on the closed loop path side is driven by a stepping motor 64. The reason that the stepping motor 64 is used is, as is described above, to establish a peripheral velocity that equals that of the conveying belt 40 (to ensure a highly accurate registration). In this embodiment, the conveying belt 40 and the registration rollers 11 are rotated by the stepping motors 51 and 64. The PLL control of a DC motor may be employed to control the peripheral velocity at the drive force transmission portion, or a single drive source and clutch means may be employed so that the conveying belt 40 and the registration rollers 11 may be rotated by the same drive source while the clutch means is turned on and off. A clock disk 65 is attached to the drive shaft of the stepping motor 64, and a clock sensor 66 detects the step-out state of the stepping motor 64.

A separation motor 52 rotates forward the separation and feeding means 5, 5' and 5" on the switchback side, and rotates in parallel the separation feed means 9, 9' and 9" and the feed roller 10 on the closed loop side. A clock disk 53 and a clock sensor 54 are provided around the separation motor shaft to control the speed. In addition, during reverse rotation, the driving force of the separation motor 52 can selectively drive or halt the separation feeding means 9, 9' and 9" via a clutch 70. A clock disk 67 is fitted around the roller shaft of a driven roller 10' that is pressed against the feed roller 10. The feeding speed of an original and the distance that it is fed can be measured from the output of a clock count sensor 68.

A reverse rotation motor 55 is provided as drive means for the registration and the reversing on the switchback side and can rotate the reverse roller 6. In this embodiment, the reverse rotation motor 55 is a DC motor and performs PLL control to provide equal peripheral velocity for the conveying belt 40 and the reverse roller 6. A clock disk 56 and a clock sensor 57 are fit around the reverse rotation motor shaft to permit PLL control (it should be noted that the reverse rotation motor may be a stepping motor that rotates synchronously with the above described belt motor (control for equal peripheral velocity)).

A discharge motor 61 drives the discharge roller 16 along the switchback path. A clock disk 62 and a clock sensor 63 are provided for the discharge motor 61 in order to transmit a driving force to the reverse roller 6 and to control the velocity at the time the paper is discharged. In addition, a tray elevating motor 59 is provided as a drive source to power the ascent or descent of the tray 2 during the closed loop sheet handling.

When the closed loop sheet handling is begun, a sheet abutting shutter 41 transfers, as a bundle, the originals until their leading ends reach the entrance for the separation feeding means 9, 9' and 9" on the closed loop side. A stepping motor 60, which is a DC motor in this embodiment, is employed as a bundle transfer means and as a drive means for shifting the original that is returned after the closed loop sheet handling again to the separation and feeding means side.

Further, as is described above, a recycle motor 58 is fitted, in a tray side plate 4, as a drive source for driving the recycle levers 3 that serve to separate the originals that are set from the discharged originals.

Next, solenoids and relating components will be described. A weight solenoid 71 is provided to activate a weight 42 that assists in the feeding on the switchback side. A shutter solenoid 72 is attached to rotate and to retract the shutter 41 during paper feeding. A reverse flapper solenoid 73 is provided to rotate a reverse flapper 15 that, at the time of switchback reversing, switches the ejection of paper and the reversing of paper for double side copying. In addition, a separator rotation solenoid 74 and a pressurization solenoid 75 are attached on the closed loop side, so that they rotate with a closed loop weight shaft, in order for a closed loop weight to be operated and to assist in the paper feeding and to provide for the separation in the closed loop mode. With the solenoids 74 and 75, the above described closed loop path turn flapper 14 is also rotated, which changes its position relative to the platen 105 when an original is fed and discharged in the manual insertion mode. A solenoid 76 is also attached to rotate the shaft of the flapper 14.

Original sensors along the paths and an image reading position will now be described. First, an explanation for these on the switchback side will be given. The switchback side pass sensors are an empty sensor 30 for detecting a document that is placed on the tray 2; a separation sensor 31 for detecting originals that are separated; a switchback registration sensor 32 for the timing of document registration and for the correction of an angled position of an original; a reverse sensor 33 for detecting a document that is returned by the switchback from the platen 105; and a paper ejection sensor 39 for detecting an original that is discharged.

The pass sensors on the closed loop side will be explained. The empty sensor 31 is used in common with the switchback side. A document set sensor 34 is provided, which detects the rear edge of a document that is set to determine whether the document is a half size (A4, LTR or B5) or longer. When the document is determined to be half size (i.e., when the empty sensor 30 is ON and the document set sensor 34 is OFF), the original is fed from the closed loop side (actually in this embodiment, the detection of a document width is performed at the same time as the detection by the empty sensor 30 and the detection by the document set sensor 34 to determine the size, A4, LTR or B5).

Since at the time closed loop feeding is initiated the tray 2 descends and the shutter 41 is moved in direction F (see FIG. 1), the document set sensor 34 detects the leading edges (closed loop feeding side ends) of the set documents that are transferred as a bundle, and halts the movement of the shutter 41 when the leading ends of the originals reach the position that is appropriate for performing separation (a clock is moved by a predetermined count following the detection of the leading edges). The document set sensor 34 also serves as document bundle leading edge sensor. Reference number 35 denotes a closed loop separation sensor; 36, a closed loop registration sensor for acquiring a timing for closed loop registration and for correction of a position angle; 37, an image sensor for positioning a document on a platen; and 38, a paper manual insertion set and ejection sensor.

A home position for an exposure start of an optical system is a first image leading end (fixation reading image leading end) G when the system moves and scans a document that is fixed in a specific position. A second image leading end (flow reading image leading end) H, which is shifted to the right from the position G by a distance L, is a scanning point for the optical system in a flow reading mode, wherein the optical system is fixed and reads an original that is moved past it.

Figure 3:
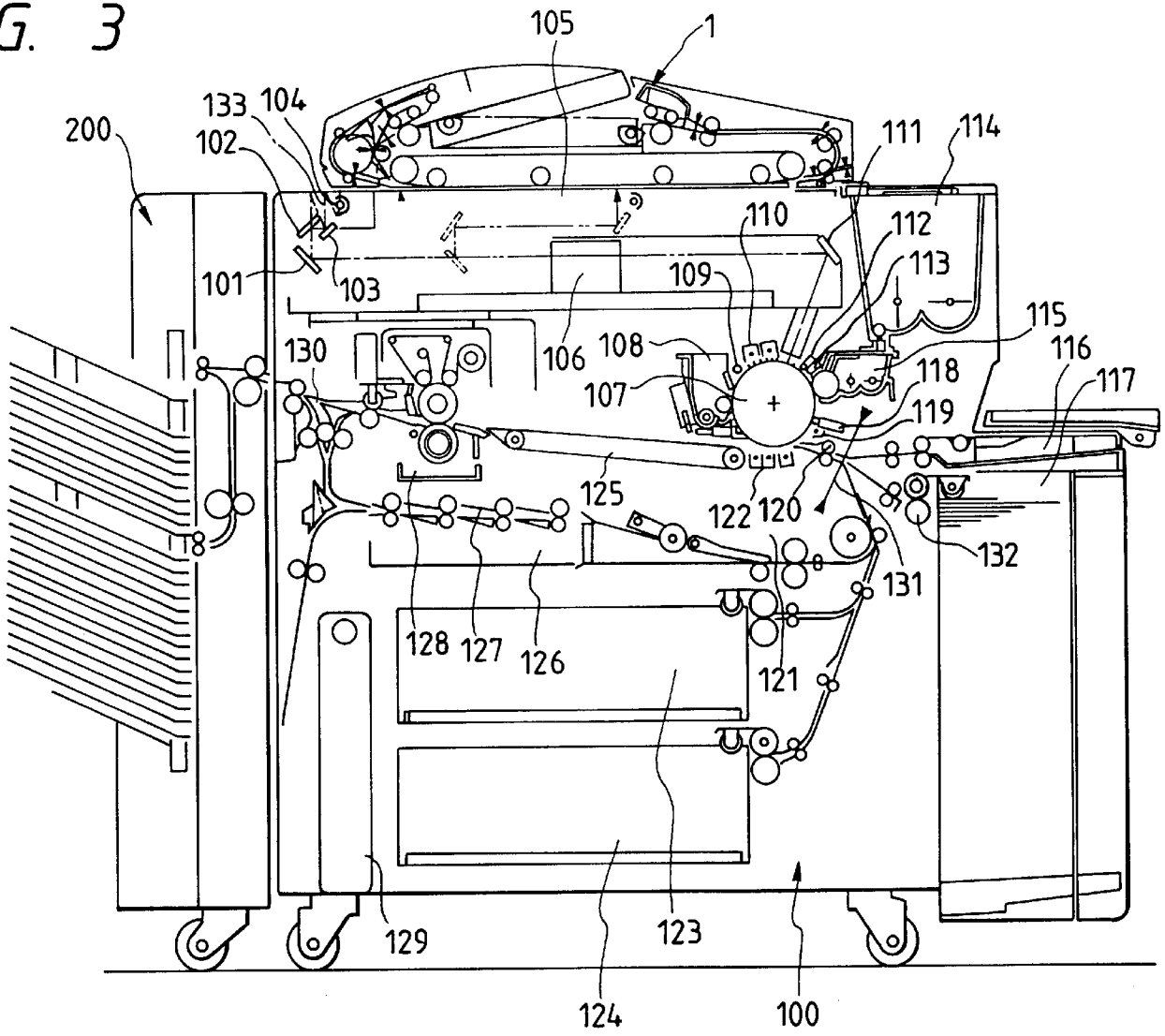
FIG. 3 is a cross sectional view of one embodiment of an image forming apparatus on which the RDF is mounted.

The schematic arrangement of the image forming apparatus 100, to which the above described RDF is attached, will be explained while referring to FIG. 3.

As is well known, the optical system comprises a third mirror 101, a second mirror 102, a first mirror 103, a document irradiation lamp 104, a zoom lens 106 and a fourth mirror 111 to transfer document data on the platen 105 to a photosensitive drum 107. The optical system is so designed that it can perform both document fixation reading, in which a document is fixed at a specific position and an exposure unit 133 reciprocates above the platen 105 and reads an image, and document flow reading, in which the exposure unit 133 is fixed at a specific position and reads an image while a document reciprocates.

Reference number 108 denotes a drum cleaner; 109, a pre-exposure lamp; 110, a primary charger; 112, a blank exposure lamp; 113, a potential sensor; 114, a toner hopper; 115, a developing unit; 116, a multi-feeder; 117, a side tray; 118, a roller electrode; 119, a precharger; 120, a registration roller; 121, a paper refeeding section (double sided); 122, a transfer/separation charger; 123, an upper front tray; 124, a lower front tray; 125, a conveying section; 126, an intermediate tray; 127, a second conveying section; 128, a fixing unit; 129, a toner collecting container; 130, a paper ejection portion; and 200, a copy sheet output side device (sorter). Since the processing of the above image forming apparatus is well known, no explanation for it will be given here.

With the paper feeding arrangement of the image forming apparatus as an example, a feed roller 132, a registration sensor 131 and a registration roller 120 are employed to explain the flow of an original in this embodiment.

Since the flow reading of a document is performed in this embodiment, it is important that the timing for the sheet feeding, the registration, the transfer and the separation by the copying machine be performed synchronously with the flow of a document through the document processor. The handling of a document until it reaches the image reading position must especially be synchronized with the individual processes of the copy machine. Before the synchronization with the copy machine is described, the flow of a sheet material that is inherent to the document processor in this embodiment will be described.

The switchback path of the document feeder in this embodiment, along which an original is fed in direction A as is described above while referring to FIG. 1, is well known, and no explanation for it will be given. The flow of a sheet in a mode (hereafter referred to as a mixed mode) in which both flow reading and fixation reading are employed for an original that is fed from direction B, will be explained while referring to FIGS. 4A through 8B. The mixed mode is a mode where, to copy a plurality of sets, flow reading is performed for the first copy set and then fixation reading is performed for the second and thereafter.

Figure 4A:
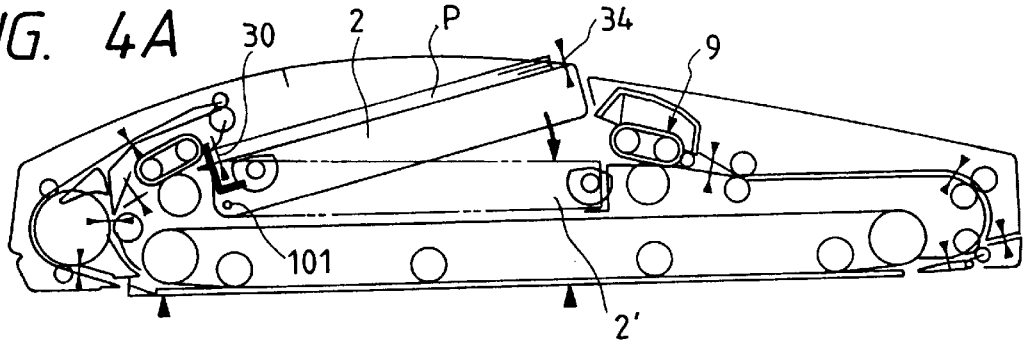
FIGS. 4A, 4B, 4C and 4D are diagrams showing the feeding of an original in a mixed mode.
Figure 4B:
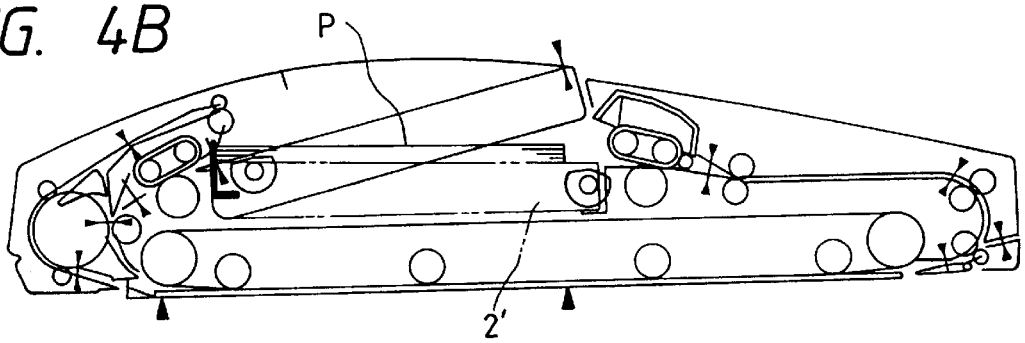
Figure 4C:
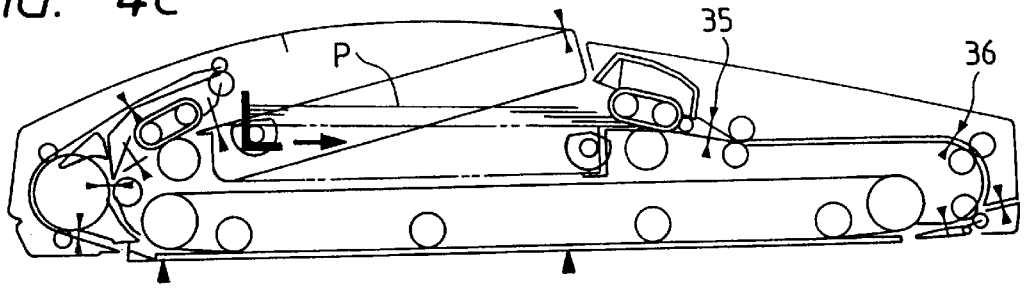

In FIG. 4A is shown the state where originals P are set on the tray 2. When the empty sensor 30 detects that the originals are present and the document set sensor 34 is OFF, i.e., the originals are long enough to be stored within a given storage space, a copy machine outputs a copy start signal in a mixed mode. In response to this signal, the tray 2 descends to a position 2' (indicated by chained, double-dashed lines) by swiveling around a pivot 101 and in direction I. When the descent is completed, the document abutting shutter 41 transfers the bundle of originals P in direction J. When the leading ends of the originals P are passed through the document set sensor 34 and are fed by the shutter 41 a predetermined distance (during which originals can be appropriately separated by the separation and feeding means 9), the movement of the originals P is halted, and then an original $P_n$ is fed from the bottom of the originals P (see FIGS. 4C and 4D).

Figure 4D:
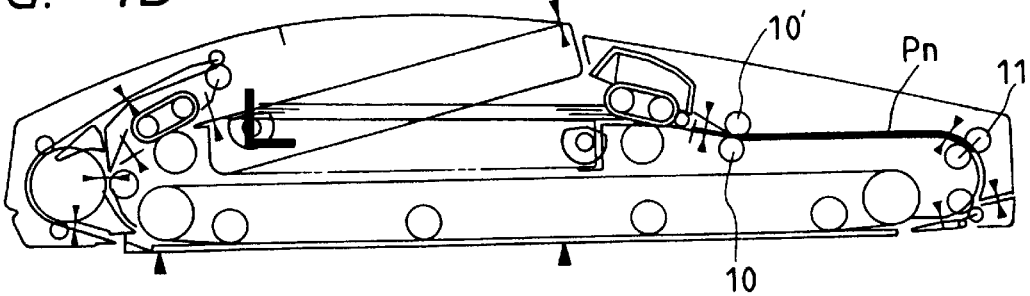

In FIG. 4D is shown the state where the original $P_n$ contacts the registration rollers 11. The registration rollers 11 perform a well known alignment process with the original $P_n$ (the leading end of the document $P_n$ is in contact with a halted roller nip portion to form a registration loop between the upstream feed rollers 10 and 10', and the correction of the angle positioning of the original is performed during the separation and feeding). When a predetermined period of time has elapsed, the registration rollers 11 begin to rotate to begin feeding the original $P_n$.

Figure 5A:
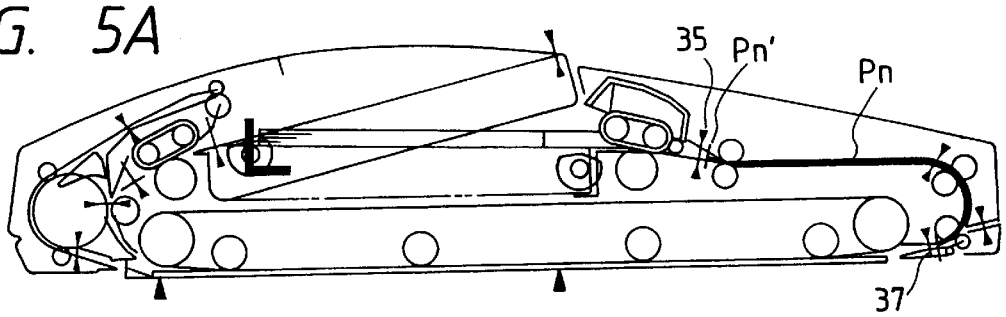
FIGS. 5A, 5B, 5C and 5D are diagrams showing the feeding of an original in a mixed mode.

In FIG. 5A is shown the state when the trailing end of the original has passed the separation sensor 35. The separation and feeding of the following original $P_{n-1}$ is begun. Referring back to the state in FIG. 4D, although, after the registration loop, the registration rollers 11 and the feed rollers 10 and 10' are driven by drive sources, the clock disk is fitted around and rotates with the shaft of the driven roller 10' for the feed roller 10. The feeding speed of the original $P_n$ can thus be detected by employing the clock disk and the clock count sensor, and in consonance with the output of the clock sensor, the registration rollers 11 rotate at a peripheral velocity that is synchronized with the feeding speed of the original $P_n$ (i.e., a controller is provided that controls the rotation speed of the stepping motor 64, which employs the clock signal while driving the registration rollers 11).

Immediately before the leading edge of the original $P_n$ is nipped by the backup roller 12 that is rotated by the drive force of the wide belt 40, the peripheral velocities of the feed rollers 10 and 10' and the registration rollers 11 are so controlled that they are equal (feed roller↔resist roll peripheral velocity control), and the clock with which the wide belt 40 is driven, i.e., the synchronous operation between the stepping motor 51 that drives the wide belt 40 and the stepping motor 64 that drives the registration rollers 11, is controlled (synchronous control of the stepping motor 64 by using a clock for the stepping motor 51). In this manner, conveying belt↔resist roll peripheral velocity control is performed, in which the peripheral velocity of the wide belt 40 and the peripheral velocities of the backup roller 12 and the registration rollers 11 are so adjusted that they are equal.

Figure 5B:
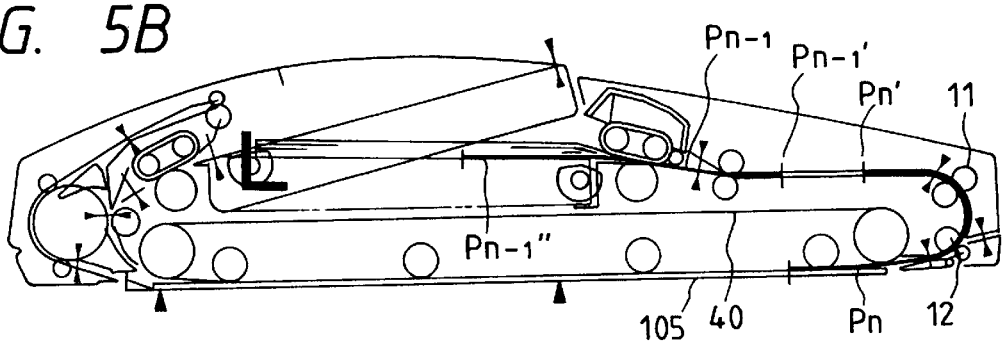
Figure 5C:
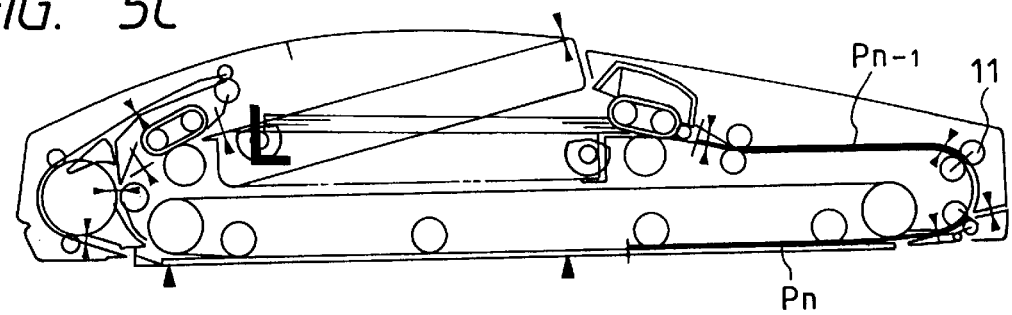
Figure 5D:
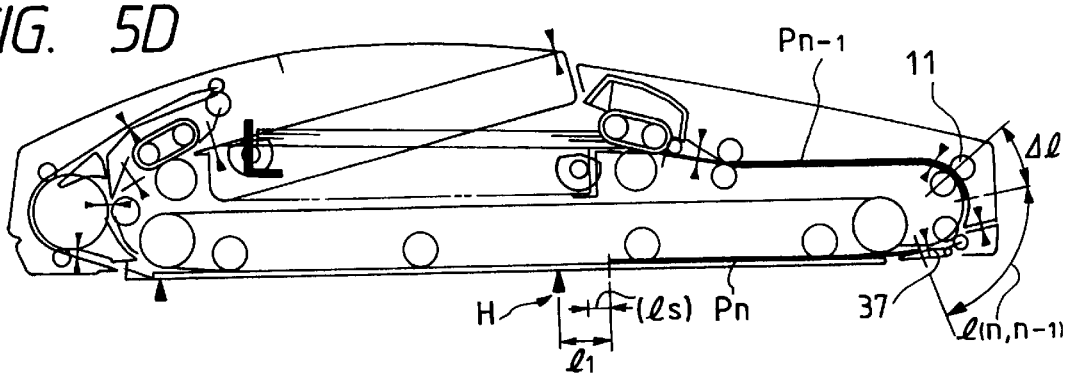

In the state in FIG. 5D immediately after the equal speed control is switched, the trailing end of an original is nipped by the feed rollers 10 and 10'. A one way clutch (not shown) is provided on the feed roller side to permit the feed roller to freely rotate in the paper feeding direction, and an original is extracted by the registration rollers 11 at their peripheral velocity even if the peripheral velocity of the registration rollers 11 is higher than that of the feed rollers 10 and 10'. While referring back to FIG. 5A, the state is shown where the trailing end $P_n'$ of the document is passed between the feed rollers 10 and 10' under the above described control (conveying belt↔resist roll equal speed control).

In this embodiment, in order to provide a compact apparatus, the paper path length is so set that, when, as is shown in FIG. 5A, the drive system is activated by the conveying belt↔resist roll equal speed control, the trailing end $P_n'$ of the original $P_n$ is nipped by the feed rollers 10 and 10'. If the paper path length is so set that the trailing end $P_n'$ of the original $P_n$ passes over the feed rollers 10 and 10' when the drive system is activated by the conveying belt↔resist roll equal control, the one way clutch (not shown) on the feed rollers 10 and 10' can be removed (see FIG. 11).

Figure 11:
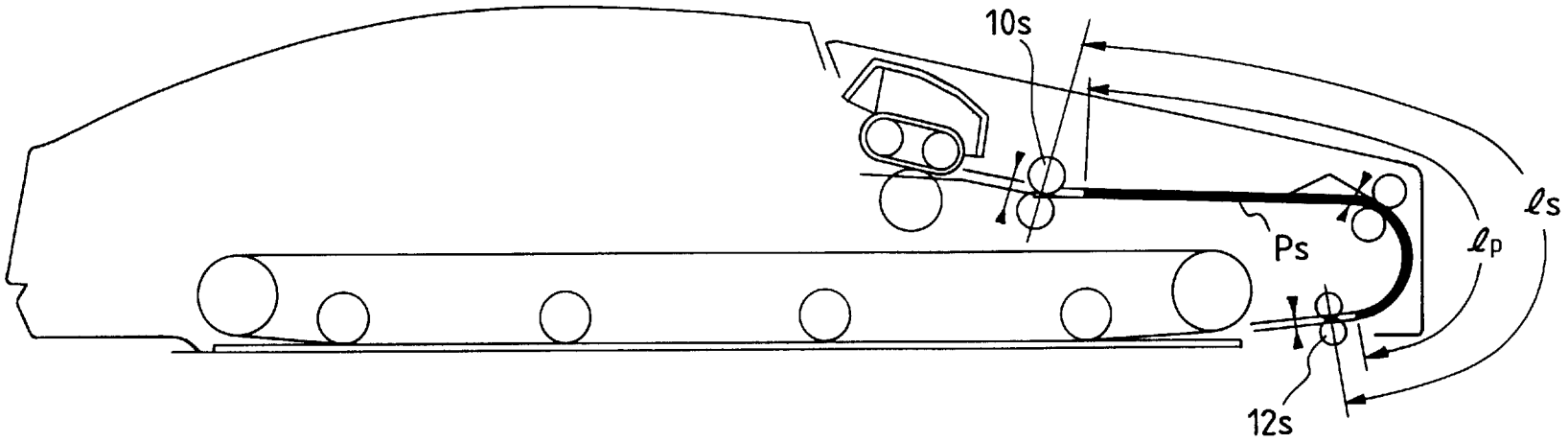
FIG. 11 is a diagram showing a positional relationship between an original and a feed roller.

In FIG. 11, the length 1*p* of an original Ps that has the maximum size for scanning need only to be set shorter by a predetermined value than 1*s*, which is a distance between the feed roller pair 10*s* and the turn roller pair 12S.

In FIG. 5B, the wide belt 40, the backup roller 12, and the registration rollers 11 are rotated at an equal peripheral velocity by the conveying belt↔resist roll equal velocity control, and the original $P_n$ is fed to the platen 105. At this time, the leading edge $P_{n-1}'$ of the following original $P_{n-1}$ is passed between the feed rollers 10 and 10' and is continuously fed at a feeding speed at which the leading edge $P_{n-1}'$ does not contact the trailing end $P_n'$ of the preceding original $P_n$. When the original $P_{n-1}$ is fed by the feed rollers 10 and 10' that are driven by the separation motor 52 shown in FIG. 2 and its trailing end $P_{n-1}''$ has not yet passed at the nip point of the separation and feeding means 9 and 9', the separation clutch 70 (FIG. 2) is turned off. Although the feed rollers 10 and 10' rotate continuously, the separation and feeding means 9, 9' and 9" are halted, and thereafter the original $P_{n-1}$ is extracted from the separation and feeding means 9 by the feed rollers 10 and 10'.

A preferable separation function can be acquired with the above described arrangement, and in order also to reduce a load during the extraction, the feed roller 9 and the feed auxiliary roller (semicircle roller) 9" include a one way clutch that permits free rotation in the feeding direction. In FIG. 5C is shown the state after the originals $P_n$ and $P_{n-1}$ have been fed farther. In addition, the registration loop and the correction for an angle position are to be performed for the original $P_{n-1}$, as well as for the original $P_n$, by the registration rollers 11.

In FIG. 5D is shown the state where the original $P_n$ is temporarily halted with its leading edge separated from the flow reading image leading end (second image leading end) position H by a specific distance 11 The trailing end of the original $P_n$ is not nipped by the upstream feed rollers 10 and 10' so that it is not affected by a drive force other than that of the wide belt 40, which is employed to perform flow reading exposure scanning. A brake, etc., is released when the original $P_n$ is passed through the drive system (although it is halted for a moment in this embodiment, it may not always be halted). At this time, the state of the original $P_{n-1}$ is such that it is immediately fed forward by a predetermined value (Δ1) from the nip portion of the registration rollers 11 under the control of the feed roll → resist roll equal velocity control. The interval between the trailing end of the original $P_n$ and the leading end of the original $P_{n-1}$ is 1 $(_{n,\ n-1})$ The leading end of the original $P_n$ is fed and is located at a position that is a predetermined clock count distant from the point at which it passed the image leading end sensor 37. In the state shown in FIG. 5D, upon the receipt of an image forming enable signal (a standby signal) from a copy machine, feeding of the original $P_n$ is begun and its feeding speed increases after it has traveled a predetermined distance ($l_s<l_1$) until it equals the processing speed of the copy machine (equal size copying). For variable magnification copying, a flow reading speed that is consonant with the magnification is employed so that the feeding speed varies from the processing speed by a relative speed difference (a difference between a document handling speed and a transfer material shifting speed).

Figure 6A:
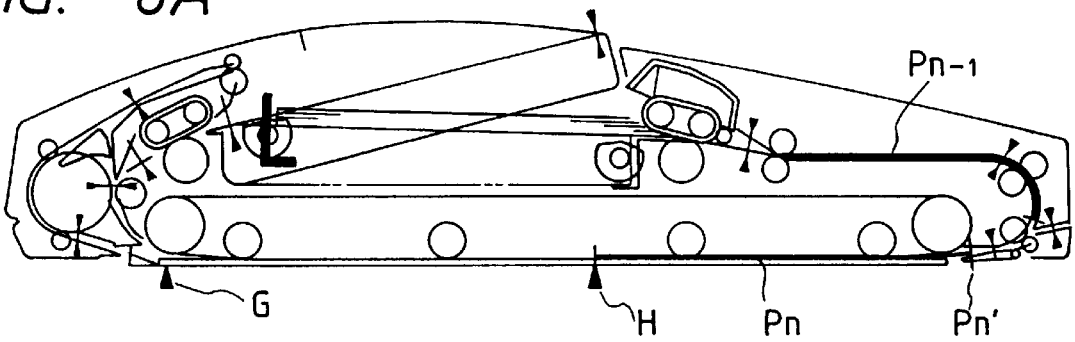
FIGS. 6A, 6B, 6C and 6D are diagrams showing the feeding of an original in a mixed mode.

When the leading end of the original $P_n$ reaches point H (the second image leading end), by employing a controller that determines a feeding distance for the leading end of the original (when a period has elapsed that is equivalent to the total clock count since the leading end passed the image leading end sensor 37 and reached the point H), the document processor outputs an image leading end signal and begins image forming on the photosensitive drum 107 of the copy machine (FIG. 6A). The document feeding and the processing by the apparatus are synchronized with each other at the same peripheral speed, and the flow reading in which an image is read while the original is being fed (the optical system is fixed) is performed.

When the flow reading at a specific speed has been completed and the trailing end $P_n''$ of the original $P_n$ has passed point H (when the trailing end of the original $P_n$ has passed point H and its location is detected by a controller that uses the wide belt conveying clock), a controller (not shown) in the document processor outputs an optical system return signal (for copying two or more sets) to the controller of the copying machine, and then the optical exposure unit 133 (FIG. 3) begins to move to the first image leading end position G.

Figure 6B:
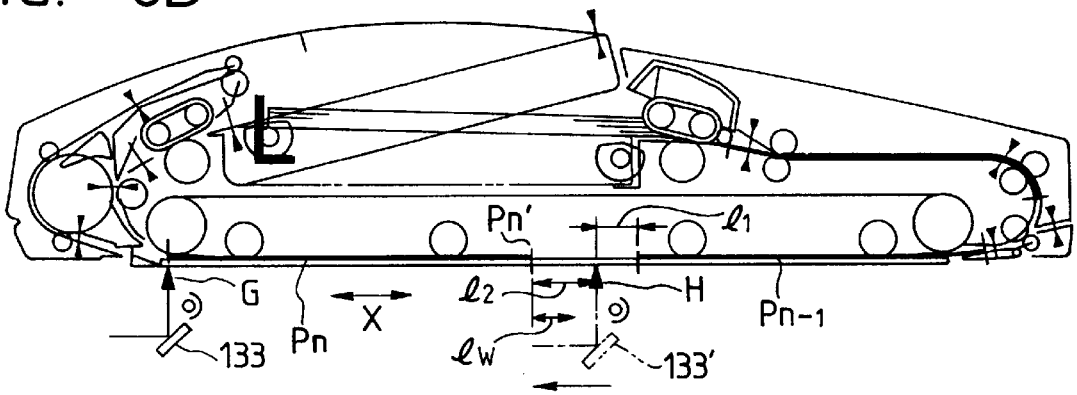
Figure 6C:
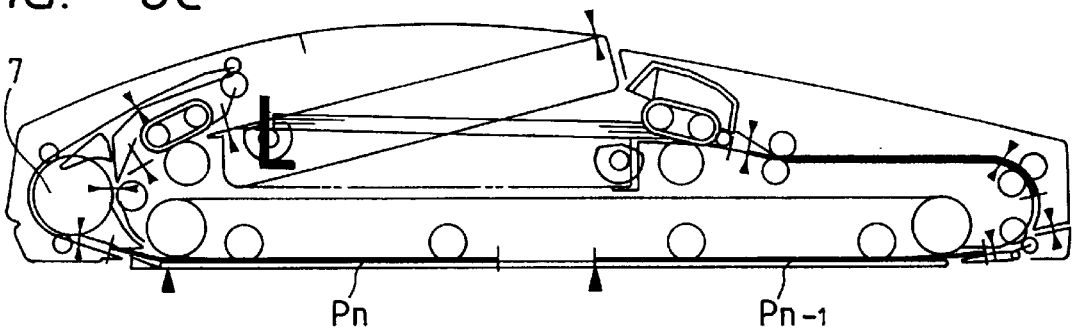

In FIG. 6B is shown the state of the optical exposure unit 133 when it has moved from the point H to the point G. When the flow reading of the original $P_n$ has been completed and its leading end has reached the first image leading end (image leading end position for fixation reading) position H, the driving of the wide belt is stopped and the movement of the original $P_n$ (and also $P_{n-1}$) is also halted (FIG. 6B). The locations of the originals $P_n$ and $P_{n-1}$ at this time are also detected by the controller (not shown) of the document processor that uses the wide belt conveying clock.

When the copy set mode in FIG. 6B is a plurality of sets, m, the optical exposure unit 133 then reciprocates the remaining m−1 times (in the direction X) and scans the original $P_n$. Of course, when the set mode is only "1", the position of the optical exposure unit 133 is fixed and to provide a single copy the flow reading is performed during the feeding of the original $P_n$, so that the flow reading and exposure can be sequentially performed for the succeeding originals $P_{n-1}$, $P_{n-2}$, . . . $P_1$ while the optical exposure unit 133 is fixed at the position H.

With this arrangement, the flow reading and the fixation reading for an original can be sequentially performed in consonance with the number of copies that is set. As long as the number of copies that is set is within the capacity of a printed sheet output side, for example, the capacity of a sorter (more specifically, the number of bins in a sorter), a scanning process count that equals the number of copies that is set is performed during the circulation of the bundle of originals $P_n$ through the apparatus. More specifically, while in the conventional flow scanning mode the number of times an original must circulate is the same as the number of copies that is set, in this embodiment, both the flow reading scan and the fixation reading scan are employed during the document feeding sequence, so that not only is the scanning completed with only one circulation of a document (when the count of the copies that is set is within the capacity of the sorter), but also a single scanning is completed during the replacement of the original. In addition, the original replacement speed may be slower than the scanning speed (conventionally, it is rather faster than the scanning speed (1000 to 1300 mm/sec)).

Figure 9:
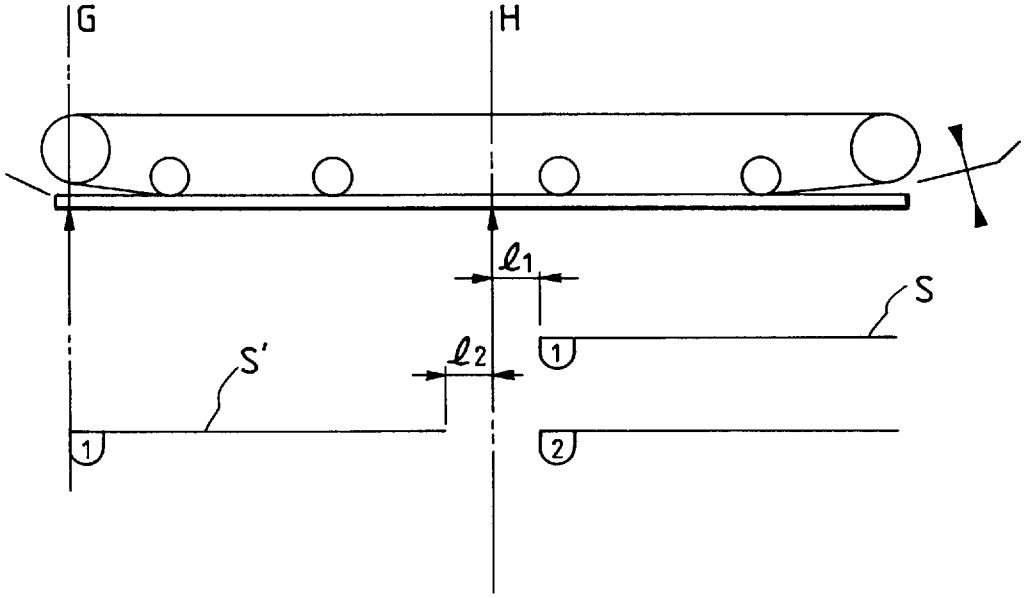
FIG. 9 is a diagram showing the relationship between a flow reading position and a fixation reading position.

The document standby position during the flow reading scan will be further explained while referring to FIG. 9.

The operation is begun by driving the belt 40 when the original is located at a standby position upstream a distance $l_1$ from the flow reading image leading end position H. The graph (time-speed) for the activation of the belt drive motor (stepping motor) 51 at this time is shown in FIG. 10.

Figure 10:
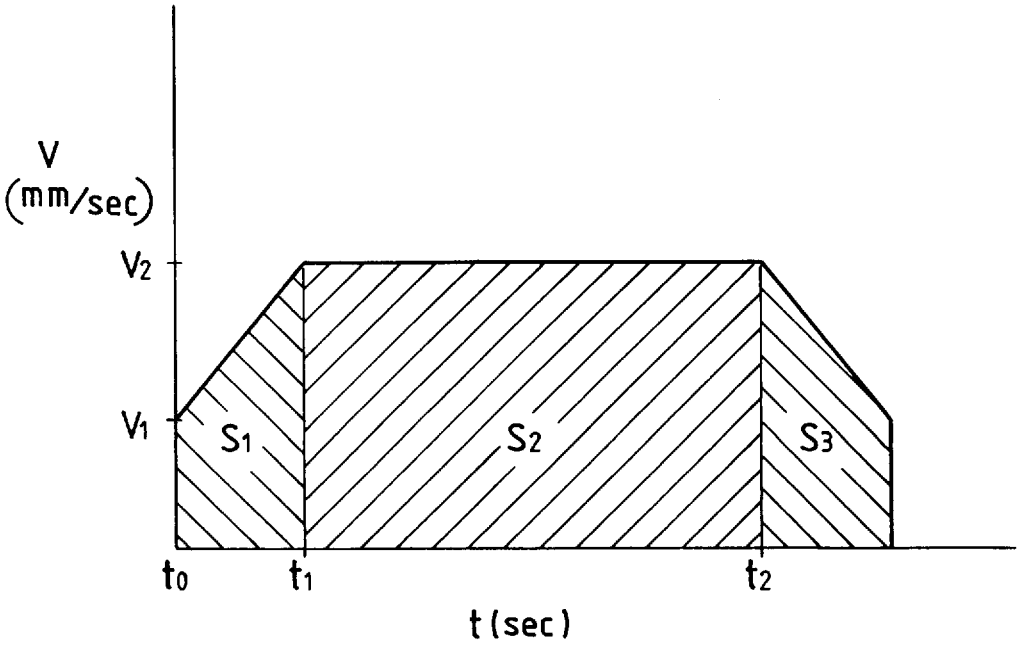
FIG. 10 is a graph showing a waveform for a belt drive motor when it rises.

In the graph in FIG. 10, the horizontal axis represents time and the vertical axis represents speed. The belt drive motor 51 builds up from $v_1$ to $v_2$ at a constant speed during a period following the step excitation (t0) until $t_1$ is reached. The speed $v_2$ is the paper feeding speed for a flow reading scan, and matches the processing speed of the copying machine in the equal magnification copy mode. The area $S_1$ in FIG. 10 represents the run distance, and corresponds to distance $l_s$ in FIG. 5D. In this embodiment, $l_1>l_s$ ($l_1$ is an approach run distance at the time of the flow reading scan).

This is because consideration is given to the minimum vibration attenuation time, wherein the inherent vibration at the rising time for the drive system of the belt 40 is attenuated, and image blurring does not occur. As the distance $l_1$ becomes shorter, the time until the flow reading begins is reduced and the productivity of the system is increased. After the flow reading scan is completed, the original is shifted from position S to position S' and is halted. Since while the original is shifted a constant speed is maintained as it passes the flow reading image leading end position H, the distance that is required for the substantial halting of the original is $l_2$ (a fixation reading image leading end distance, at which scanning is performed by moving the optical system to the first image leading end position, that corresponds to $l_2$ in FIG. 6B). In FIG. 6B, $l_w$ is an interval for substantial speed reduction and halting, and corresponds to area $S_3$ in FIG. 10. Then, $l_2>l_w$ is provided because a constant speed interval of $l_2-l_w$ is set even after the image scanning is completed, with a margin being provided so as not to affect the image even if a distribution occurs that is due to faulty registration, and in order also to reduce the time interval until the original feeding is halted.

After the original is halted at the position S' in FIG. 9, and an estimated time has elapsed that is required for the inherent vibration of the belt drive system to stop, the scanning is performed by moving the optical system.

Though the order of the explanation is inverted, FIG. 5D is referred to. The leading end of the original $P_{n-1}$ is moved a predetermined distance value, which is Δ1 and is advanced from the nipping portion of the registration rollers 11 under the control of the feeding roll↔resist roll peripheral speed control, and the control is then switched to the conveying belt↔registration roller peripheral velocity control. The moving of the original $P_{n-1}$ is begun from the condition in FIG. 5D, and the conveying clock counter starts counting when the leading end of the original $P_{n-1}$ has passed the image leading end sensor 37.

When the original $P_{n-1}$ is halted at a position indicated in FIG. 6B, its halted position depends on the position of the preceding original $P_n$. However, until the original $P_{n-1}$ reaches the position H, the conveying clock counter will have been counting since the leading end of the original $P_{n-1}$ passed the image leading end sensor 37. Since the distance between the position H and the image leading end sensor 37 is unchanged, when the original $P_{n-1}$ is shifted, in consonance with the remaining clock count, from the position in FIG. 6B to the point at which it reaches the position H, i.e., when the original $P_{n-1}$ assumes the state shown in FIG. 5D, an image leading end signal is output by the controller of the document processor to start the flow reading, so that accuracy in the registration of the document can be acquired.

The flow reading and registration are performed for the succeeding originals $P_{n-2}$, $P_{n-1}$ and $P_1$ under the same control. The distance $l_1$ for the original $P_n$ to the position H and the distance $l_1$ of the original $P_{n-1}$ to the position H vary slightly depending on a variance in a predetermined distance value Δ1, the distance that the original is forwarded by the registration rollers 11. As is described above, however, since the points that the leading ends of the original reach are specified for each original by the clock count obtained by the image leading end sensor 37, the difference between the reading start position H in the flow reading mode and the document leading end halt position in the fixation reading mode can be minimized, and a steady accuracy for the leading end registration can be acquired for both the flow reading mode and the fixation reading mode.

In FIG. 5D, the fixation reading exposure (a well known operation in which the document is fixed and the optical system reciprocates) has been performed for the original $P_n$ according to a count that is obtained by decrementing a set predetermined copy count by one, which corresponds to the exposure operation in the flow reading mode. Then, the original $P_n$ is shifted to the reverse roller pair 7 to enter the discharge process. The reverse roller pair 7 is controlled by performing PLL control of the reverse motor 55 to match the peripheral velocities of the wide belt 40 and of the reverse roller pair 7. Even when an original to be discharged is fed over both the wide belt 40 and the reverse roller pair 7, the loop formation and the conveying can be performed whereby the stress that is placed on the original is reduced to the minimum.

Figure 6D:
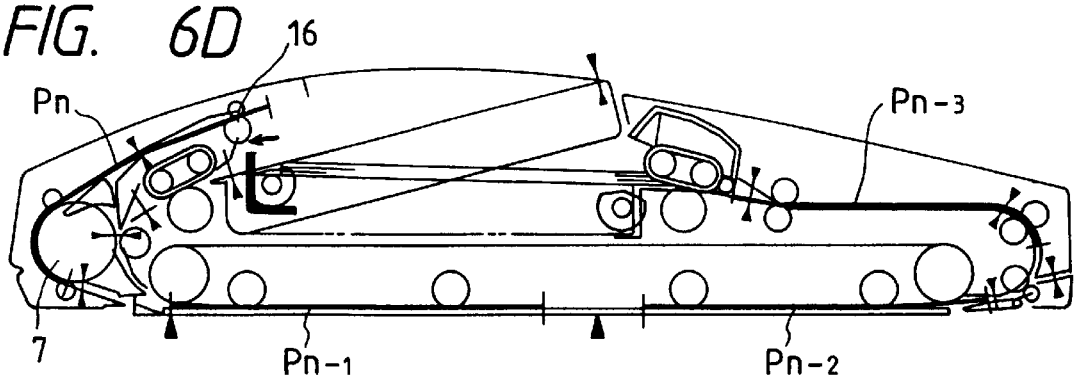
Figure 7A:
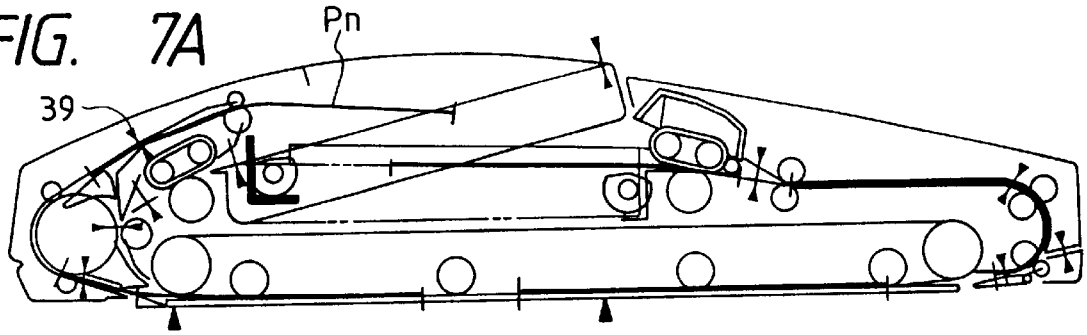
FIGS. 7A, 7B, 7C and 7D are diagrams showing the feeding of an original in a mixed mode.

Next, in FIG. 6D, the leading end of the original $P_n$ is nipped by the discharge rollers 16. The discharge rollers 16 are rotated by the discharge motor 61 at a velocity that is higher than the peripheral velocities of the wide belt 40 and the reverse roller pair 7. When the original is conveyed over the reverse roller pair 7 and the discharge rollers 16, the original is controlled and delivered by the reverse roller 7, which has the greater conveying force. When the trailing end of the original has passed the nipping portion of the reverse roller pair 7, the original $P_n$ is then discharged at the peripheral velocity that is inherent to the discharge rollers 16 and that is appropriate for stacking the discharged originals (FIG. 7A).

More specifically, when the original $P_n$ has passed through the nip of the reverse roller pair 7, the original $P_n$ is temporarily fed at a higher speed than the peripheral velocity of the reverse roller 7 so as to lengthen the distance between the original $P_n$ and the succeeding original $P_{n-1}$. When the trailing end of the original $P_n$ has passed through the paper ejection sensor 39, the original $P_n$ is conveyed at a lower speed, 200 to 400 mm/sec in this embodiment, which is appropriate for stacking the discharged originals.

Figure 7B:
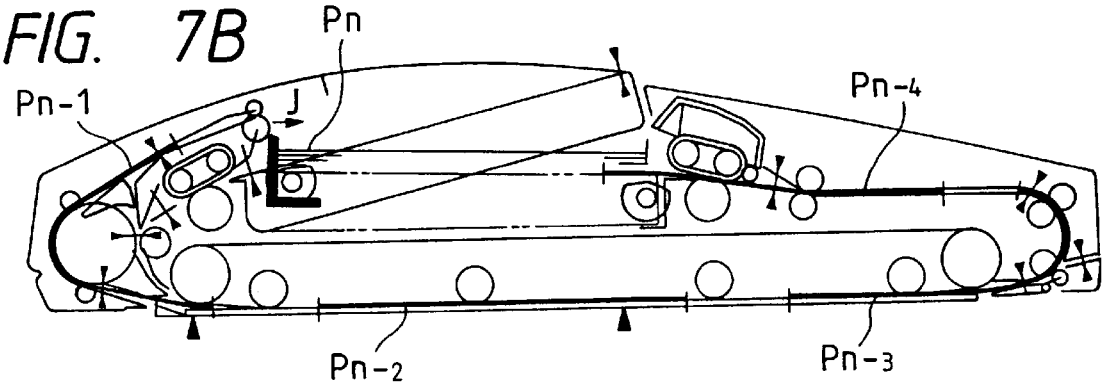

In FIG. 7B, the original $P_n$ is discharged and settles down on the stacked originals for which processing has not yet performed. Then, a given period of time later, the shutter 41 is driven by the shutter drive stepping motor 60 to perform a jog adjustment in direction J for the discharged original $P_n$ (FIG. 7B).

Figure 7C:
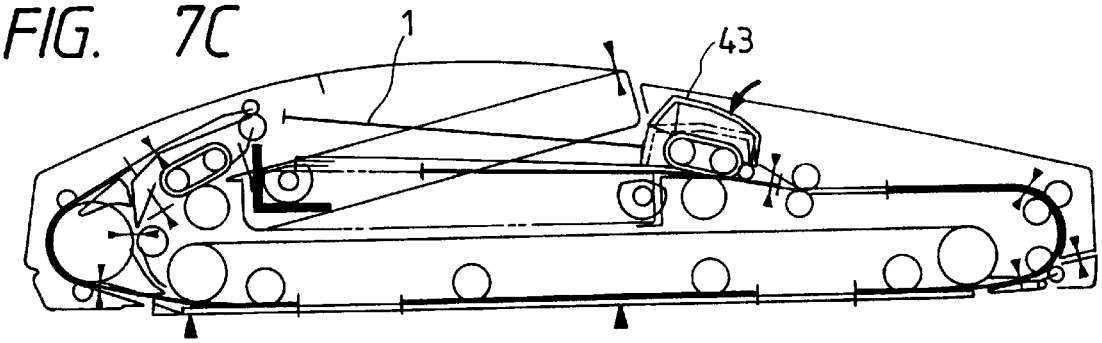

The above described document handling is repeated, and when the last original $P_n$ of the originals P has been circulated a predetermined number of times (a plurality of circulation circuits are performed when the set copy count is greater than the capacity of the printed sheet output side) and has been discharged, i.e., when the last sheet of the originals P circulated and is discharged, a partition member 43 descends and presses down on the original bundle P (see FIG. 7C). The partition member 43 is driven by the solenoid 74 in FIG. 2. More specifically, with the solenoid 74 on, the weight of the partition member 43 causes the partition member 43 to press down on the original bundle P, and prevents the originals for which the final scanning has been completed from entering the feeding sections 9 and 9' (the pressing force that the partition member 43 exerts downward on the original bundle P is light, so as not actively to assist the feeding of the lowermost original by the feeding auxiliary rollers 9").

The solenoid 75 is operated only when the partition member 43 must apply a pressing force to the original bundle P (in order to assist the feeding). That is, when the separation of the originals is not detected by the separation sensor 35 within a time t, which is determined for the original feeding sequence, the solenoid 75 is activated to cause the partition member 43 to place pressure on the original bundle that is equal to a predetermined load W, so that an active feeding force is applied to the paper feeding auxiliary roller 9" for the lowermost original (an original that is being separated and fed).

A mechanism is provided whereby the two solenoids 74 and 74 are employed to urge the partition member 43 to apply a stepping pressing force (a detailed explanation of the mechanism will not be given).

Figure 7D:
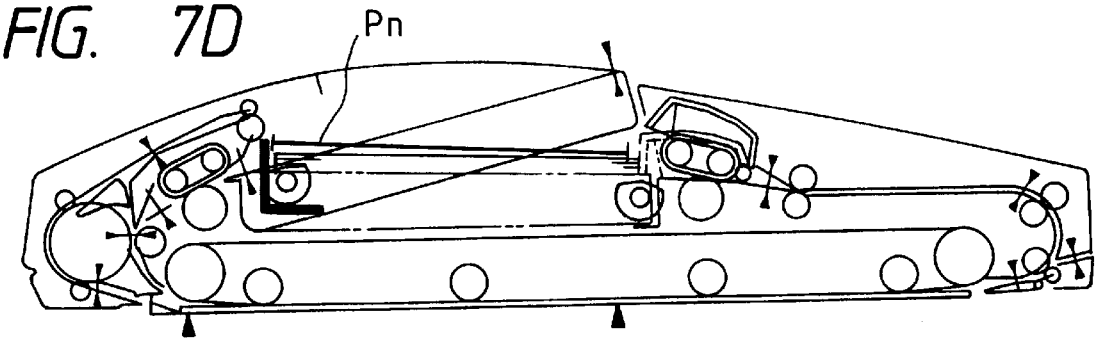
Figure 8A:
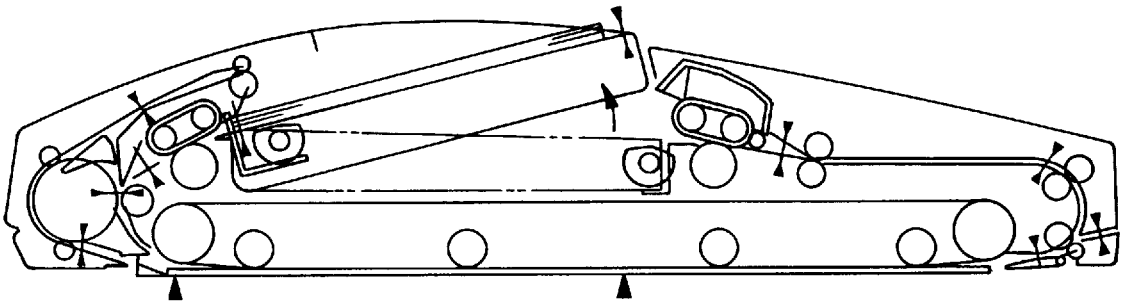
FIGS. 8A and 8B are diagrams showing the feeding of an original in a mixed mode.

In FIG. 7D is shown the state when the last original $P_n$ that is to be circulated is discharged. The tray 2 then ascends to the initial position (when the originals were set) (FIG. 8A).

Figure 8B:
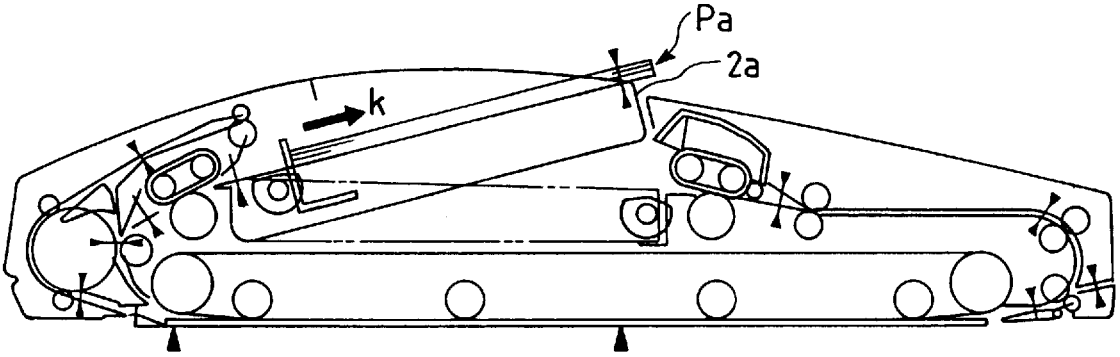

Sequentially, the original bundle P is shifted by the shutter 41 in the direction K, so that the leading end of the bundle P projects a little from the distal end $\mathbf{2}_a$ of the tray 2, and the removal of the original bundle P is thereby facilitated (FIG. 8B).

The operation that is associated with the flow of an original in the document processor has been described.

Figure 22:
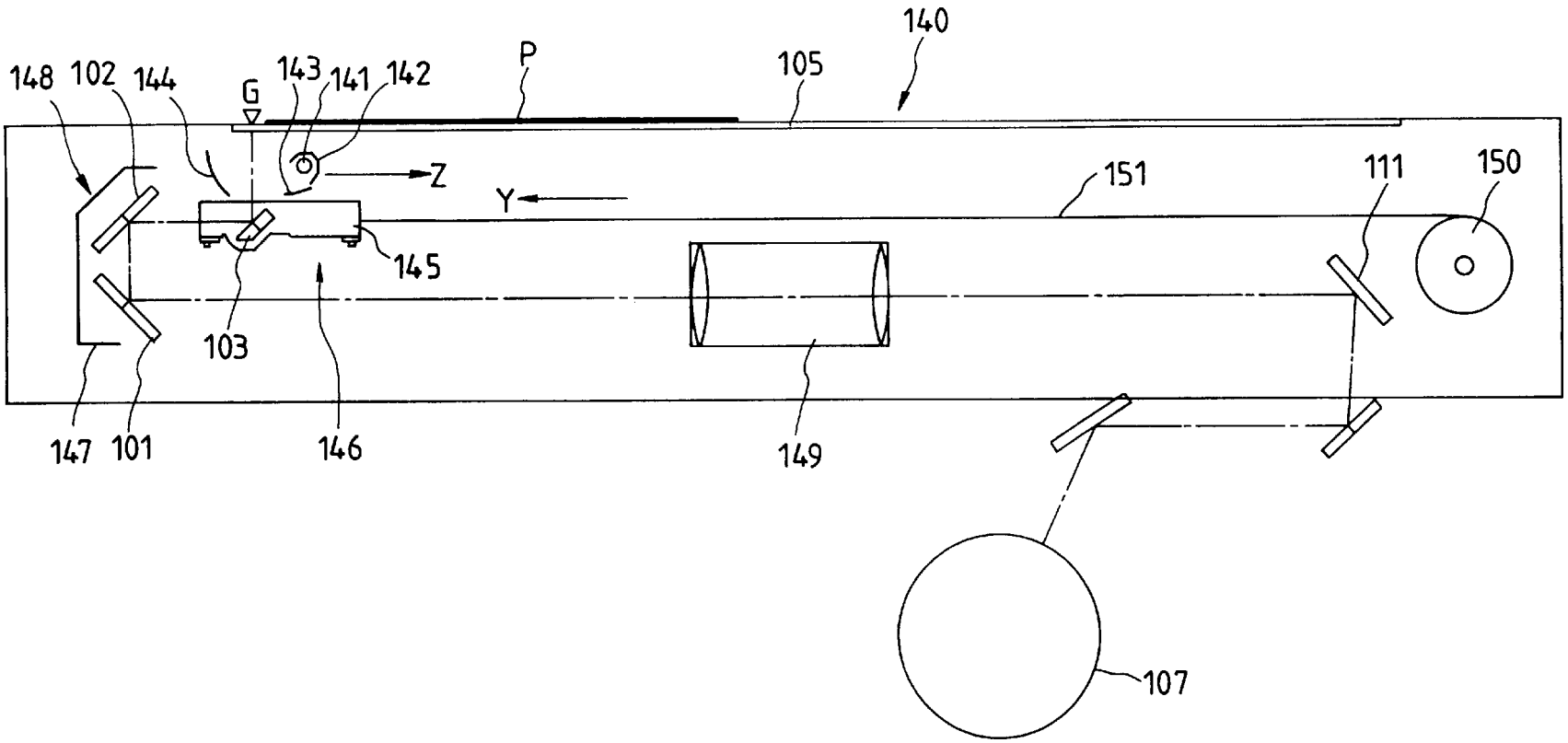
FIG. 22 is a schematic cross sectional view of an optical system when an original is positioned at a first leading edge position (document fixation reading mode)

The operation of the optical system of the apparatus will now be described. In FIG. 22, an optical system 140 that has a return mirror light path comprises: a first mirror assembly that includes a first mirror 103, a halogen lamp 141, a first reflector 142, a second reflector 143, a third reflector 144 and a first mirror support 145; a second mirror assembly 148 that includes a second mirror 102, a third mirror 101 and a second mirror support 147; a zoom lens 149; and a fourth mirror 111. The optical system 140 employs these components to transfer a document image on the platen glass 105 to the photosensitive drum. A drive pulley 150 is reciprocally rotated by the driving force of a drive motor (not shown). A wire 151, which is wound around the drive pulley 150 as it rotates, is provided that the first mirror assembly 146 and the second mirror assembly 148 can move under the platen glass 105 at a predetermined velocity.

In the fixation reading mode, the first mirror assembly 146 moves and scans an original P, which is placed on the platen glass 105, in a direction indicated by the arrow Z at a constant speed, with the first image leading end G as a reference point, and then exposes the original P. When the exposure of the original P is completed, the first mirror assembly 146 moves in reverse in a direction indicated by the arrow Y and returns to the first image leading end position G. For a plurality of copies or copy sets, the first mirror assembly 146 begins to move and scan in the direction Z. In the flow reading mode and in the mixed mode, as well as in the above described fixation reading process, the first mirror assembly 146 must be halted at the second image leading end position H.

Figure 23:
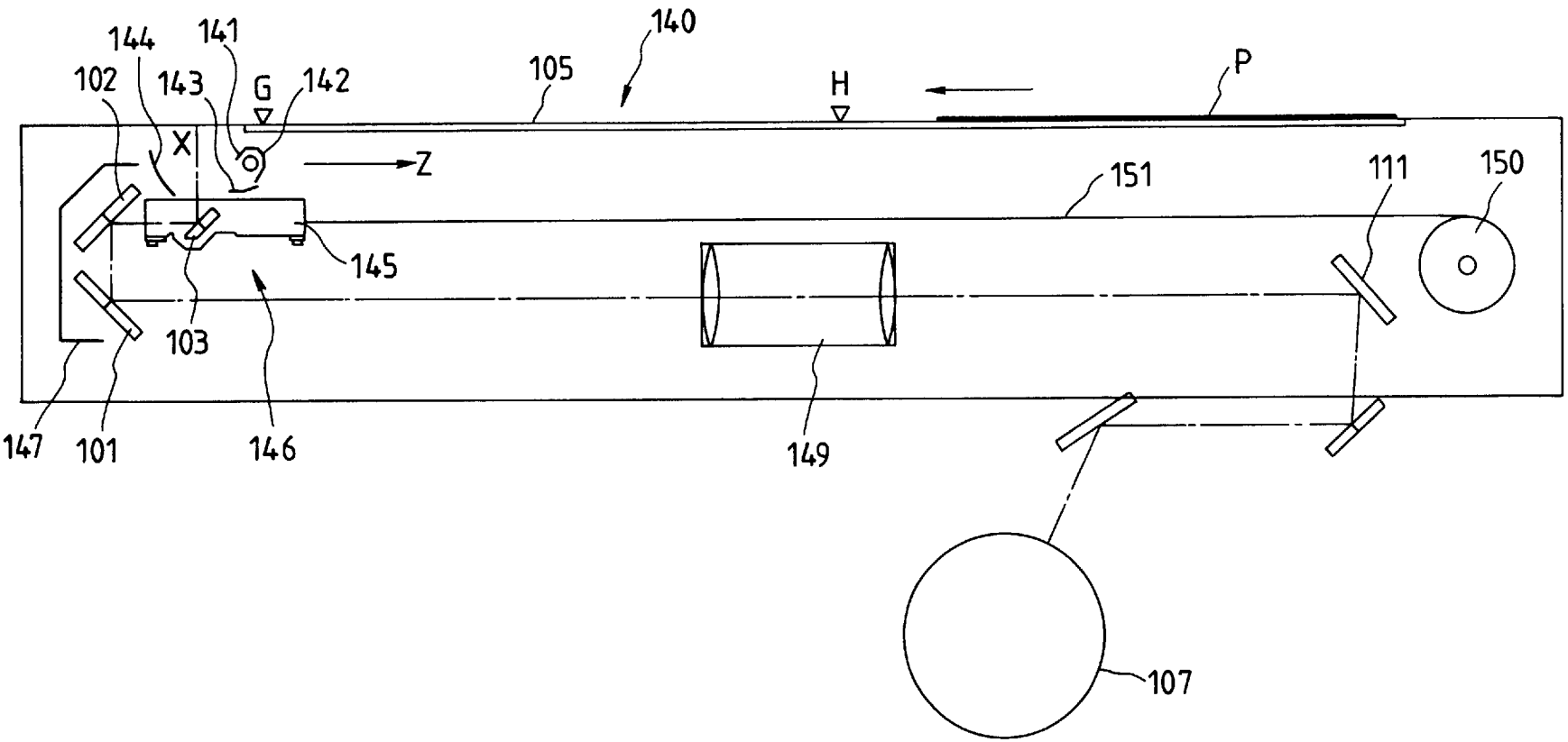
FIG. 23 is a cross sectional view of the optical system when an original is located at a home position.
Figure 24:
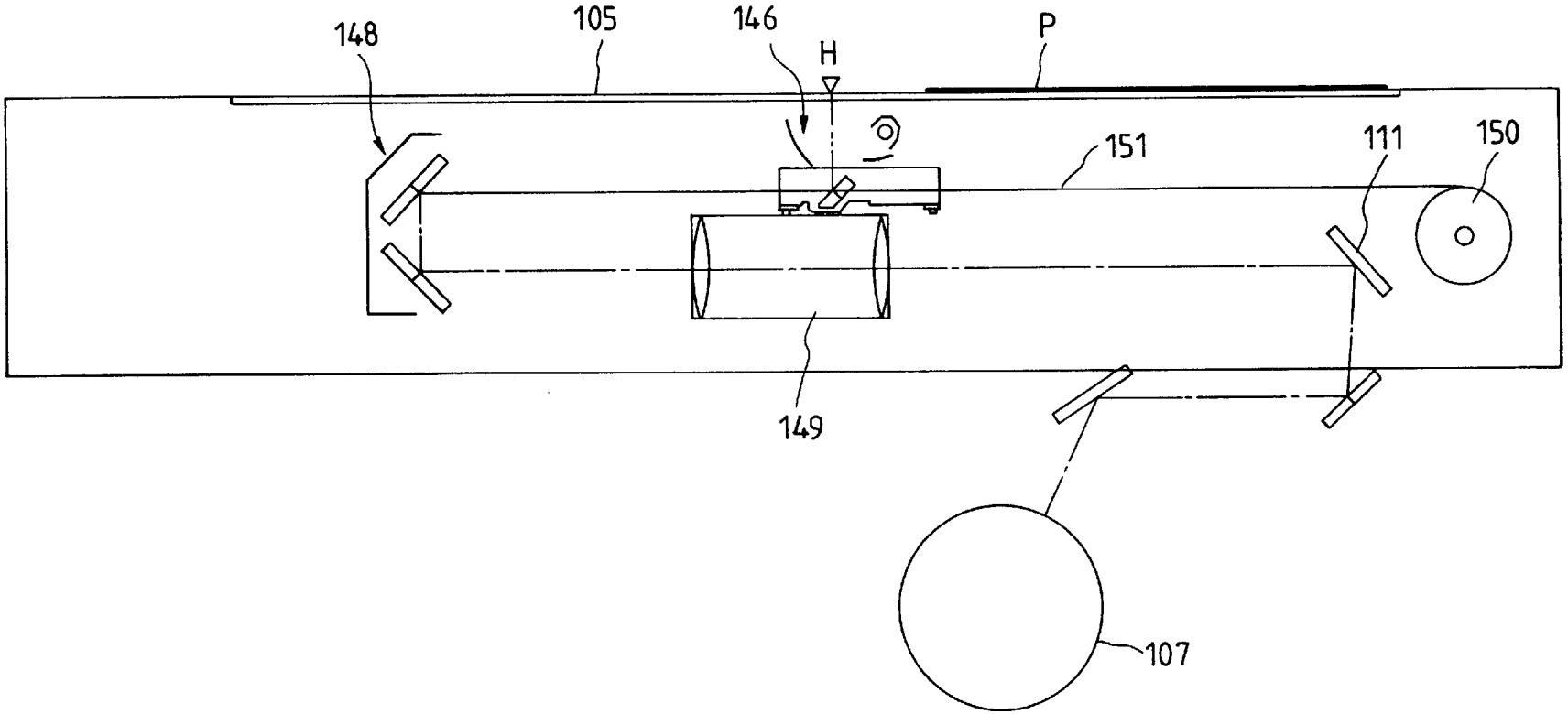
FIG. 24 is a schematic cross sectional view of an optical system when an original is positioned at a second leading edge position (document flow reading mode)

As is shown in FIG. 23, the first mirror assembly 146 is ordinarily located at a home position for the mirror system (the exposure unit is located at position X). In response to a flow reading mode command or a mixed mode command, the first mirror assembly 146 moves under the platen glass 105 in the direction Z, or moves while exposing and scanning, and stops at the second image leading end position H. Then, while the first mirror assembly 146 remains at the second image leading end position H, it performs exposure and scanning for the original P, which is shifted across the upper face of the platen glass 105 by the RDF 1 (not shown) at a constant speed. In the flow reading mode, as is described above, a signal is output from the RDF 1 at the registration time, and upon receipt of that signal, the controller 120 of the copying machine is activated to perform the registration of an image transfer sheet. At this time, it is absolutely necessary that the first mirror assembly 146 be halted exactly at the second image leading end position H (FIG. 24).

Figure 25:
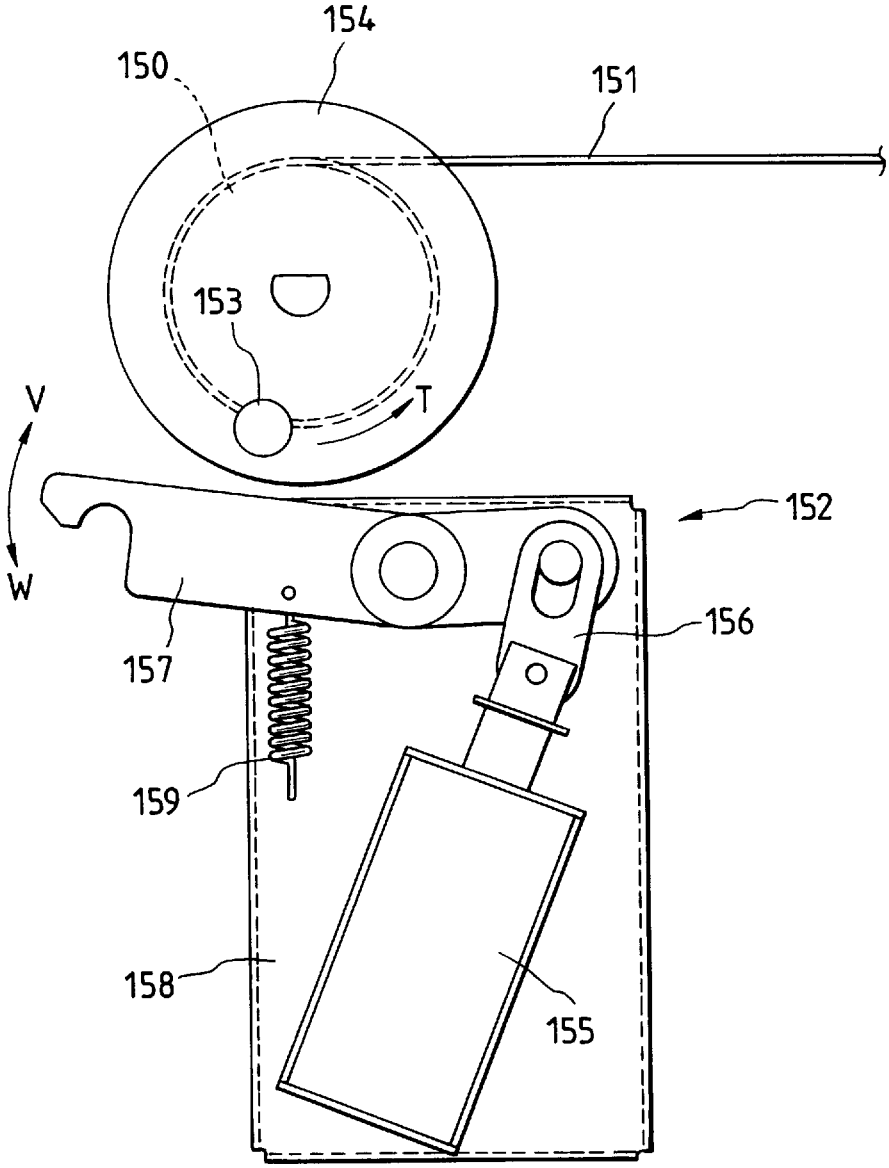
FIG. 25 is a side view of an optical system driving pulley and an optical system locking mechanism.

In order to accomplish this requirement, according to the present invention, a locking mechanism 152 is provided, as is shown in FIG. 25, to position the first mirror assembly 146 and the second mirror assembly 148. A rotary support disk 154 that has an engagement pin 153 is fitted around the rotary shaft, which also serves as the rotary shaft of the drive pulley 150 that moves the first mirror 146 and the second mirror 148. Downward from the rotary disk 154, a lock arm 157 is attached to a support board 158 and is rotated by a solenoid 155 and a connecting arm 156 in the directions indicated by the double headed arrow W↔V. The lock arm 157 is normally held at the position (a retracted position) in FIG. 25 during the OFF state of the solenoid 155 by the force of a tension spring 159.

Figure 26:
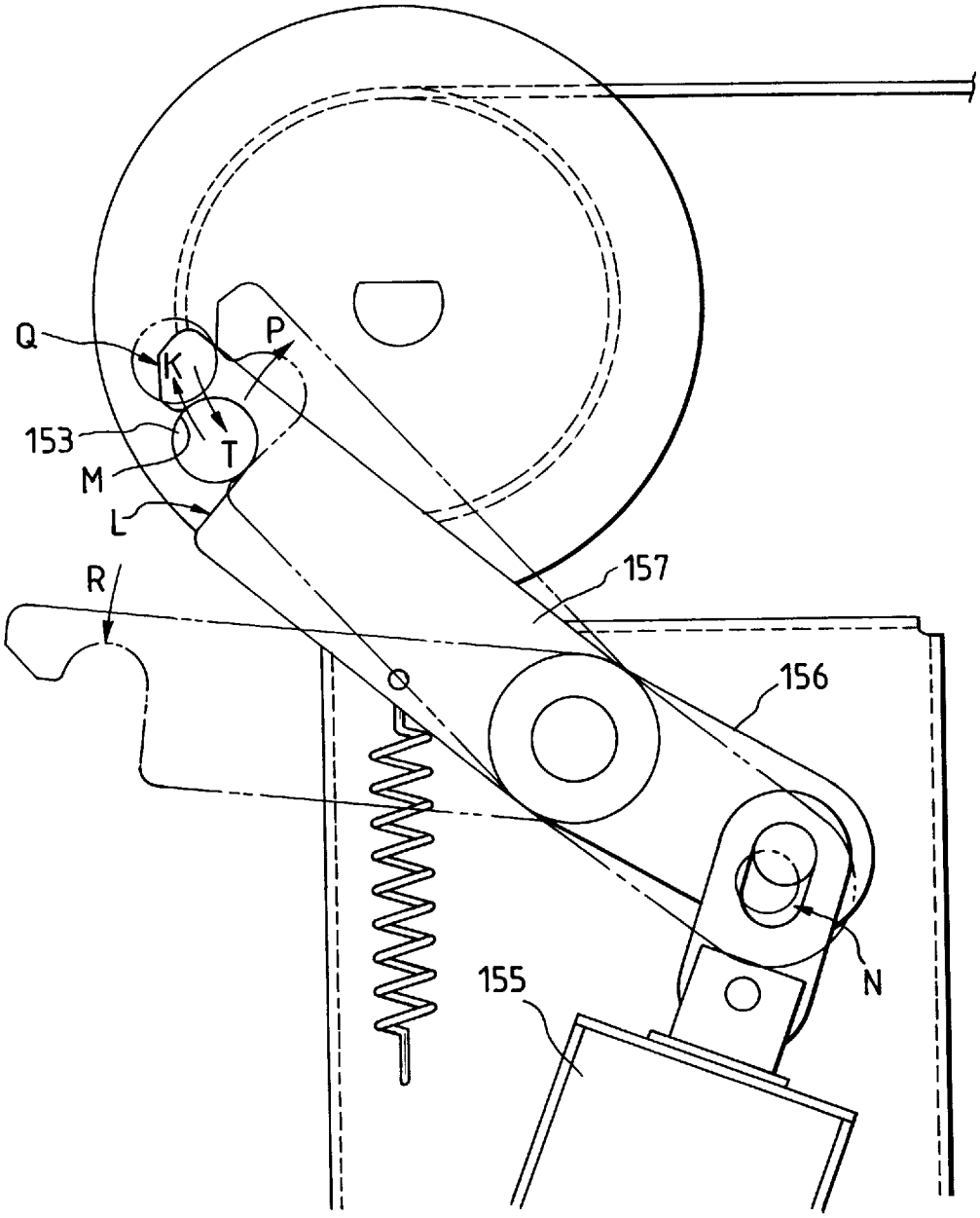
FIG. 26 is a diagram showing the operation of a pin lever when the optical system is locked.

In the flow reading mode, the drive pulley 150 rotates in the direction indicated by the arrow T to bring the first mirror assembly 146 to the second image leading end position H. In order to halt the first mirror assembly 146 exactly at the second image leading end position H, as is shown in FIG. 25, the solenoid 155 is displaced in the direction indicated by the arrow V and is turned on, and the lock arm 157 is displaced to a position (an operating position) that is indicated by the solid lines of the connecting arm 156. In FIG. 26, as the disk 154 rotates around the same axis as that of the drive pulley 150, the engagement pin 153 enters the lock arm 157 at the operating position in a direction that is indicated by the arrow T, contacts a chamfered portion Q of the lock arm 157, and pushes the lock arm 157 up in direction P.

An engagement portion N of the connecting arm 156, where it connects with the lock arm 157, is an elongated hole, so that the lock arm 157 can be displaced from the operating position in the direction indicated by the arrow P. After the engagement pin 153 pushes the lock arm 157 in the direction indicated by the arrow P, it continues to rotate in the direction indicated by the arrow T until it abuts upon the wall L of the lock arm 157 and is halted. The engagement pin 153 pushes the lock arm 157 up in the direction indicated by the arrow P and it continues to rotate in the direction indicated by the arrow T until it abuts upon the wall L of the lock arm 157 and is halted.

As the lock arm 157 is retracted to the position indicated by the solid lines by the tension spring 159 and engages the engagement pin 153, the rotation of the drive pulley 150 is stopped and the first mirror assembly 146 is halted at a predetermined position. While taking the impact due to the engagement into consideration, the rotation speed for the engagement pin 153 is reduced until it is low enough to engage the lock arm 157.

When the first mirror assembly 146 is to return from the second image leading end position H to the first image leading end position G for flow reading, the engagement pin 153, which is coupled with the lock arm 157, pushes up the internal chamfered portion L of the lock arm 157 and the disk 154 is rotated inversely in the direction indicated by K. When the engagement pin 153 is disengaged from the lock arm 157, the solenoid 155 is already turned off, and the lock arm 157 is returned to its retracted position by the tension spring 159.

The movements of an original, of the optical system, and of the paper supply side when the copying sequence is performed in a mixed mode will now be briefly described.

Figure 12A:
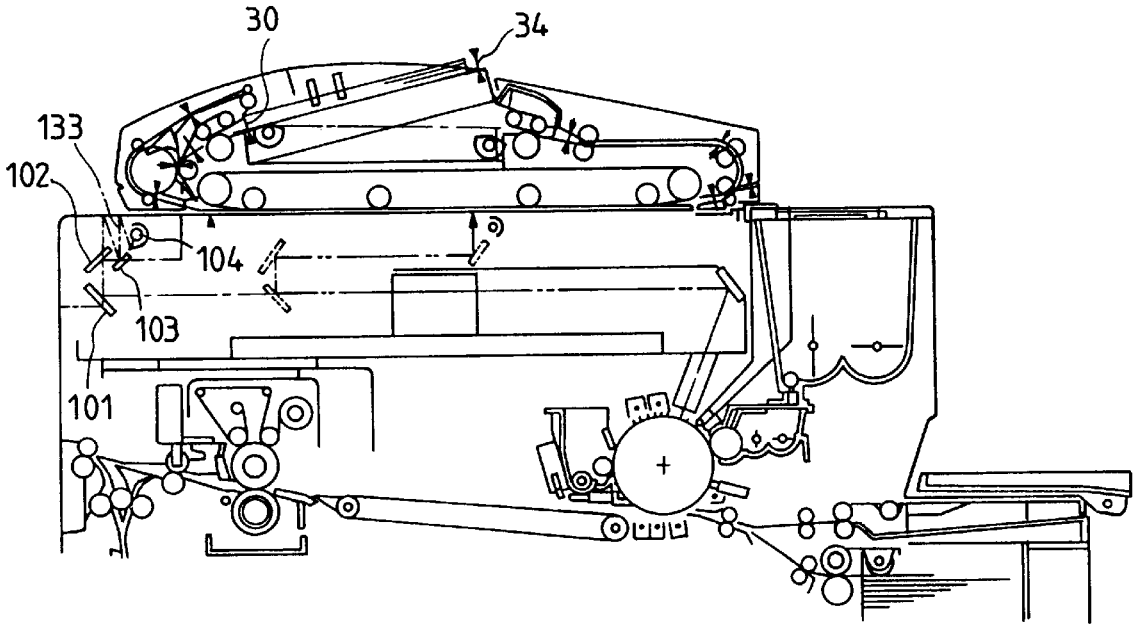
FIGS. 12A and 12B are schematic diagrams for explaining the movement in a mixed mode of an original, of an optical system, and of a copy sheet.
Figure 12B:
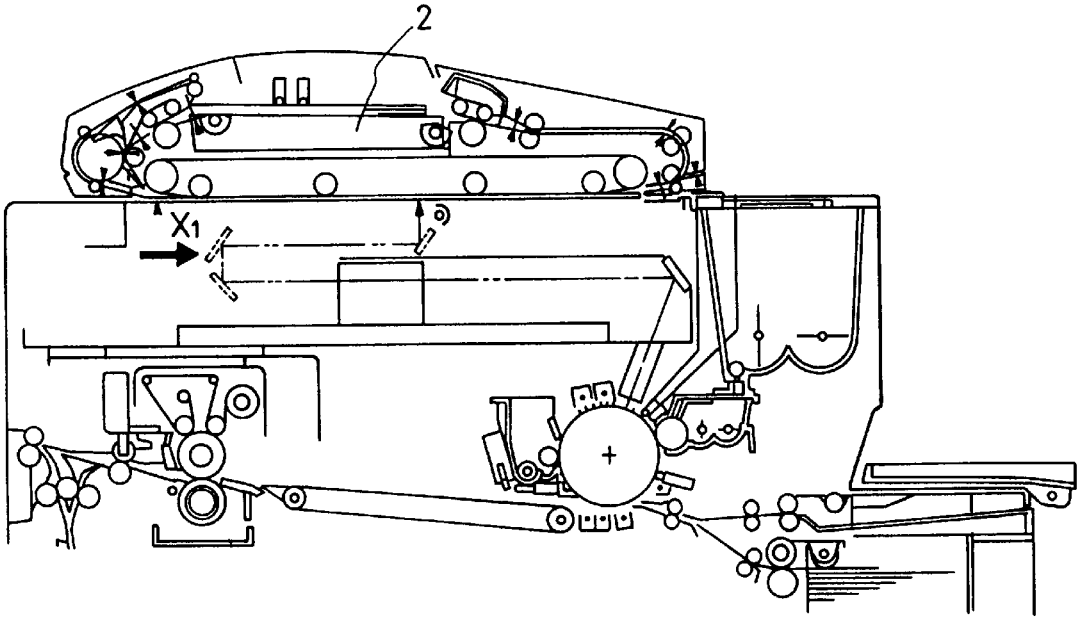
Figure 13A:
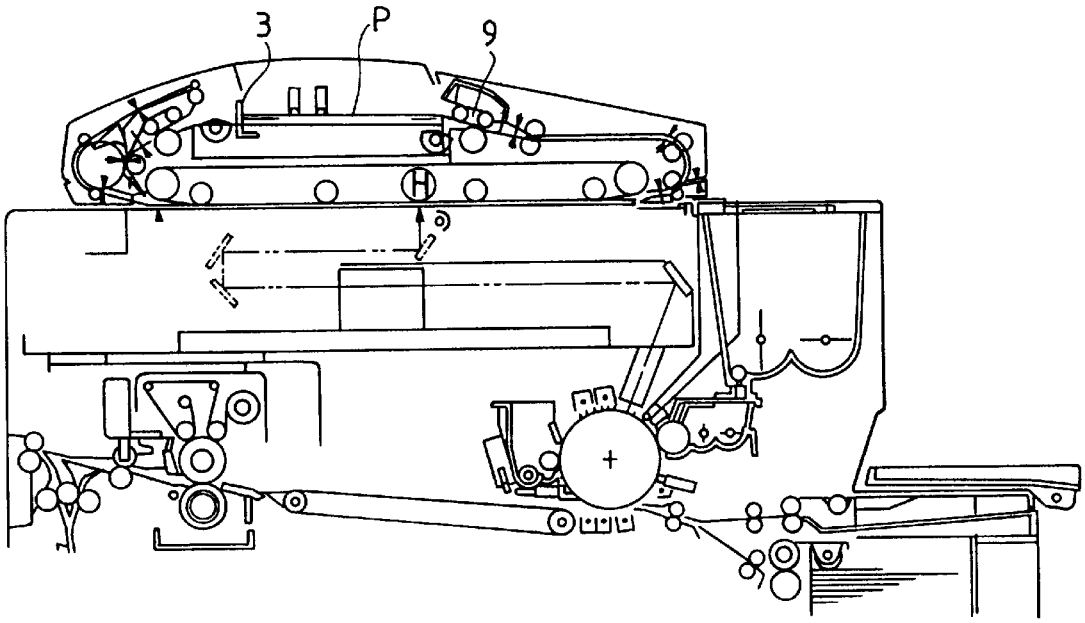
FIGS. 13A and 13B are schematic diagrams for explaining the movement in the mixed mode of an original, of an optical system, and of a copy sheet.

In FIG. 12A is shown the state where the originals are stacked on the tray 2. The flow reading path (indicated by B in FIG. 1) is selected by pressing down a copy start button (not shown) of the copy machine, and the empty sensor 30 by turning off the document size sensor 34 and by referring to the data for the width of the document (detection means (not shown) for the document width is provided by employing the restricting plate 4 and a member opposite to the plate 4). Then, the tray 2 is rotated clockwise in the vicinity of the left end of the tray (FIG. 12B). The bundle trailing end impelling means drives the original bundle P from the rear and moves it to the right side paper supply section 9 (FIG. 13A).

When the flow reading mode is established, the optical system, which consists of the components 101, 102, 103, 104 and 133, begins to move in the direction $X_1$ (FIG. 12B). The exposure unit 133 is halted and locked at the flow reading image leading end position H (FIG. 13A).

Figure 13B:
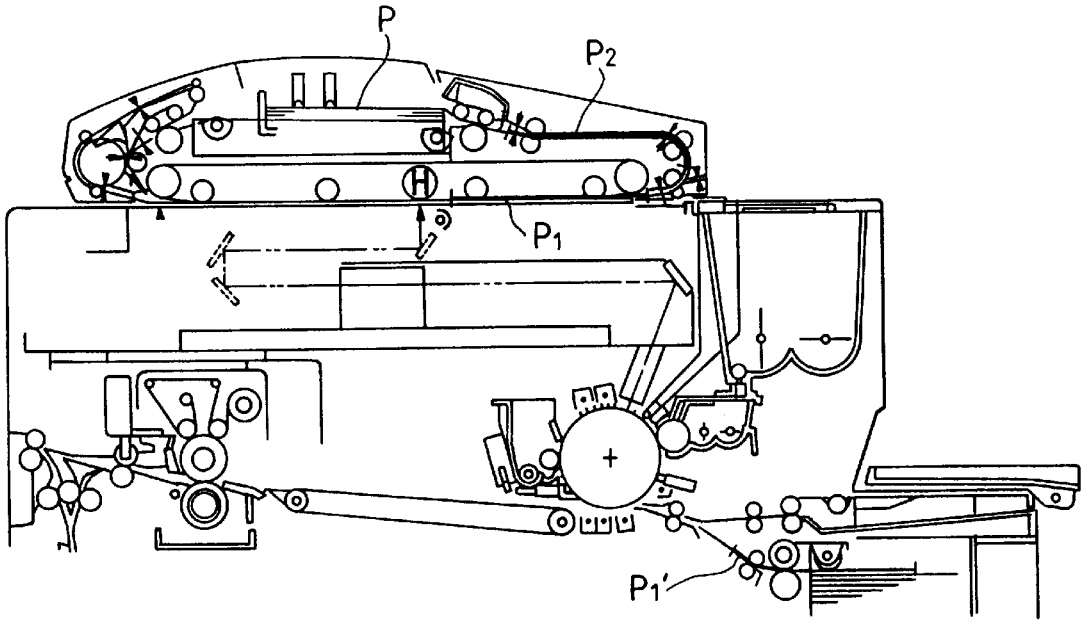
Figure 14A:
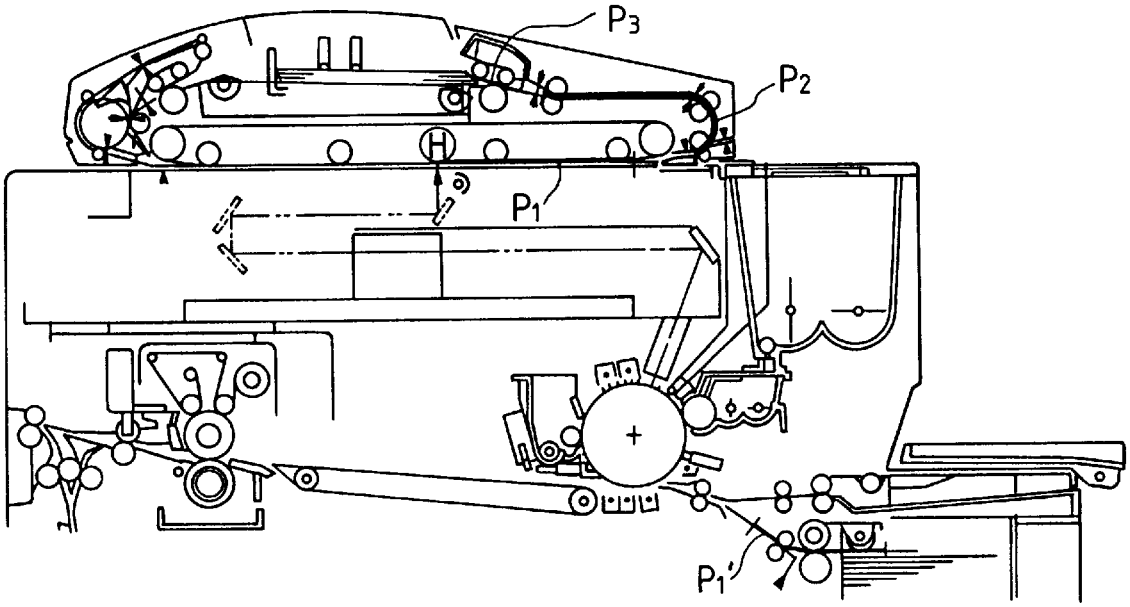
FIGS. 14A and 14B are schematic diagrams for explaining the movement in the mixed mode of an original, of an optical system, and of a copy sheet.

When the lowermost original $P_1$ of the originals P reaches the flow reading standby position in FIG. 13B, feeding of a transfer sheet $P'_1$ is also begun. When the transfer sheet reaches a position that is equivalent to that where $P_1$ is located, the RDF ascertains it by employing the clock count that has been acquired since the original $P_1$ passed the image leading end sensor 38, and outputs a standby position arrival signal to the apparatus. In response to this signal, a CPU (not shown) of the apparatus transmits an exposure start permission signal to the RDF. Upon receipt of this signal, the RDF starts to feed the original $P_1$. When the leading end of the original $P_1$ reaches the flow reading image leading end position H, the RDF transmits an image leading end signal to the apparatus, and the exposure for image forming is thereafter performed (FIG. 14A).

The time at which the original $P_1$ reaches the image leading end position is also ascertained by using a clock count that has been acquired since the leading end of the original $P_1$ passed by the image leading end sensor 38.

Figure 14B:
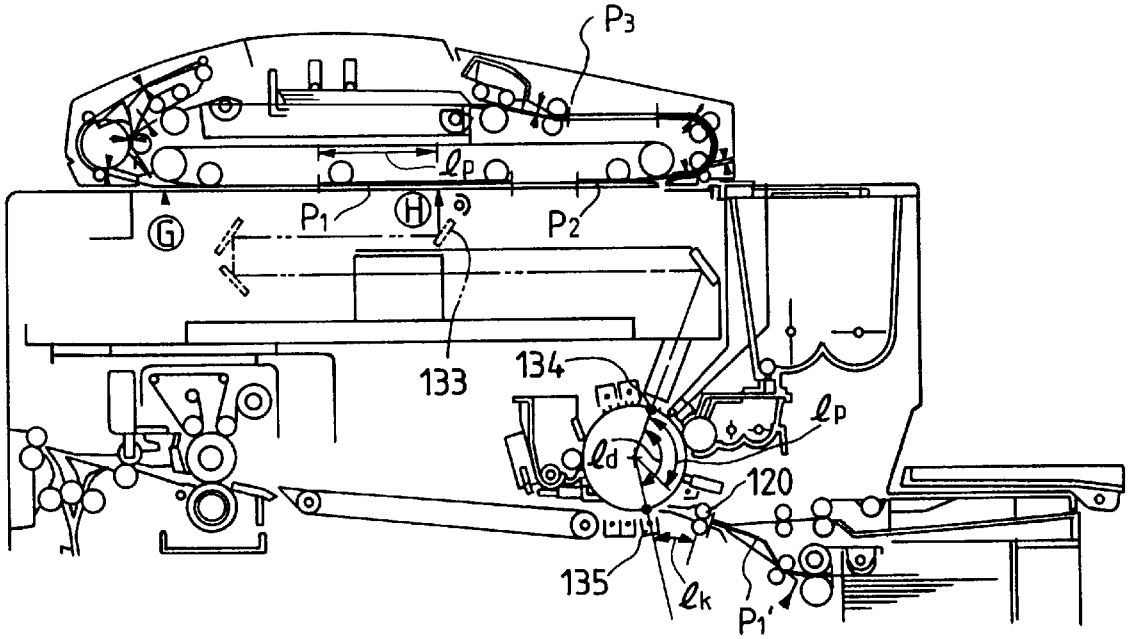
Figure 15A:
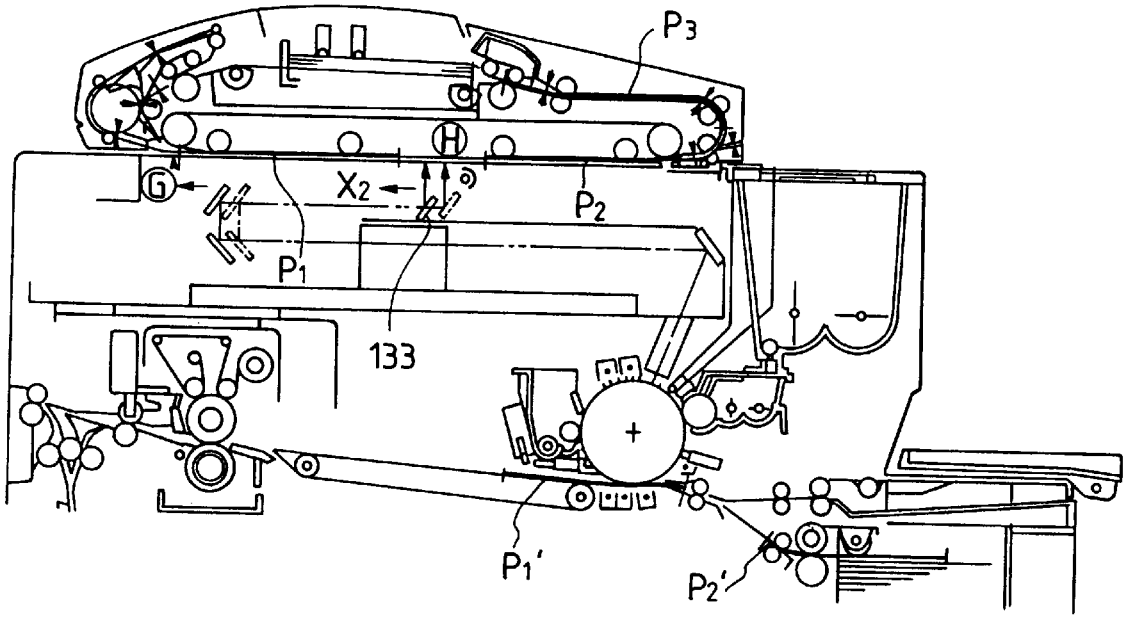
FIGS. 15A and 15B are schematic diagrams for explaining the movement in the mixed mode of an original, of an optical system, and of a copy sheet.

In FIG. 14B is shown the state where the flow reading and the exposure are performed for the original $P_1$. To align the leading end of the transfer sheet with that of the image, the registration rollers 120 are turned on at such a time as there is established a relationship of ld−lp≈lk, where ld denotes the distance from the exposure position 134 of the photosensitive drum 107 to the transfer position 135, lp denotes the distance from the registration rollers 120 to a transfer unit, and lk denotes the distance from the registration roller 120 to the transfer position 135 (FIG. 14B). When the trailing end of the original $P_1$ has passed the exposure position, an optical system return signal is sent by the RDF and the optical system thereafter begins to return in the direction indicated by $X_2$ (to the first image leading end position) (FIG. 15A).

Figure 15B:
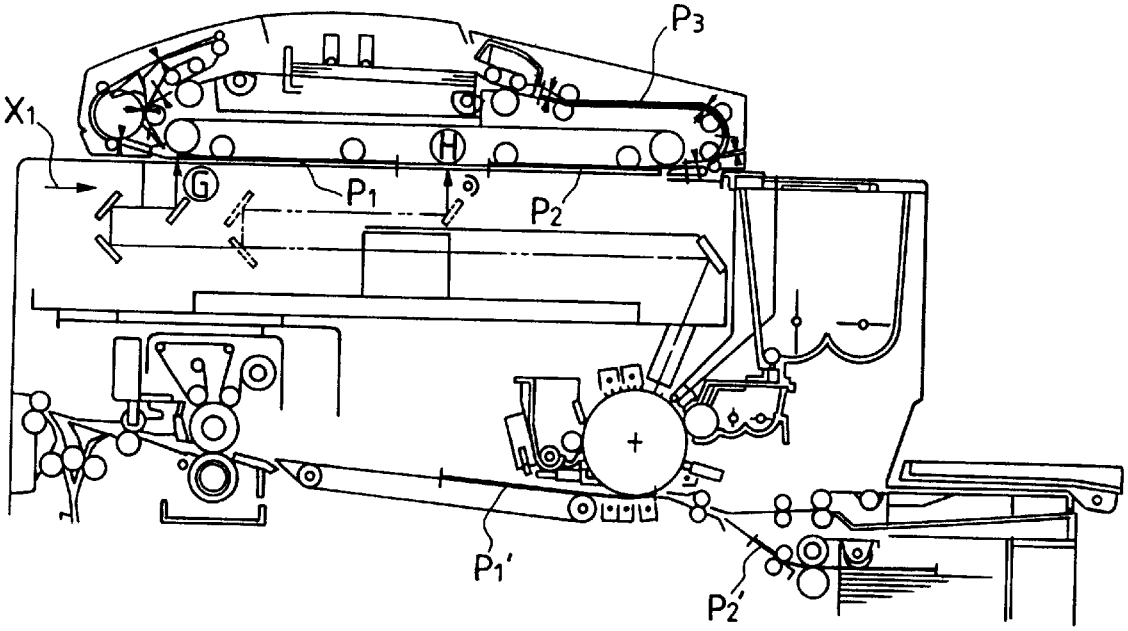
Figure 16A:
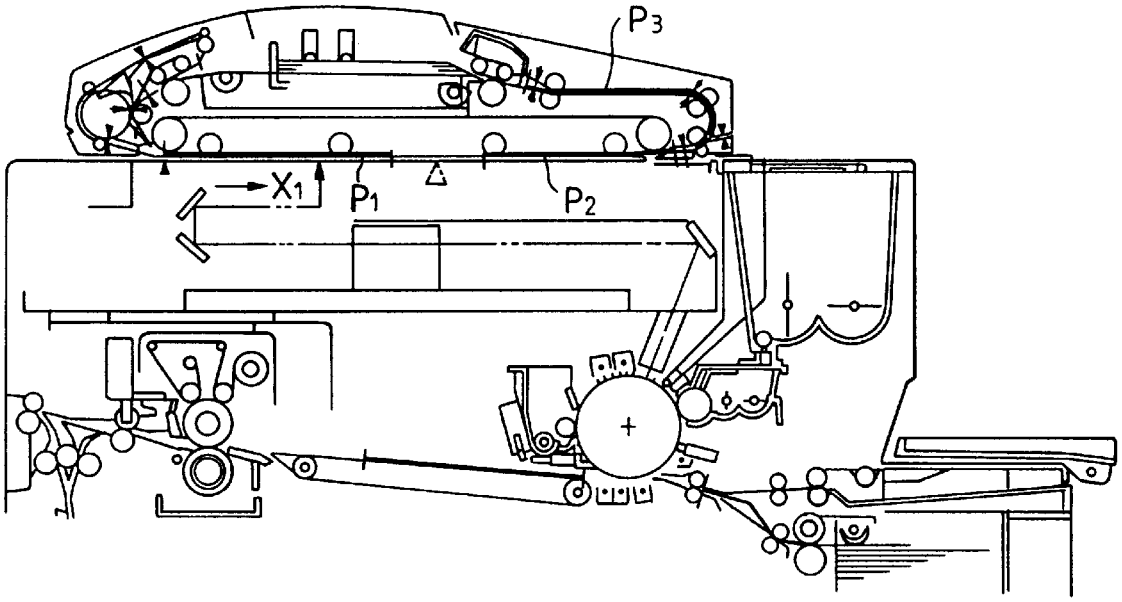
FIGS. 16A and 16B are schematic diagrams for explaining the movement in the mixed mode of an original, of an optical system, and of a copy sheet.
Figure 16B:
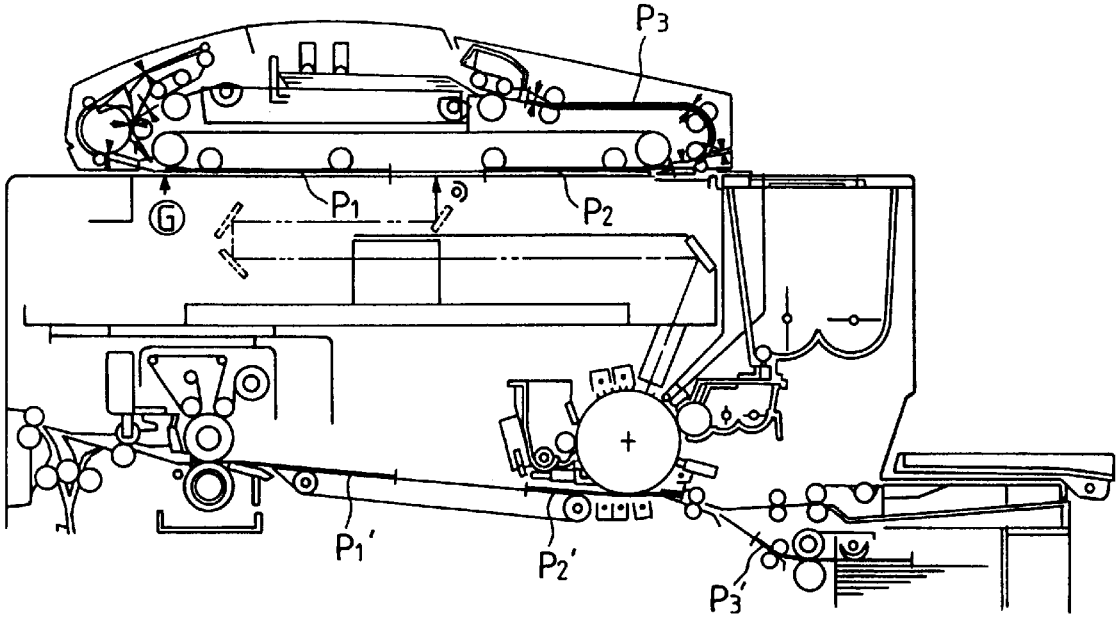

After the arrival at the home position that is as the first image leading end position (detected by a home position sensor (not shown)), the common fixation reading mode begins, in which the exposure is performed while the optical system is moving and the original $P_1$ is fixed. At this time, the original $P_1$ is already located at the first image leading end position (fixation reading image leading end position G). In FIG. 15B is shown the state where the optical exposure unit 133 has reached the first image leading end position G, while in FIG. 16A is shown the state where the exposure is performed by shifting the optical system.

Thereafter, the optical system reciprocates for the copy count n that is set and repeats the exposure n−1 times (since the exposure is performed one time in the flow reading mode, the scanning that is performed by moving the optical system is therefore n−1 times).

Since the acquisition of the timing at which the original was fed, and at which the transfer sheet is fed during an exposure that is performed by moving the optical system, is well known, no explanation for it will be given here.

In FIGS. 12A through 17B is shown the process for making two sets of copies. The flowing reading and exposure and the fixation reading and exposure are each performed one time. To make one set of copies, the fixation reading is not required, and only the flow reading and exposure is performed while the optical system is positioned at the flow reading image leading end position H.

Figure 17A:
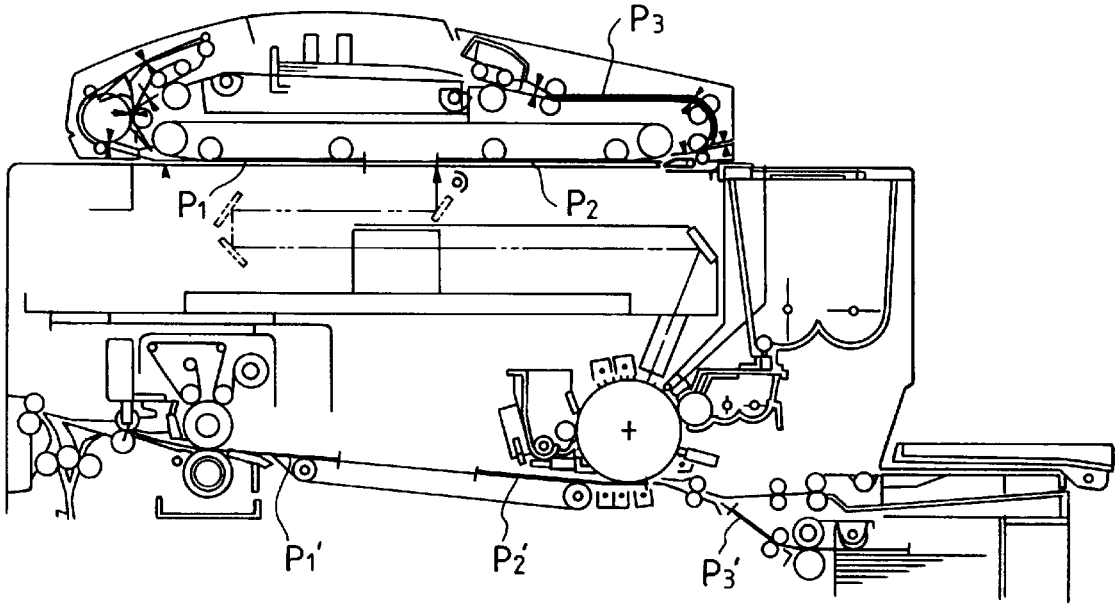
FIGS. 17A and 17B are schematic diagrams for explaining the movement in the mixed mode of an original, of an optical system, and of a copy sheet.
Figure 17B:
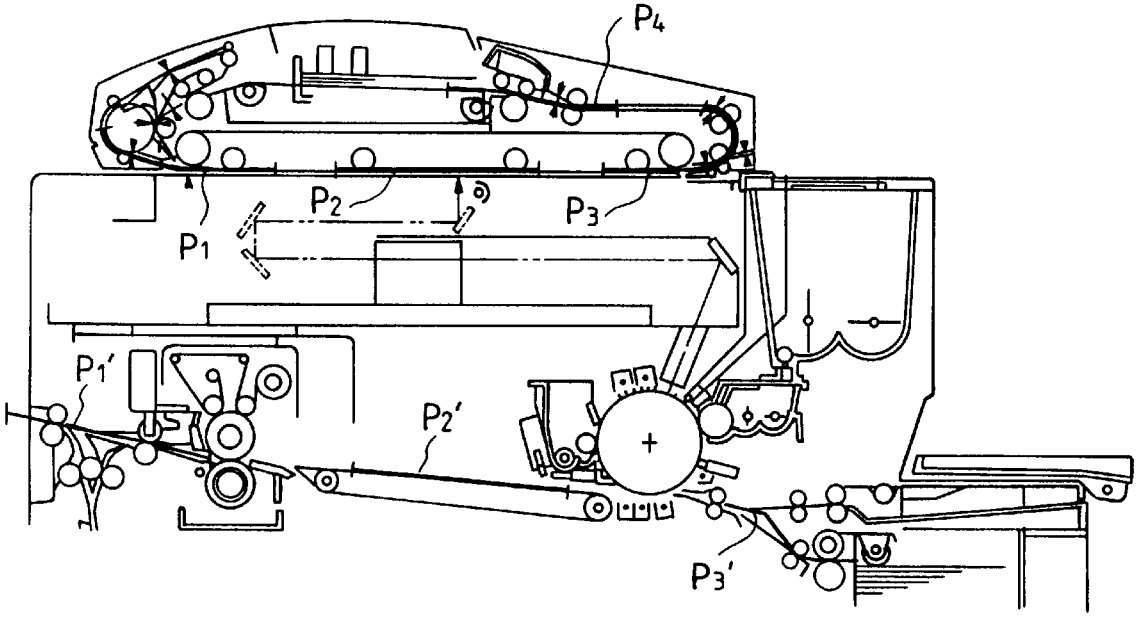
Figure 18A:
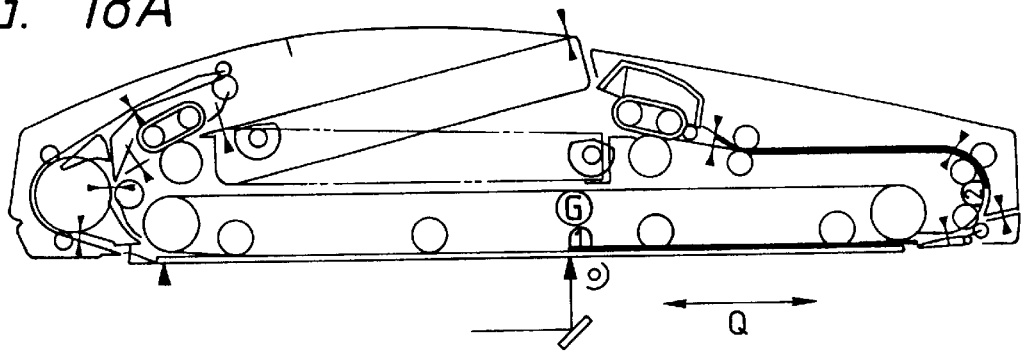
FIGS. 18A, 18B, 18C and 18D are schematic diagrams for explaining the movement in the mixed mode of an original, of an optical system, and of a copy sheet.
Figure 18B:
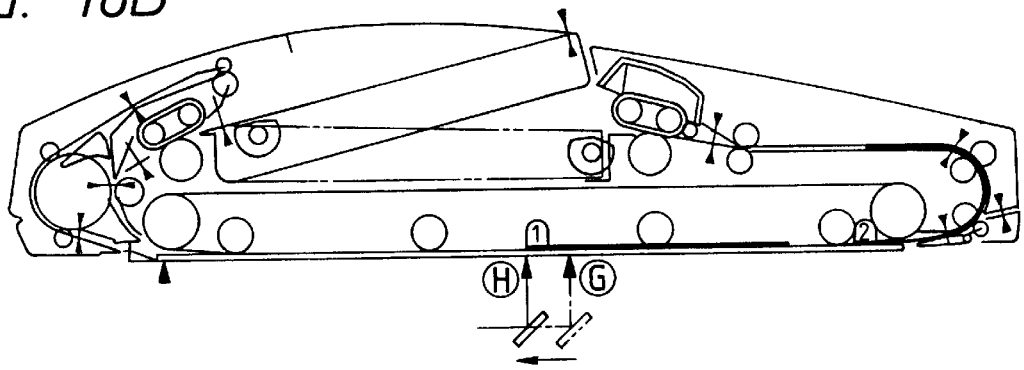
Figure 18C:
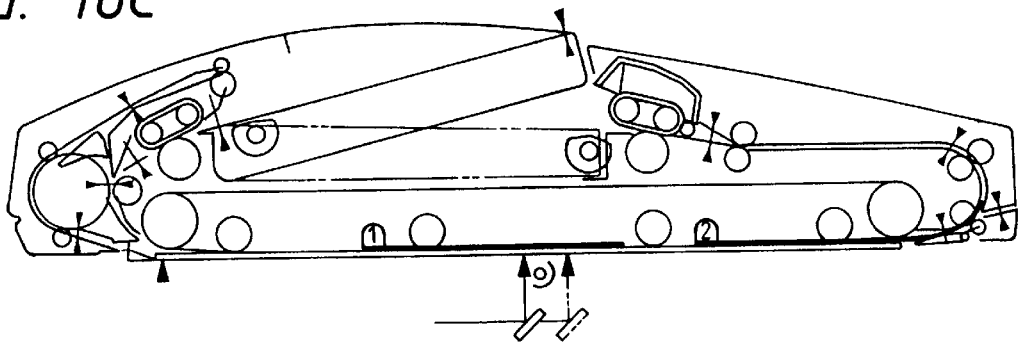
Figure 18D:
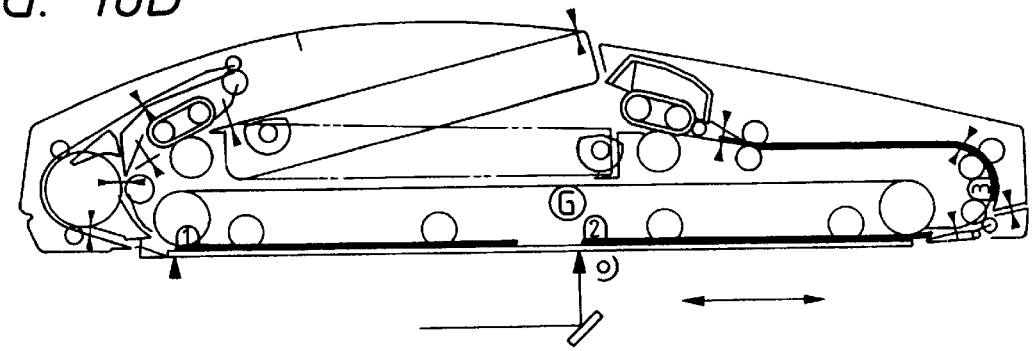
Figure 19:
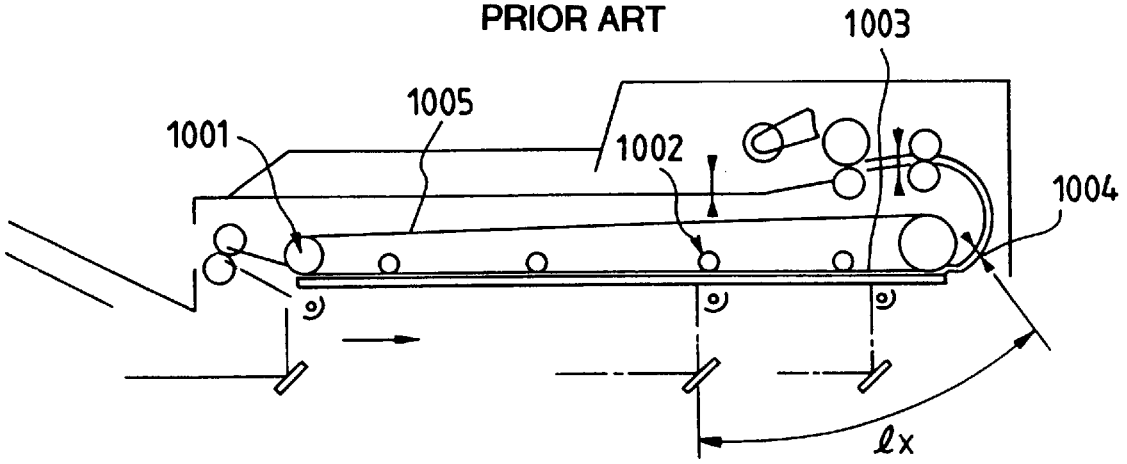
FIG. 19 PRIOR ART
FIG. 19 is a cross sectional view of an ADF apparatus that has been proposed.
Figure 20:
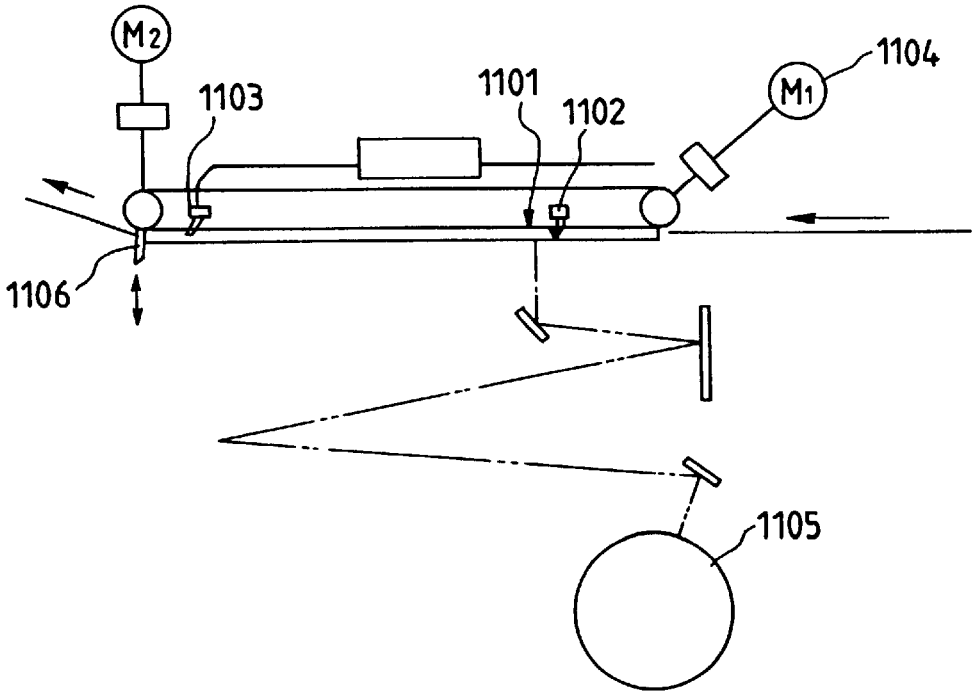
FIG. 20 PRIOR ART
FIG. 20 is a cross sectional view of another ADF apparatus that has been proposed.
Figure 21:
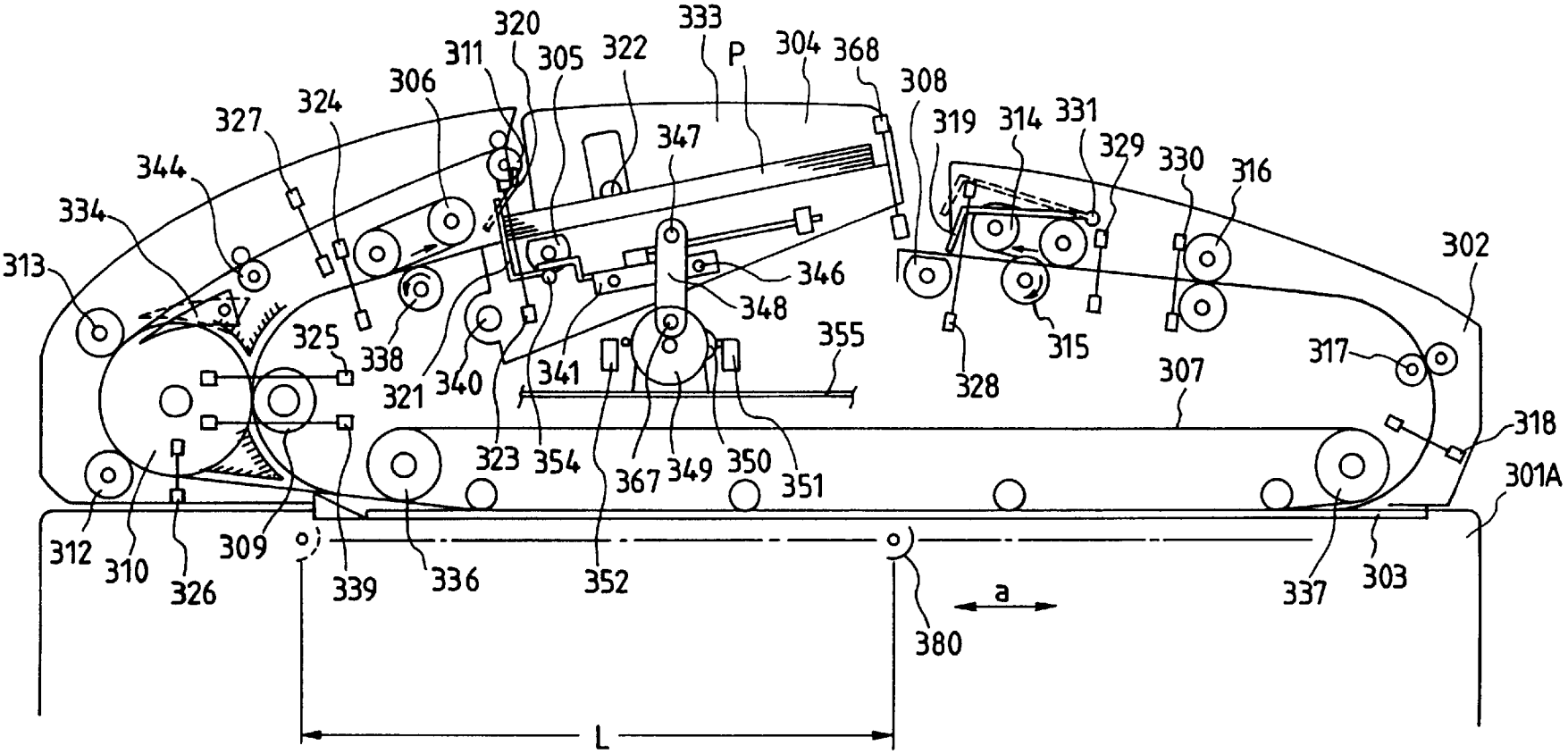
FIG. 21 PRIOR ART
FIG. 21 is a cross sectional view of an additional ADF apparatus that has been proposed.

Since the flow reading and exposure are to be performed for the succeeding original $P_2$ after the completion of the scanning that is performed by moving the optical system, the optical system does not return to the first image leading end position G. Instead, the optical exposure unit 133 is halted at the flow reading image leading end position H that is advanced a predetermined distance (a speed reduction and halting interval) in the direction $X_1$ (FIG. 16A). Then, the flow reading for the second original $P_2$ is begun. During the flow reading and exposure of the second original, the preceding original P is passed through the left side of the platen and discharged onto the tray 2. Since the timing relationship is the same as that for the original $P_1$, no explanation for this will be given (FIGS. 17A and 17B).

Thereafter, the same process is repeated for all of the originals P, and the copying sequence is terminated.

(RDF control unit)

Figure 27:
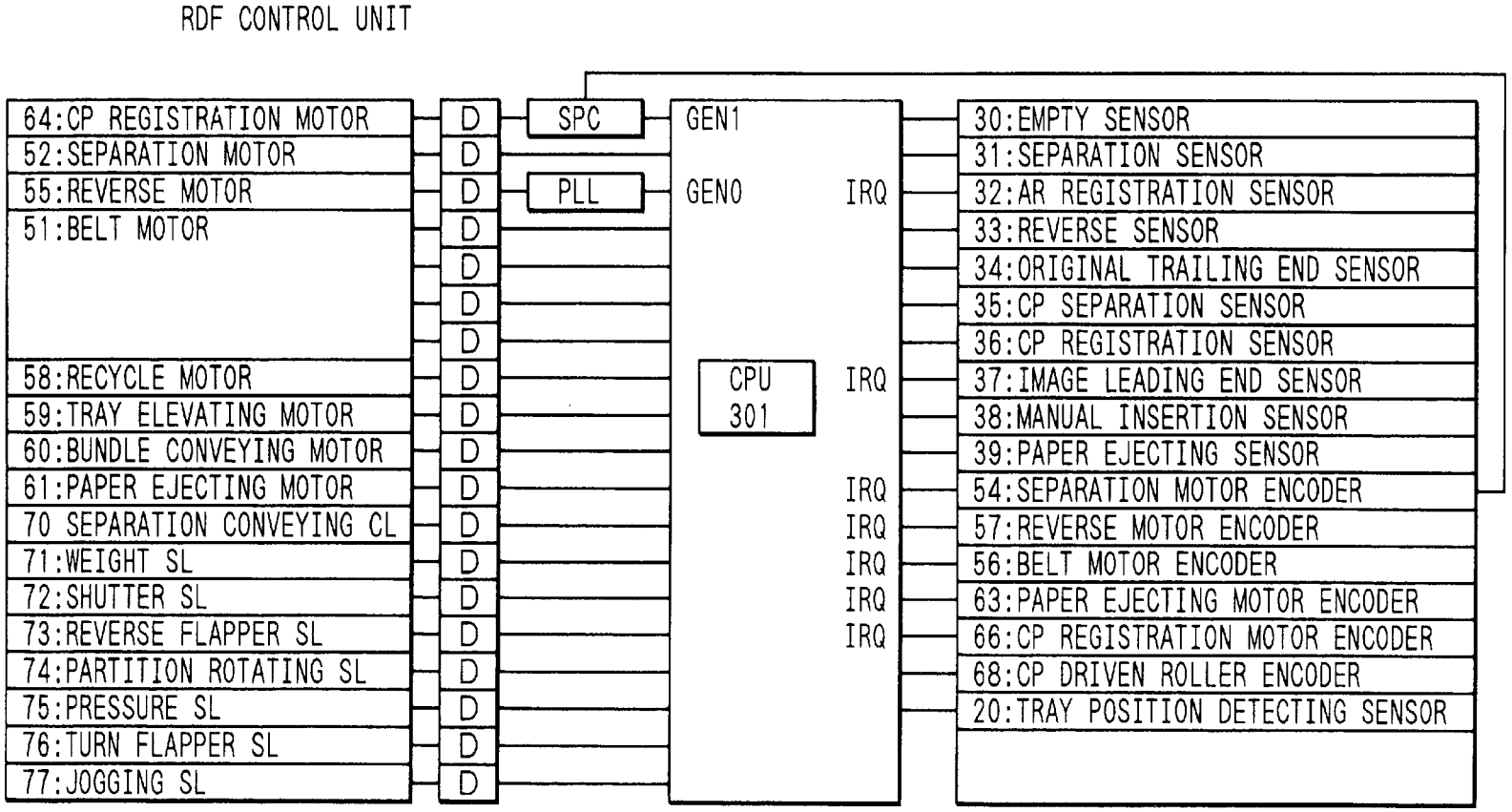
FIG. 27 is a block diagram showing an RDF controller.

FIG. 27 is a block diagram illustrating the circuit structure of a control unit for the RDF in this embodiment.

The RDF control unit is constituted mainly by a one chip microcomputer (CPU) 301 that incorporates a RAM, etc. To the input port of the microcomputer 301 are input various of the above described sensor signals.

A slide volume for detecting the width of a document is connected to an analog/digital conversion terminal, and is designed to sequentially detect 255 levels of slide volume values.

The previously described loads are connected via drivers to the output port of the microcomputer 301. For the reverse motor 55, especially, a well known PLL circuit is connected to the front stage of its driver. The PLL circuit receives a rectangular wave signal of an arbitrary frequency from the rectangular wave output terminal GEN0 of the microcomputer 301, and synchronization with the peripheral velocity of the belt motor 51 can be controlled by changing the frequency of that signal.

A well known stepping motor pattern controller (for which SPC is the abbreviated title) is connected to the front stage of a driver for a CP registration motor 64. The SPC receives a rectangular signal of an arbitrary frequency via a selector from the rectangular output terminal GEN1 of the microcomputer 301. The velocity synchronization with the belt motor 51 can be performed by changing the frequency of that signal. The output terminal from a separation motor encoder 54 is connected to the other terminal of the selector. When the selector selects this output, speed synchronization with the separation motor 52 can be performed.

Control data are exchanged with the copying machine via a communication IC 302. Data to be received are flow reading speed data (v); document conveying mode data, such as single side/double side/flow reading mode; a sheet supply trigger; a sheet exchange (flow reading start) trigger; and a sheet discharge trigger. Data to be transmitted are termination signals for sheet supplying, replacing, and discharging; detected original size data; a last original signal for giving a notice of the end of an original bundle; and an image leading end signal in a flow reading mode.

Figure 28:
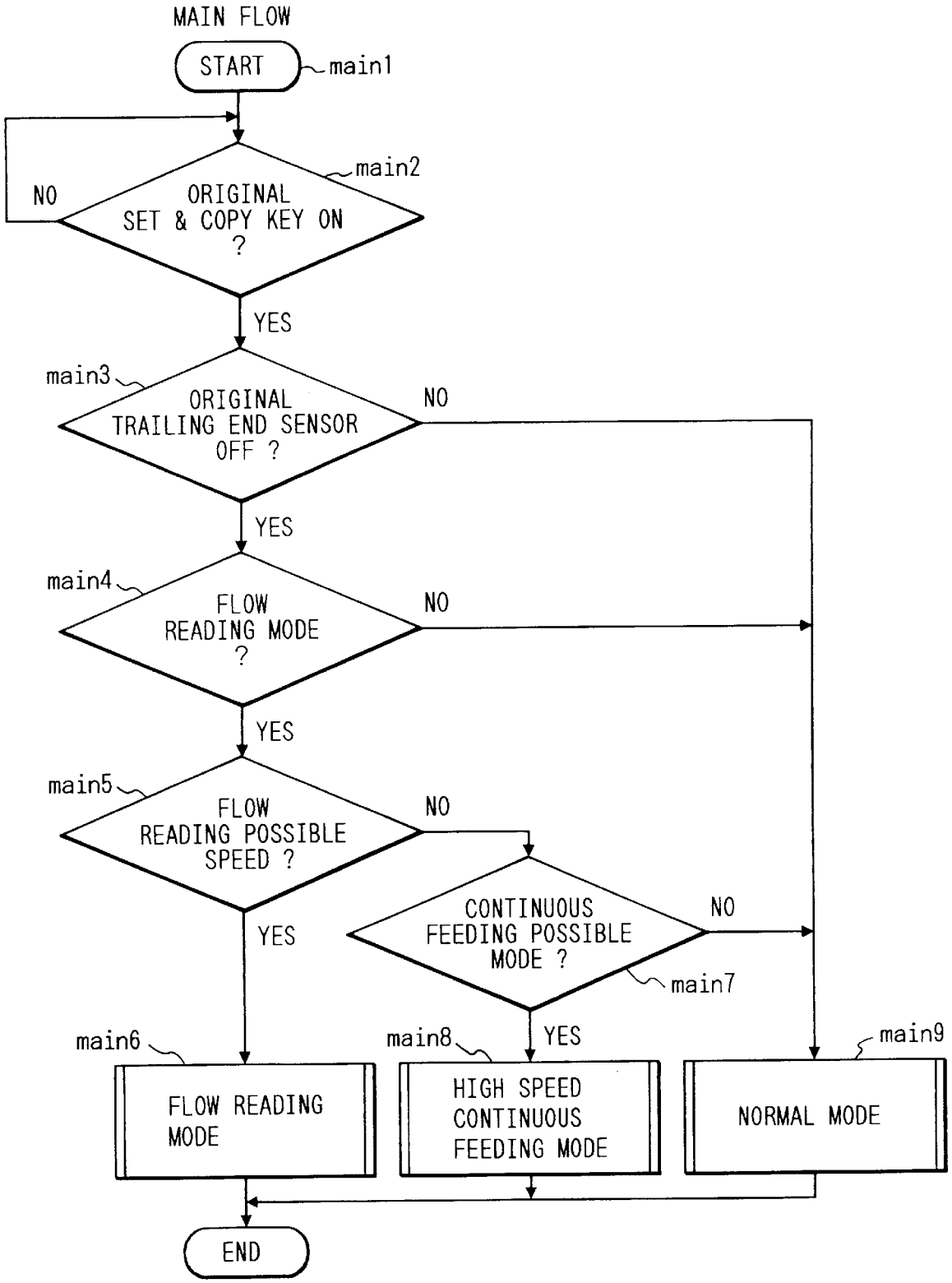
FIG. 28 is a main flowchart.

The control procedures (a control program) shown in FIG. 28 and thereafter are stored in advance in an incorporated ROM, and in consonance with the control procedures, data input and output are controlled.

In FIG. 27, CL denotes a clutch; SL, a solenoid; D, driver; PLL, a PLL circuit; AR, a switchback; CP, a closed loop; IRQ, an interruption terminal; and SPC, a stepping pattern controller.

This control unit, however, is only an example for this embodiment, and is not limited to the above described arrangement. A ROM and a RAM may be externally provided, and the reverse motor 55 may be a stepping motor with the same arrangement as that of the CP registration motor 64.

(Main flow)

The processing for this embodiment will now be described while referring to a main flowchart in FIG. 28.

The empty sensor 30 detects whether or not an original is set, and upon depression of a copy key on a console section of the apparatus body 100 (not shown), the processing is begun (main1). A check is performed to determine whether or not the original trailing end sensor 34 is in the OFF state (main2). When the obtained result is affirmative, a copy mode that is transmitted from the apparatus body 100 is examined (main3). If the copy mode is a flow reading copy mode, program control advances to (main5), where a check is performed to determine whether or not flow reading velocity data (v) that is transmitted from the apparatus body 100 can be performed by the RDF of the present invention. If the obtained result is affirmative, program control advances to (main6), where a copying process sequence is performed in the flow reading mode, which will be described later. The processing is thereafter terminated. If, at (main4), the obtained result is negative, program control moves to (main7). A check is then performed to determine whether or not the copy mode is a high speed continuous feeding mode, in which two or more originals are positioned on the platen 105 and copying is performed (a single side copying mode in this embodiment corresponds to the high speed continuous feeding mode). If the obtained result is affirmative, program control advances to (main8), wherein the copying sequence is performed in the high speed continuous feeding mode, which will be described later. The processing is thereafter terminated. If, at (main7), the obtained result is negative, program control goes to (main9), where the copying sequence is performed in a normal switchback mode, which will be described later. The processing is thereafter terminated.

In this embodiment, the mode selection according to the document size is restricted only relative to the feeding direction by turning on and off the original trailing end sensor 34. The mode selection according to the document size may be performed by a combination of the document trailing end sensor 34 and a document width detecting means that is provided by a slide volume, which is located below a document tray (not shown).

(Flow reading copy mode)

Figure 29:
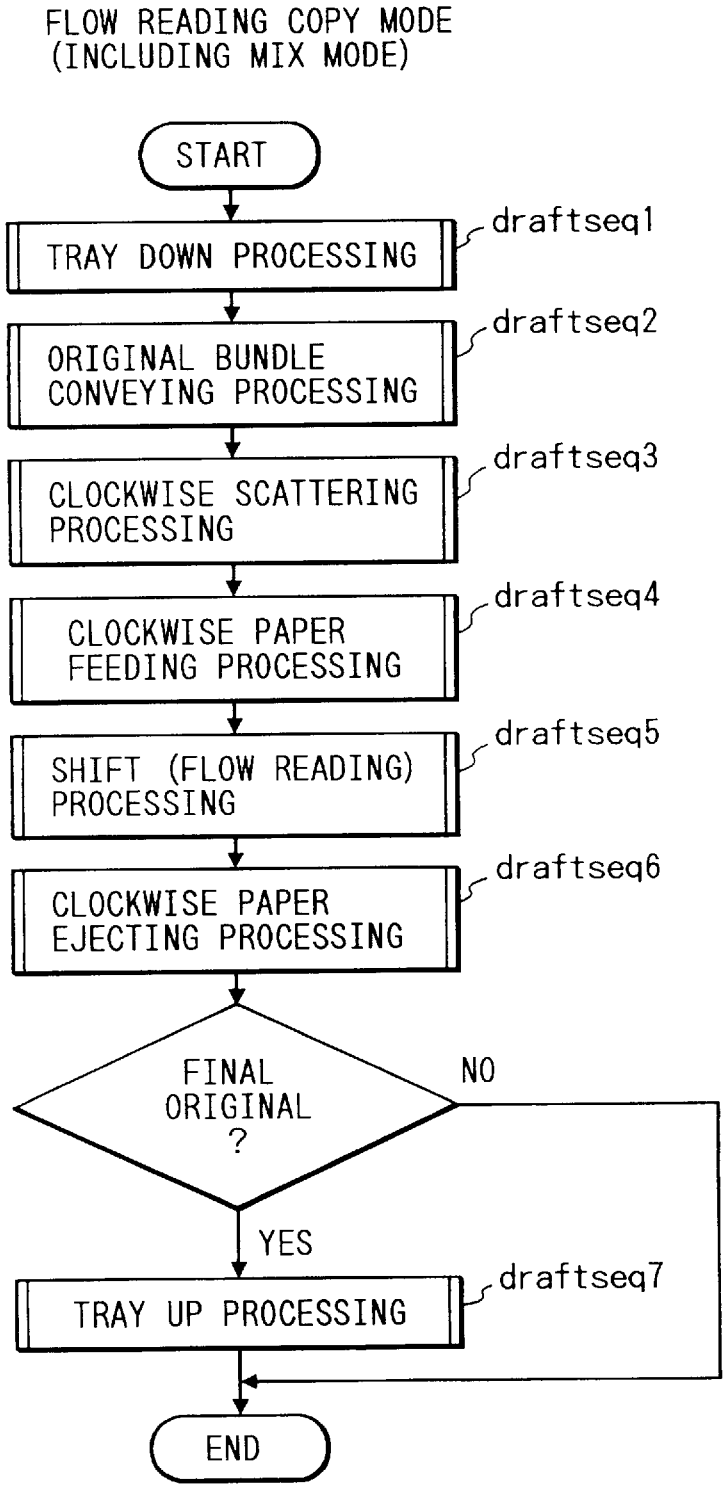
FIG. 29 is a flowchart for a flow reading copy mode (including a mixed mode)

The flow reading copy mode will now be described while referring to a flowchart in FIG. 29.

Since the operation in the flow reading mode of the RDF 1 includes the operation in a mixed mode, both operations will be described.

Tray DOWN processing, which will be described later, is performed so as to move the document tray 2 to a lower limit position (draftseq1). Then, original bundle conveying processing, which will be described later, is performed so as to shift original bundle P to the right (draftseq2), and clockwise separation processing, which will be described later, is performed to separate the lowermost original (draftseq3). Sequentially, clockwise paper feeding processing is Sequentially, clockwise paper feeding processing is performed to locate an original upstream a distance "1" from the flow reading image leading end position H (draftseq4). Upon receipt of a document change (flow reading start) trigger signal from the apparatus 100, the document flow reading is performed in which an image is read while the optical system 133 of the apparatus 100 is maintained at a predetermined position (draftseq5), and the original is moved to the fixation image leading end position G at a predetermined speed. Then, clockwise paper ejection processing is performed (draftseq6) to discharge the original onto the document tray 2.

When the obtained decision result for the last original during the clockwise separation process, which will be described later (draftseq3), is negative, the clockwise separation process is begun for the succeeding original while the clockwise paper feeding at the following step (draftseq4) is performed, so that sequential paper feeding can be provided.

After the clockwise paper ejection process (draftseq6) is completed, and if the original is the last one, tray UP processing (draftseq7), which will be described later, is performed to return the document tray 2 to its initial position.

In order to produce a plurality of copies after the flow reading (draftseq5) is completed, the home position for the fixation image leading end G. Then, the fixation reading can be performed by the shifting of the optical system 133 at predetermined times.

(High speed continuous feeding mode)

Figure 30:
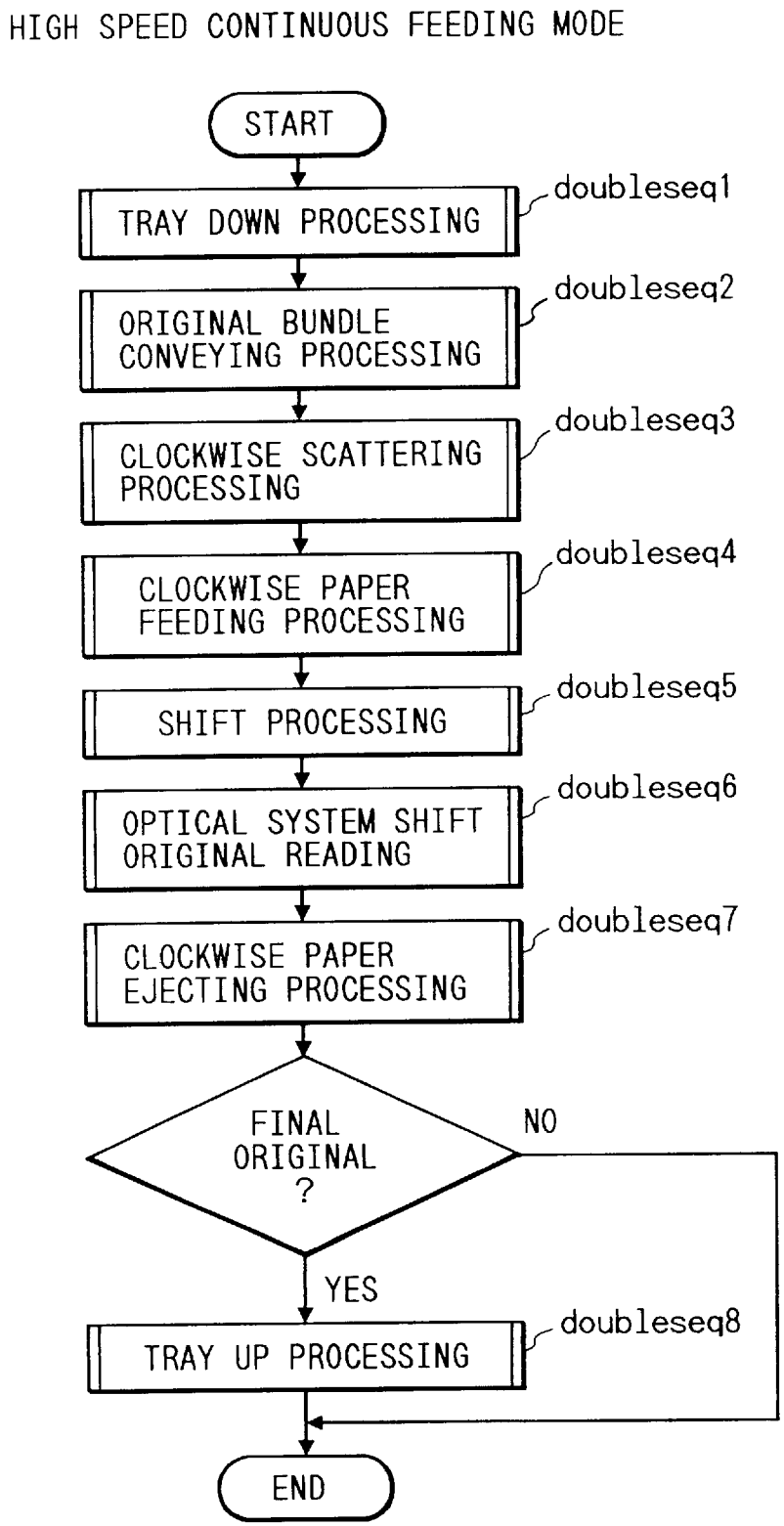
FIG. 30 is a flowchart for a high speed continuous feeding mode.

The high speed continuous mode will now be described while referring to a flowchart in FIG. 30.

Tray DOWN processing, which will be described later, is performed so as to move the document tray 2 to a lower limit position (doubleseq1). Then, original bundle conveying processing, which will be described later, is performed so as to shift original bundle P to the right (doubleseq2), and clockwise separation processing, which will be described later, is performed to separate the lowermost original (doubleseq3). Sequentially, clockwise paper feeding processing is performed to locate an original at the right end of the platen 105 (doubleseq4). Document shift processing is performed to shift the original to the fixation reading leading end position G on the platen 105 (doubleseq5). An image is read in the fixation reading mode, in which image reading is performed while the optical system 133 of the apparatus 100 is shifted (doubleseq6). When this process is completed, clockwise paper ejection processing is performed to return the original to the document tray 2 (doubleseq7).

When the obtained decision result for the last original during the clockwise separation process, which will be described later (doubleseq3), is negative, the clockwise separation process is started for the succeeding original while the clockwise paper feeding at the following step (doubleseq4) is performed, so that sequential paper feeding can be provided.

After the clockwise paper ejection process (doubleseq7) is completed, and if the original is the last one, tray UP processing (doubleseq8), which will be described later, is performed to return the document tray 2 to its initial position.

(Normal switchback mode)

Figure 31:
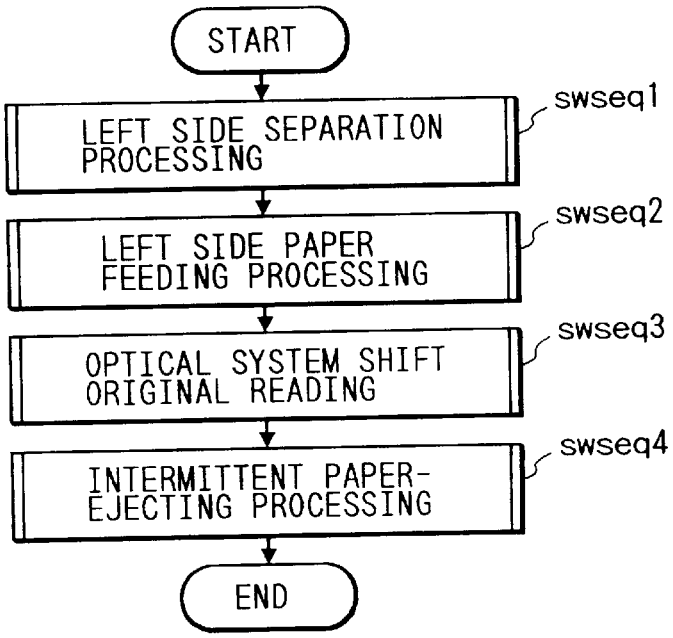
FIG. 31 is a flowchart for a normal switchback mode.

The normal switchback mode will now be described while referring to a flowchart in FIG. 31.

Switchback separation, which will be described later, is performed to separate the lowermost original from the original bundle P on the document tray 2 (swseq1). Sequentially, switchback paper feeding, which will be described later, is performed to position an original on the platen 105 (swseq2). An image is read in the fixation reading mode, in which an original is scanned while the optical system 133 of the apparatus 100 is shifted (swseq3). Then, intermittent paper ejection, which will be described later, is performed to return the original to the document tray 2 (swseq4).

Since this mode is not directly related to the subject of the invention, a detailed explanation for it will not be given.

The above various processes will now be described in detail.

(Tray UP processing)

Figure 32:
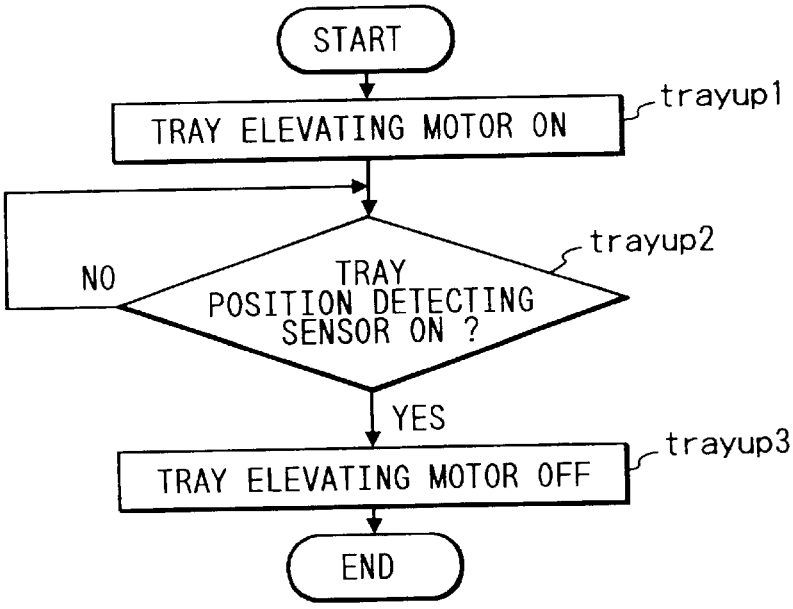
FIG. 32 is a flowchart for tray UP processing.

The tray UP processing performed by the RDF 1 will be explained while referring to FIG. 32.

The tray elevating motor 59 is driven until the tray position sensor 20 is turned on, so that the document tray 2 is elevated to the position indicated by the solid line in FIG. 1. When the tray position sensor 20 is rendered on, the tray elevating motor 59 is halted.

(Tray DOWN processing)

Figure 33:
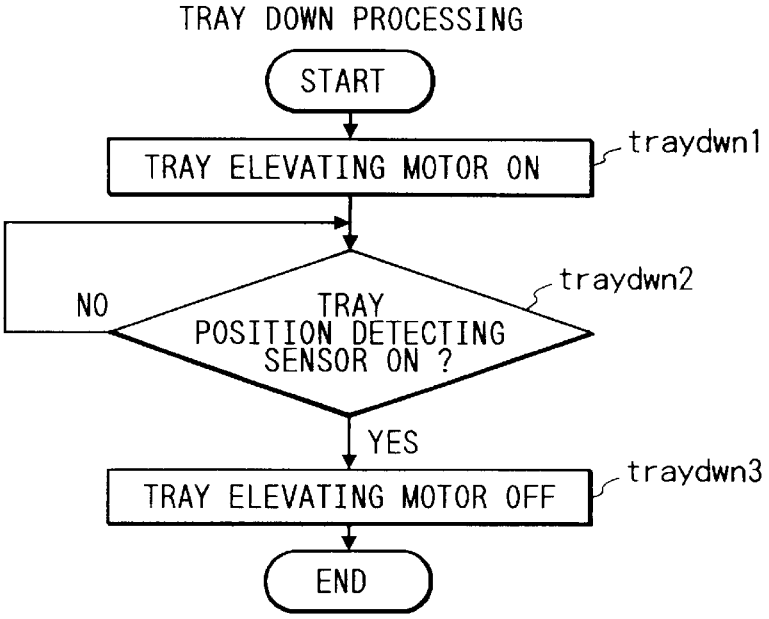
FIG. 33 is a flowchart for tray DOWN processing.

The tray DOWN processing performed by the RDF 1 will be explained while referring to FIG. 33.

The tray elevating motor 59 is driven until the tray position sensor 20 is turned off, so that the document tray 2 is lowered to the position indicated by the broken lines in FIG. 1. When the tray position sensor 20 is rendered off, the tray elevating motor 59 is halted.

(Bundle conveying processing)

Figure 34:
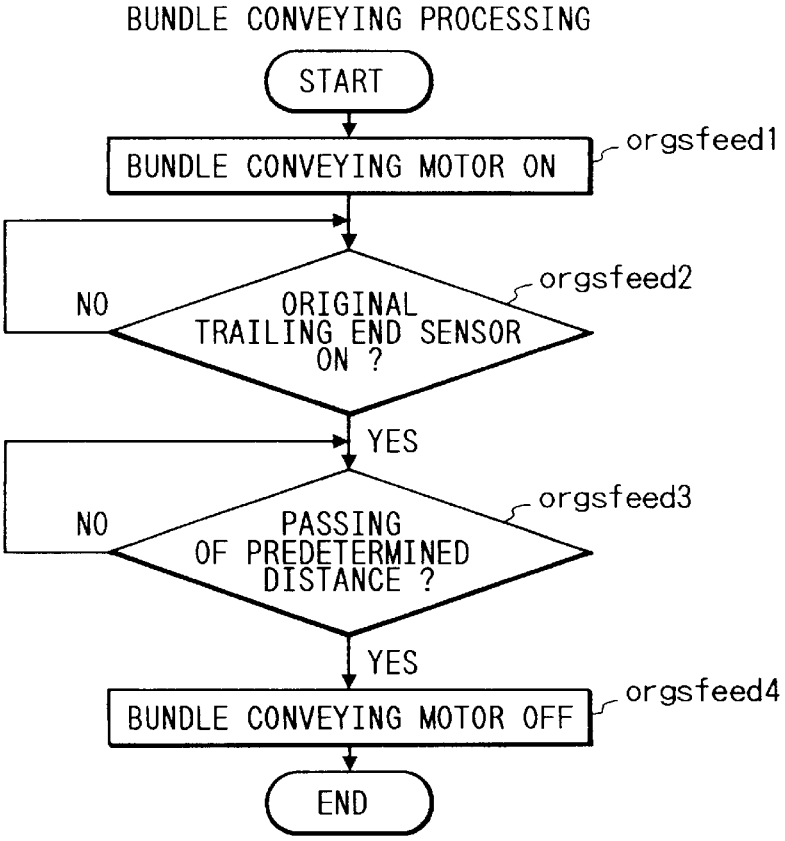
FIG. 34 is a flowchart for bundle conveying processing.

The bundle conveying processing will be described while referring to FIG. 34.

In the bundle conveying processing, the bundle conveying motor 60 is turned on so as to shift the original bundle P on the document tray 2 in the direction F in FIG. 1 (orgsfeed1). Then, the original trailing end sensor 34 detects the edge of the original bundle P (orgsfeed2), and original bundle conveying is performed by a stopper unit for a given distance (orgsfeed3). The distance that the original bundle P is fed by the bundle conveying motor 60 is controlled by the internal timer of the CPU 301. Finally, the bundle conveying motor 60 is rendered off (orgsfeed4) and the processing is thereafter terminated.

(Clockwise separation processing)

Figure 35:
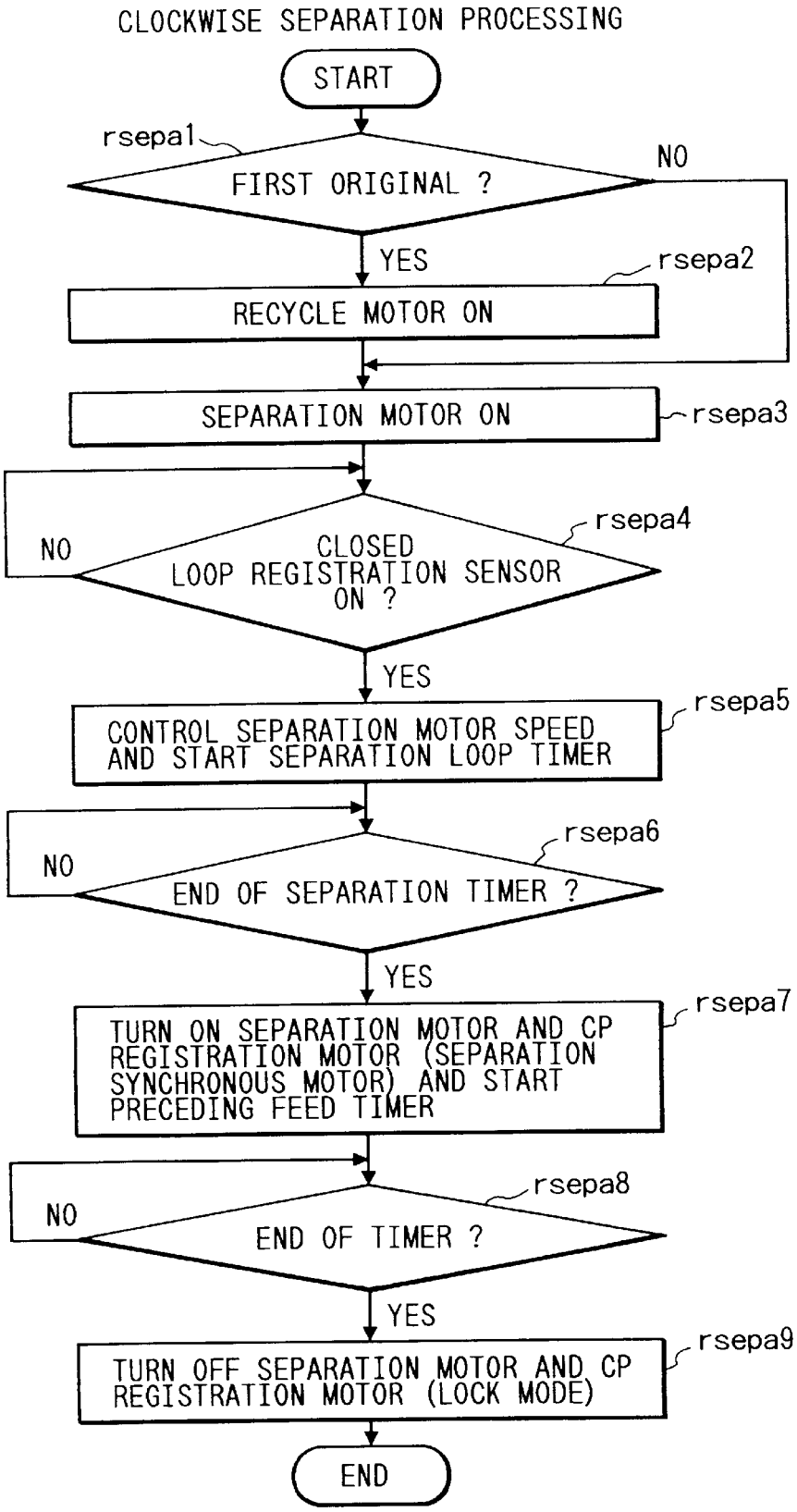
FIG. 35 is a flowchart for clockwise separation processing.

The clockwise separation processing will be described while referring to FIG. 35.

In the clockwise separation processing, if an original is the first original (rsepa1), the recycle motor 58 is activated to operate the recycle levers 3 for the detection of the end of the original bundle P (rsepa2). Then, the separation motor 52 is rendered on to separate the lowermost original of the bundle P (rsepa3). The velocity of the separation motor 52 at this time is controlled so that its rotation is substantially synchronous with a flow reading speed (v) that is designated by the apparatus 100. This is not applied for the high speed continuous feeding mode, and the motor is controlled to provide an arbitrary speed. When the original is advanced along the sheet path PH 3 and the closed loop registration sensor 36 detects the leading end of the original (rsepa4), speed control is begun to drive the separation motor 52 at a low speed, and the closed loop timer begins to count the time (rsepa5). When a set time has elapsed (rsepa6), the CP registration motor 64 is driven in the separation motor synchronization mode, and at the same time, a preceding feed timer starts to feed the leading end of the original a predetermined distance downstream of the closed loop registration rollers 11 (rsepa7). When the set time of the timer is ended (rsepa8), the separation motor 58 is turned off and the CP registration motor 64 is halted in a locked mode (rsepa9).

Through this processing, the original is fed to a position that is advanced a predetermined distance from the closed loop registration rollers 11. The predetermined distance L0 is an arbitrary value that satisfies the relationship represented by expression (1):

$$L0<L2-L1 \quad (1),$$

where L1 denotes a distance during which the peripheral velocity of the closed loop registration roller becomes stable after the CP registration motor 64 is actuated in the belt motor synchronization mode in the clockwise paper feeding process, which will be described later, and L2 denotes a distance from the image leading end sensor 37 to the closed loop registration roller 11.

When there is a preceding original in the flow reading mode, since the travel distance for the succeeding original, for which the clockwise paper feeding process that will be described later is performed, depends on the travel distance of the preceding original that is being performed in the shifting processing, the distance L0 is then an arbitrary value that satisfies the relationships represented by expressions (1) and (2):

$$L0<L5-(L4+1)*2 \quad (2),$$

where L4 denotes a distance from the fixation reading image leading end position G to the flow reading image leading end position H; "1" denotes a distance from the flow reading image leading end position H to the flow reading standby position; and L5 denotes a distance from the fixation reading image leading end position G to the nipping position of the closed loop registration roller pair 11.

If the copy mode in the main flowchart (FIG. 28) is the flow reading mode, and a mixed mode is not employed with the fixation reading (i.e., when the copy count that is set is one, or when a recirculation mode is employed for image forming to produce multiple copy sets), image forming can be performed only by the flow reading. In such a case, since the distance L0 is not affected by the distance that the original is shifted in the clockwise paper feeding processing, the expression (2) does not have to be established, and the distance L0 is determined by only the expression (1).

(Clockwise paper feeding processing)

Figure 36:
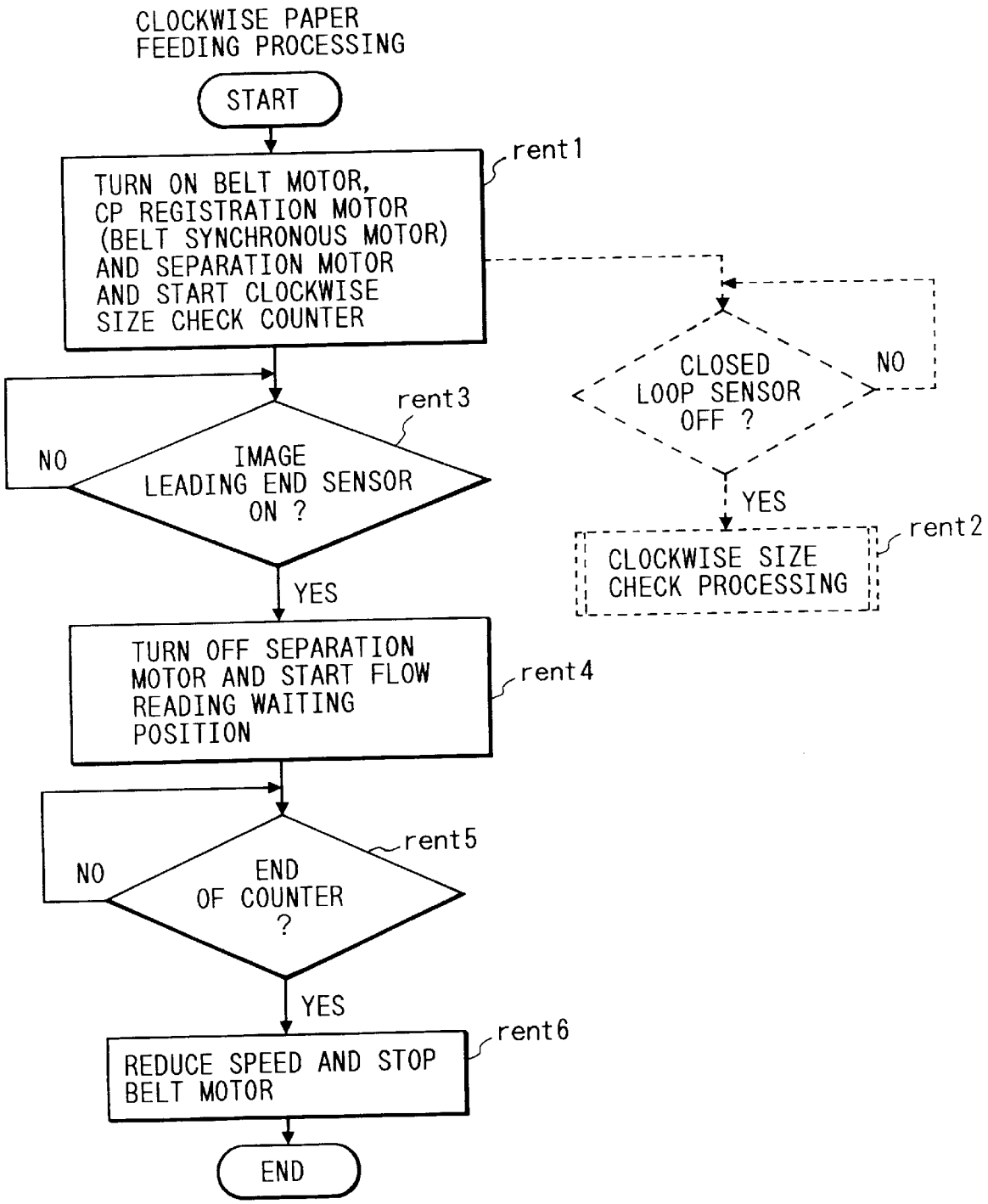
FIG. 36 is a flowchart for clockwise paper feeding processing.

The clockwise paper feeding processing will now be explained while referring to FIG. 36.

In the clockwise paper feeding processing, in order to feed an original along the sheet path PH4 to the sheet path PH5, the belt motor 51 is rendered on and begins to rotate at an arbitrary speed when the original is the first original, or in the high speed continuous feeding mode. When the original is the second original or a subsequent sheet in the flow reading mode (including the mixed mode), the belt motor 51 is rendered on and begins to rotate at a flow reading velocity (v) that is designated by the apparatus 100 in association with the clockwise shifting (including flow reading) process, which will be described later. At the same time, the CP registration motor 64 is rendered on in the belt motor synchronization mode. The separation motor 52 is also rendered on, so that the closed loop path feed roller pair 10 and 10' are driven at the same peripheral velocity as that of the CP registration motor 64. At the same time, a clockwise size-check counter starts that begins counting in response to a clock signal from the CP registration motor encoder sensor 66 (rent1), and holds a count value that is required until the trailing end of the original has passed through the closed loop registration sensor 36. According to the count value data, the size of the original is identified during the clockwise size-check processing shown in FIG. 42 (rent2). When the leading end of the original is detected by the image leading end sensor 37 (rent3), the separation motor 52 is turned off. Also, the flow reading standby position counter is started that counts a belt motor drive clock that is internally generated by the CPU 301, which drives the belt motor 51, so that the movement of the original is halted at the flow reading image leading end standby position on the platen 105 (upstream a distance "1" from the flow reading image leading end position H) (rent4). When the counting by the flow standby position counter is ended, the belt motor 51 is slowed down and halted (rent5). The distance for the velocity reduction that is required is subtracted from the count value held by the flow reading standby position counter.

The distance "1" from the flow reading image leading end position H to the flow reading standby position is an arbitrary distance that satisfies the following expression:

$$1<L3 \quad (3),$$

where L3 denotes a distance that is required until the peripheral velocity of the wide belt 40 becomes stable after the belt motor 51 is actuated at a velocity (v), as is designated by the apparatus 100 in the clockwise shifting process, which will be described later.

Since the distance L3 is varied in consonance with the designated velocity (v) of the apparatus 100, the distance "1"

from the flow reading image leading end position H to the flow reading standby position is also variable. It should be noted that this is not applied for the high speed continuous feeding mode.

(Shift processing)

Figure 37:
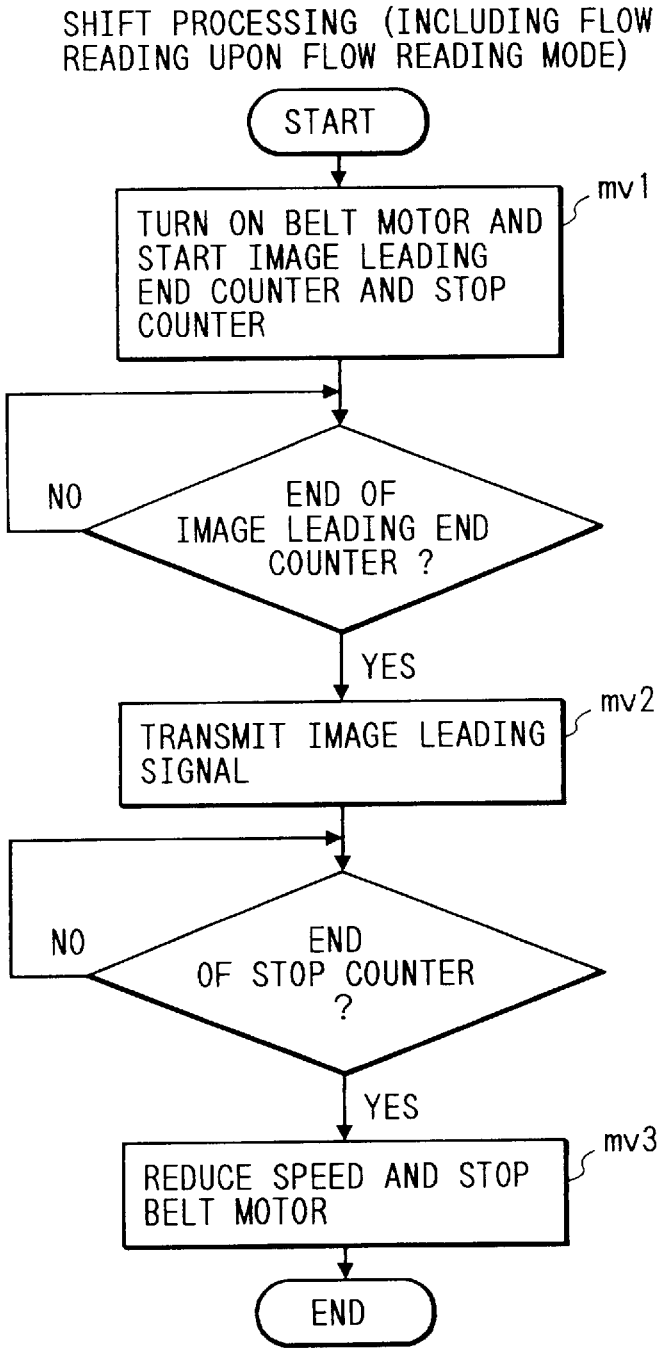
FIG. 37 is a flowchart for shift processing (including flow reading processing in flow reading mode)
Figure 38:
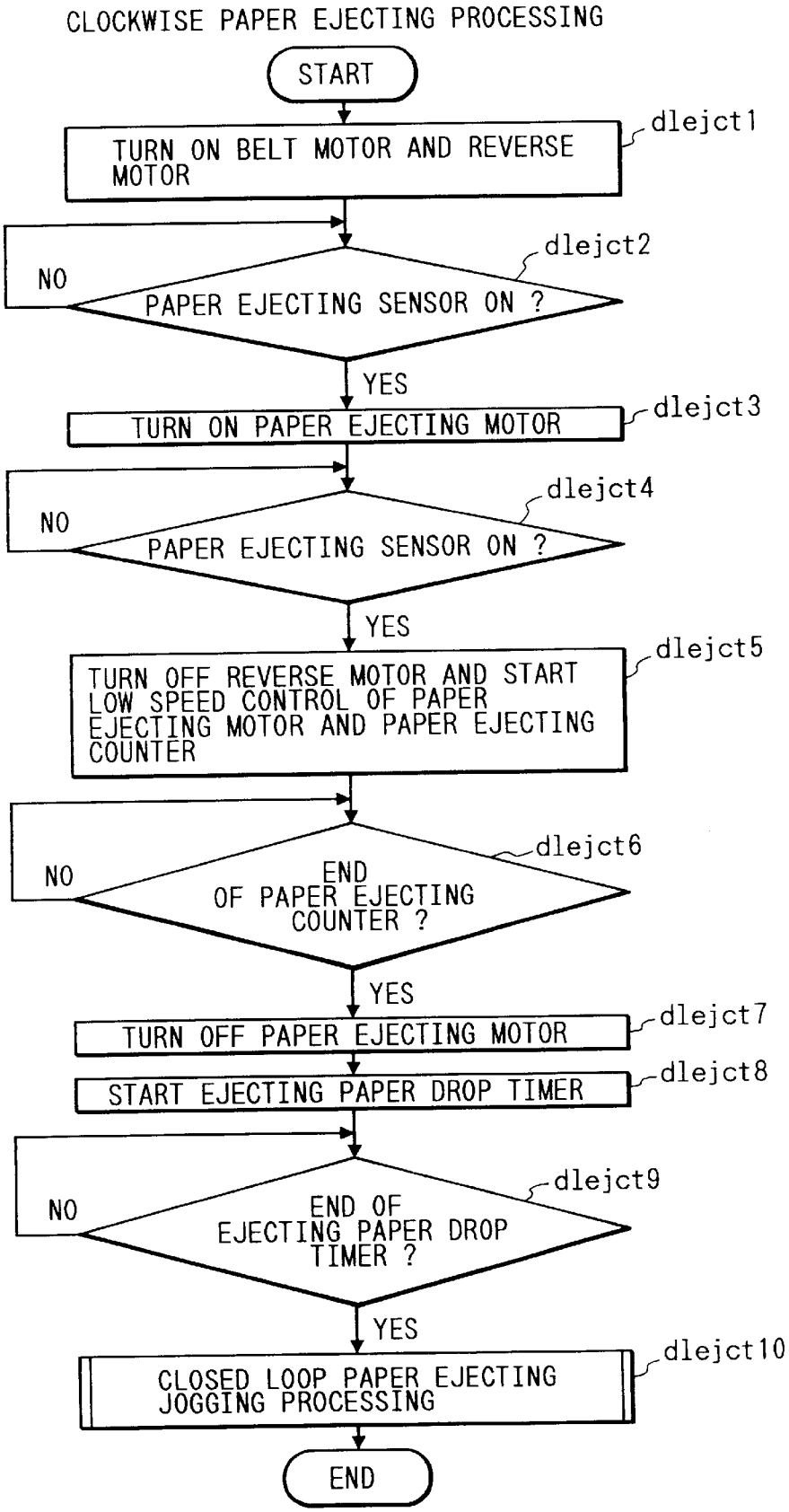
FIG. 38 is a flowchart for clockwise paper ejection processing.

The shift processing that includes the flow reading will be explained while referring to FIG. 37.

In the shift processing (which includes the flow reading), for the flow reading mode (which includes the mixed mode), the belt motor 51 rotates at a flow reading velocity (v) that is designated by the apparatus 100; and for the high speed continuous mode, the belt motor 51 rotates at an arbitrary velocity to drive the wide belt 40 and to shift the original along the sheet paths PH5 and PH6. The counting is begun by the belt motor drive clock that is generated internally by the CPU 301 that drives the belt motor 51. At this time, an image leading end counter counts down a value that is equivalent to the distance "1" from the flow reading image leading end position H to the flow reading standby position, and a stop counter counts down a value that is equivalent to a value that is obtained by subtracting a distance loss caused by the speed reduction and the halting from a distance that extends from the fixation reading image leading end position G to the flow reading standby position (mv1). When the image leading end counter terminates its counting process, an image leading end signal is transmitted to the apparatus 100 (mv2). The original continues to be fed, but when the stop counter terminates its counting process, the speed of the belt motor 51 is reduced and the motor 51 is halted (mv3).

Through this processing, since the original is passed by the flow reading image leading end position H at a predetermined speed (a velocity (v) that is designated by the apparatus 100), the image forming by the apparatus 100 through the flow reading can be provided, and the shifting to the fixation reading image leading end position G can also be completed. As is previously described, the apparatus 100 thereafter can perform the original fixation reading, in which the optical system 133 is moved as needed to scan an image.

If the copy mode in the main flowchart (FIG. 28) is the flow reading mode, and a mixed mode with the fixation reading is not employed (i.e., when the set copy count is one, or when a recirculation mode is employed for image forming to produce multiple copy sets), image forming can be performed only by the flow reading. In such a case, the stop counter (mvstopcn) holds the same value as is held by the flow reading standby position counter (entcn) in the clockwise paper feeding process for the succeeding original. The distance between the originals (the interval between the trailing end of the preceding original and the leading end of the succeeding original) can therefore be shorter and higher productivity can be provided.

Figure 47A:
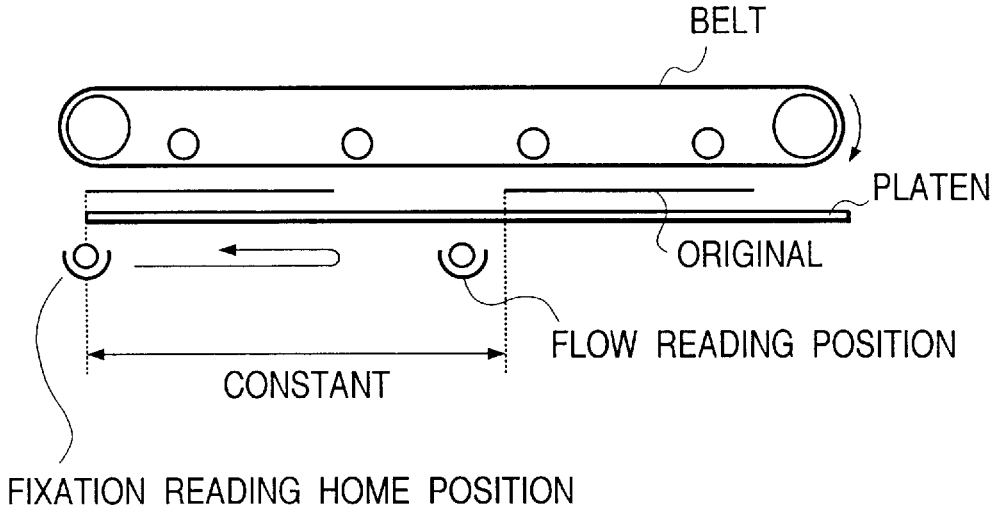
FIGS. 47A and 47B are diagrams for explaining an interval between originals in the mixed mode and in the flow reading mode.

More specifically, in the mixed mode for flow reading and for fixation reading, an interval between originals is controlled, so that a distance between the leading end of the preceding original and the leading end of the succeeding original can be held constant, regardless of the size of the original document. In the flow reading mode during which only flow reading is performed, the interval between originals is controlled so that the distance between the trailing end of the preceding original and the leading end of the succeeding original can be held constant, regardless of the size of the original document. As is shown in FIG. 47A, the interval between originals in the mixed mode is so controlled that when the leading end of the preceding original is located at the fixation reading home position, the leading end of the succeeding original is positioned upstream from the flowing reading position and at an approach run distance that is required when the shifting of the original begins.

Figure 47B:
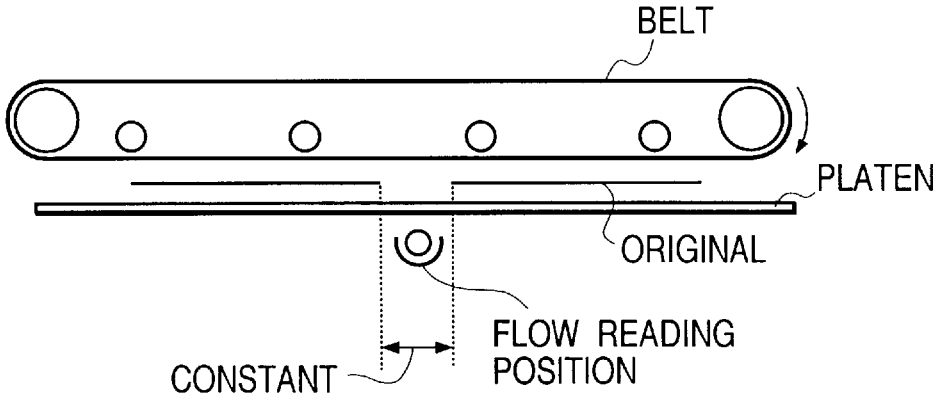

As is shown in FIG. 47B, the interval between the originals in the flow reading mode is so controlled that the distance from the trailing end of the preceding original to the leading end of the succeeding original is the minimum required value. Since the interval between the originals is unchanged as they are fed along the belt, the interval should be controlled at a location upstream from where the originals are supported by the belt.

(Clockwise paper ejection processing)

In the clockwise paper ejection processing, in order to eject the original on the platen 105, in the flow reading mode (including the mixed mode), the belt motor 51 and the reverse motor 55 are driven at a velocity (v) that is designated by the apparatus 100, while in the high speed continuous feeding mode, these motors 51 and 55 are actuated at an arbitrary velocity (dlejct1). When the original is fed along the sheet path PH7 to the sheet path PH2, its leading end is detected by the paper ejection sensor 39 (dlejct2). The paper ejection motor 61 is driven at an arbitrary speed that is higher than the velocity of the reverse motor 55 (dlejct3). When the trailing end of the original is detected by the paper ejection sensor 39 (dlejct4), the reverse motor 55 is turned off, and the paper ejection motor 61 is driven at a low speed to stack the ejected originals, while a paper ejection counter is started that determines a distance to discharge the original onto the document tray 2 counter is ended (dlejct6), the paper ejection motor 61 is rendered off (dlejct7), and a paper ejection drop timer is started that measures an interval until the original drops onto the document tray 2 (dlejct8). When the counting by the drop timer is ended (dlejct9), the closed loop paper ejection jogging processing is performed to align the originals that have been ejected (dlejct10). The clockwise paper ejection processing is thereafter terminated.

(Switchback separation processing)

Figure 39:
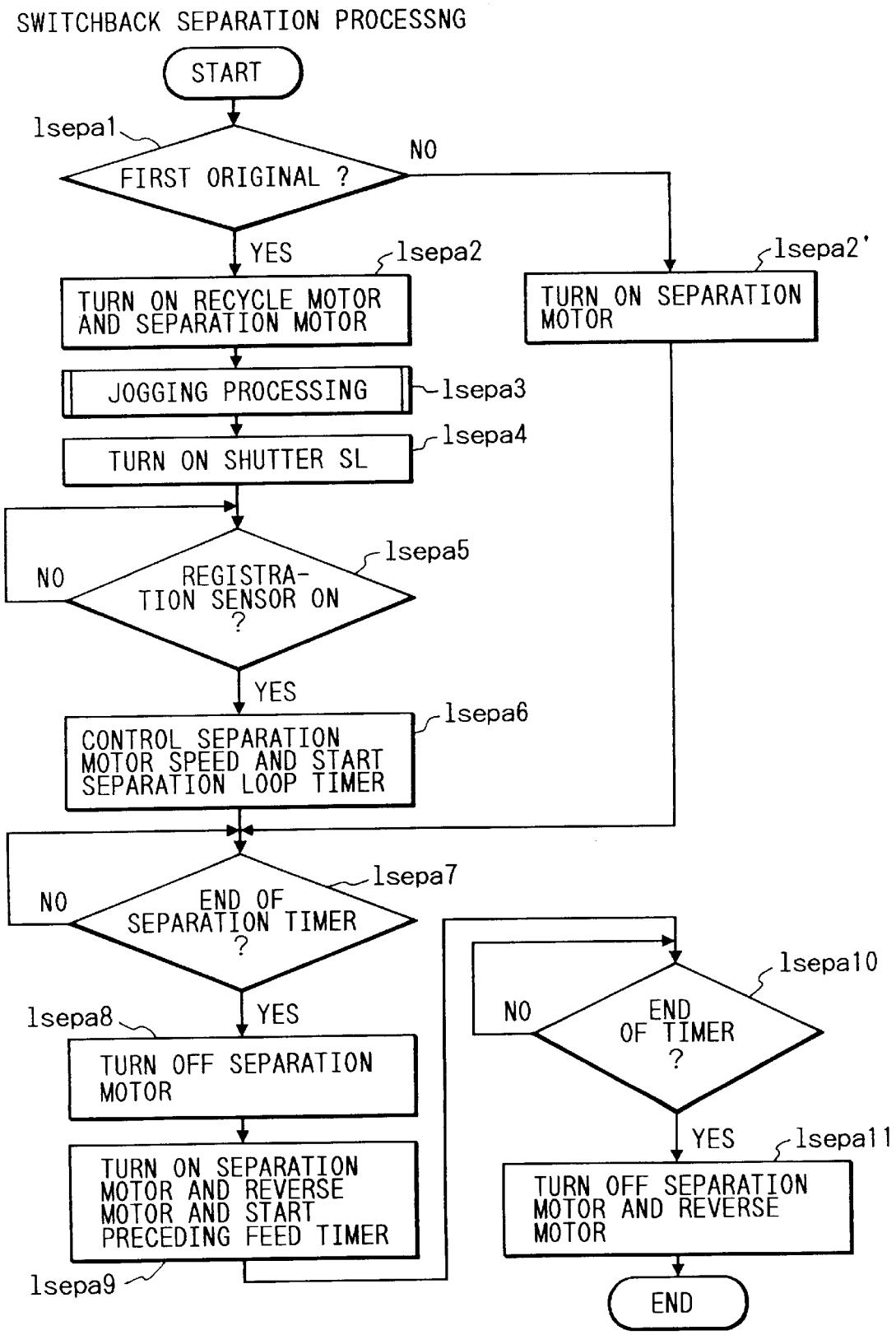
FIG. 39 is a flowchart for switchback separation processing.
Figure 40:
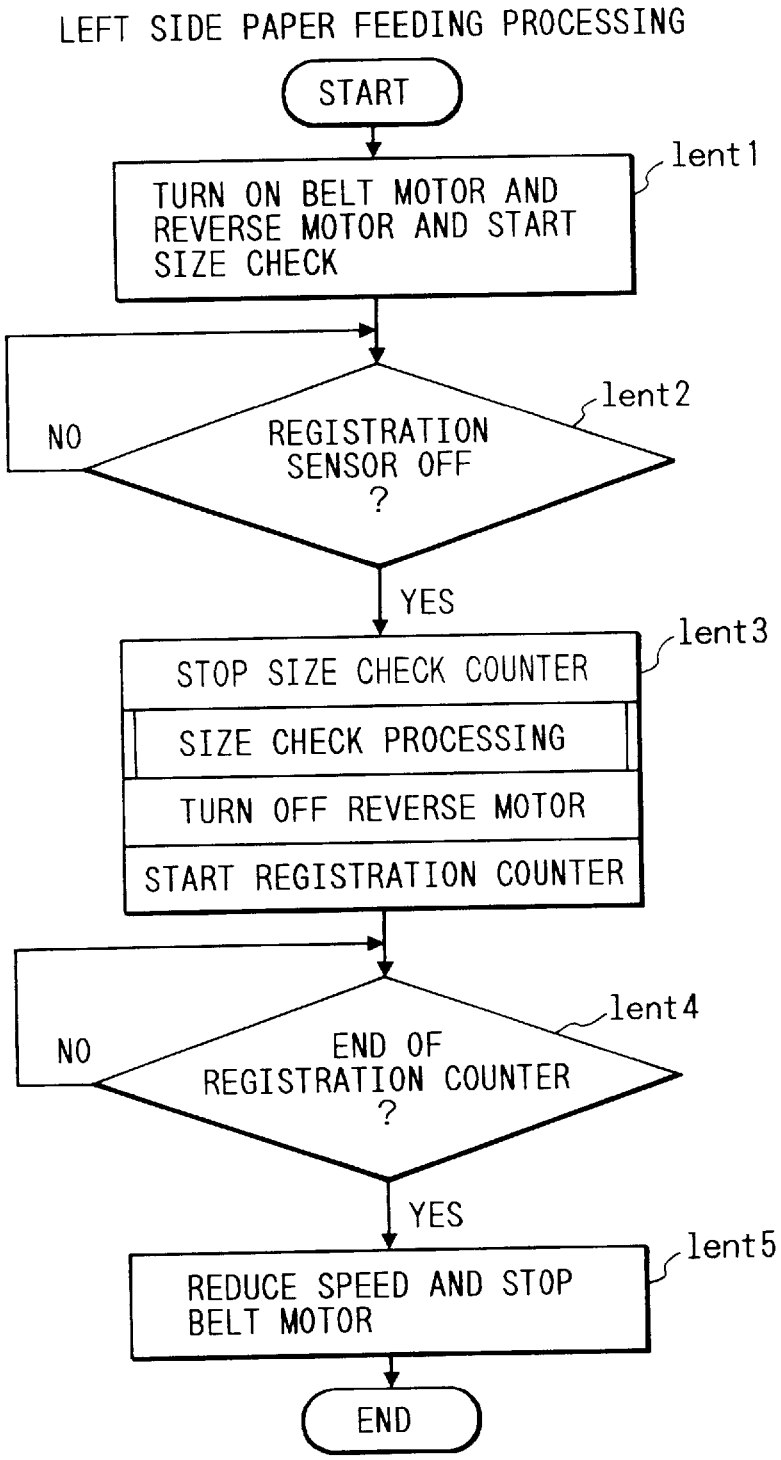
FIG. 40 is a flowchart for left side paper feeding processing.

The switchback separation processing will now be described while referring to FIG. 39.

In the switchback separation processing, when the original is the first original (lsepa1), the recycle motor 58 and the separation motor 52, which separate the original bundle P into individual sheets, are rendered on to operate the recycle lever 3 that detects the end of the bundle P (lsepa2). Further, a jogging process is performed to align the original bundle P in the direction of its width (lsepa3). After the jogging process is completed, the shutter solenoid 72 is rendered on and lowers the shutter 41 so as to separate only the lowermost original of the bundle P (lsepa4). The lowermost original is fed along the sheet path and its leading end is detected by the switchback registration sensor 32 (lsepa5). Then, the speed control is begun to drive the separation motor 52 at a low speed and the separation loop timer is started (lsepa6). When the time set for the separation loop timer has elapsed (lsepa7), the separation motor 52 is rendered off (lsepa8), and the leading end of the original slowly abuts upon the nip portion of the registration rollers 6 and 6'. Thus, damage to the leading end of the original can be prevented, the magnitude of the impact sound can be reduced, and the movement of the original is halted when a loop of a predetermined value is formed. Therefore, even if angular repositioning of the original occurs at the time of separation, this can be corrected.

The separation motor 52 and the reverse motor 55 are driven at an arbitrary velocity to reduce the time required for the change of the originals, and a preceding feed timer that holds an arbitrary value is started (lsepa9). When the operation of this timer has ended (lsepa10), the separation motor 52 and the reverse motor 55 are turned off to terminate the preceding feeding (lsepa11).

(Switchback paper feeding processing)

In the switchback paper feeding processing, the belt motor 51 and the reverse motor 55 are rendered on to drive the registration rollers 6 and 6' and the wide belt 40, which in turn feed the original to the sheet path PH1. At the same time, a size check counter is started that counts a clock signal from the reverse started that counts a clock signal from the reverse motor encoder sensor 57 (lent1). When the original is fed and its trailing end passes the registration sensor 32 (lent2), the size check counter is stopped (lent3). The current value data held by the counter is employed to identify the size of the original in the size check processing shown in FIG. 43. Then, the registration counter is started that counts a belt motor drive clock that is generated internally by the CPU 301, which drives the belt motor 51, in order to halt the original at a predetermined position on the platen 105 (lent3). When the counting by the registration counter is ended (lent4), the velocity of the belt motor 51 is gradually reduced and the motor 51 is halted (lent5). The value held by the registration counter is assumed to be the result obtained by subtracting the loss due to the speed reduction.

(Intermittent paper ejection processing)

Figure 41:
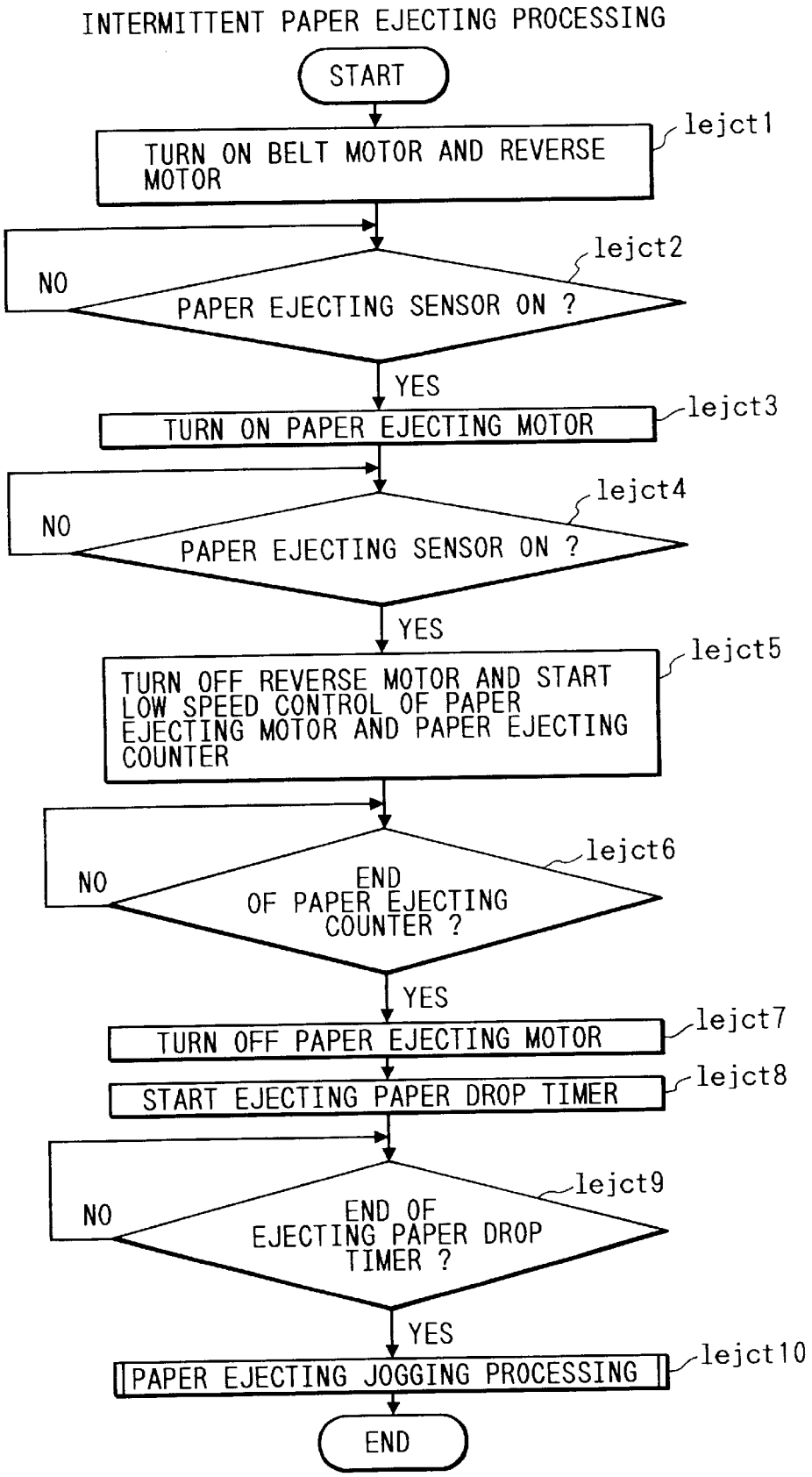
FIG. 41 is a flowchart for intermittent paper ejection processing.

The intermittent paper ejection processing will now be explained while referring to FIG. 41.

In the intermittent paper ejection processing, in order to discharge the original on the platen 105, the belt motor 51 and the reverse motor 55 are rendered on and driven at an arbitrary velocity (lejct1). When the original is fed along the sheet path PH7 to the sheet path PH2, its leading end is detected by the paper ejection sensor 39 (lejct2). The paper ejection motor the velocity of the reverse motor 55 (lejct3). When the trailing end of the original is detected by the paper ejection sensor 39 (lejct4), the reverse motor 55 is turned off, and the paper ejection motor 61 is driven at a low speed to stack the ejected original, while the paper ejection counter is started that determines a distance to discharge the original onto the document tray 2 (lejct5). When the counting by the paper ejection counter is ended (lejct6), the paper ejection motor 61 is rendered off (lejct7), and the paper ejection drop timer is started that measures an interval until the original drops onto the document tray 2 (lejct8). When the counting by the drop timer has ended (lejct9), the ejection jogging processing is performed to align the originals that have been ejected (lejct10). The intermittent ejection processing is thereafter terminated.

(Size check subroutine)

Figure 42:
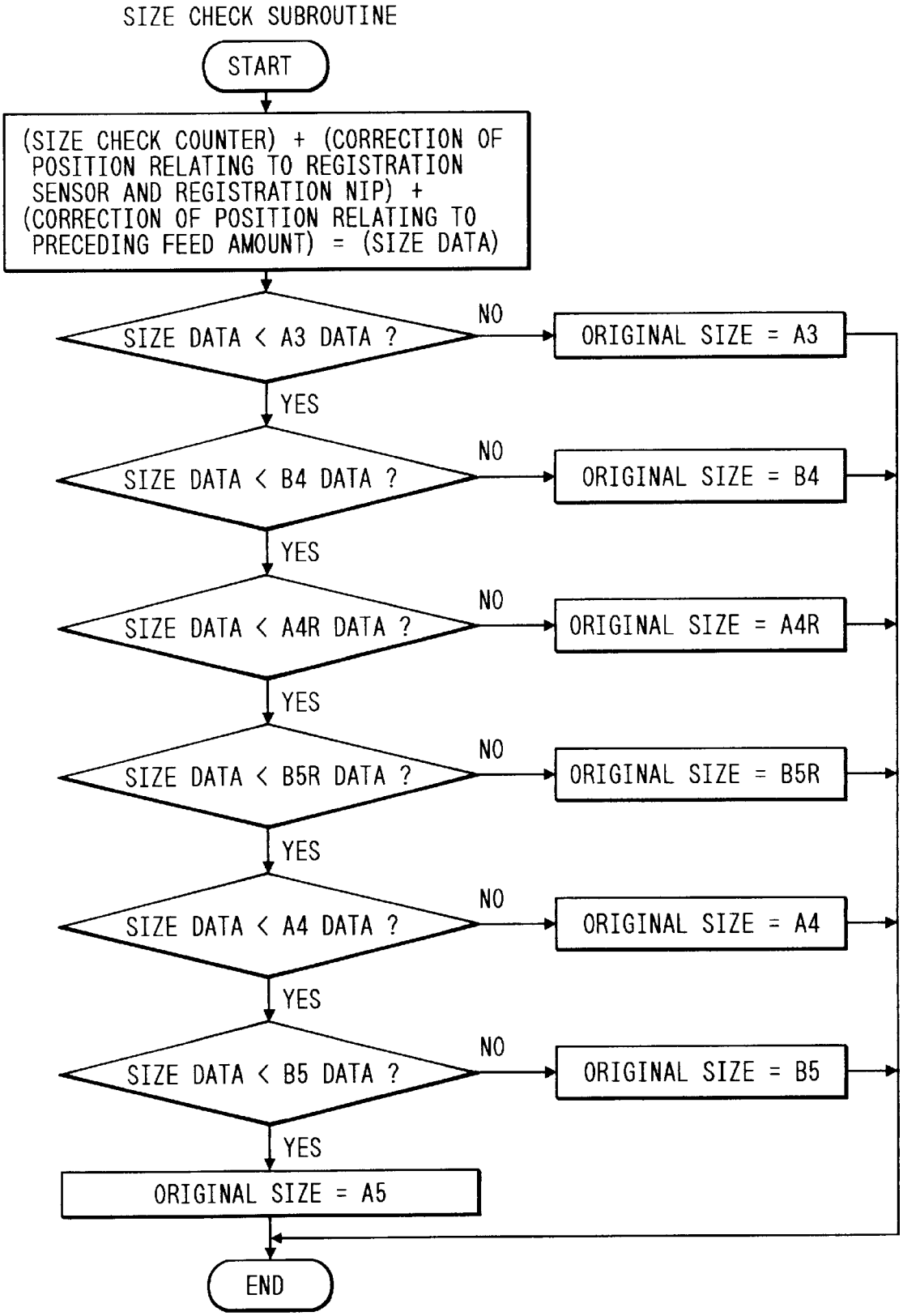
FIG. 42 is a flowchart for a size check subroutine.

The size check subroutine will now be explained while referring to FIG. 42.

In the size check subroutine, the count data that are held by the size check counter, which serves as the original size check means, is compensated for by adding together the distance value from the nip portion of the registration rollers 6 and 6' to the registration sensor 32 and the preceding value from the nip portion, which is acquired in the left side separation processing. The resultant value is a real original size. The original is fed by the registration rollers 6 and 6' and its feeding value exactly matches the count value of the clocks that are sent from the reverse motor encoder sensor 57. The corrected size data are hereafter employed to determine the size, A5, B5, A4, B5R, A4R, B4, or A3.

(Clockwise check processing)

Figure 43:
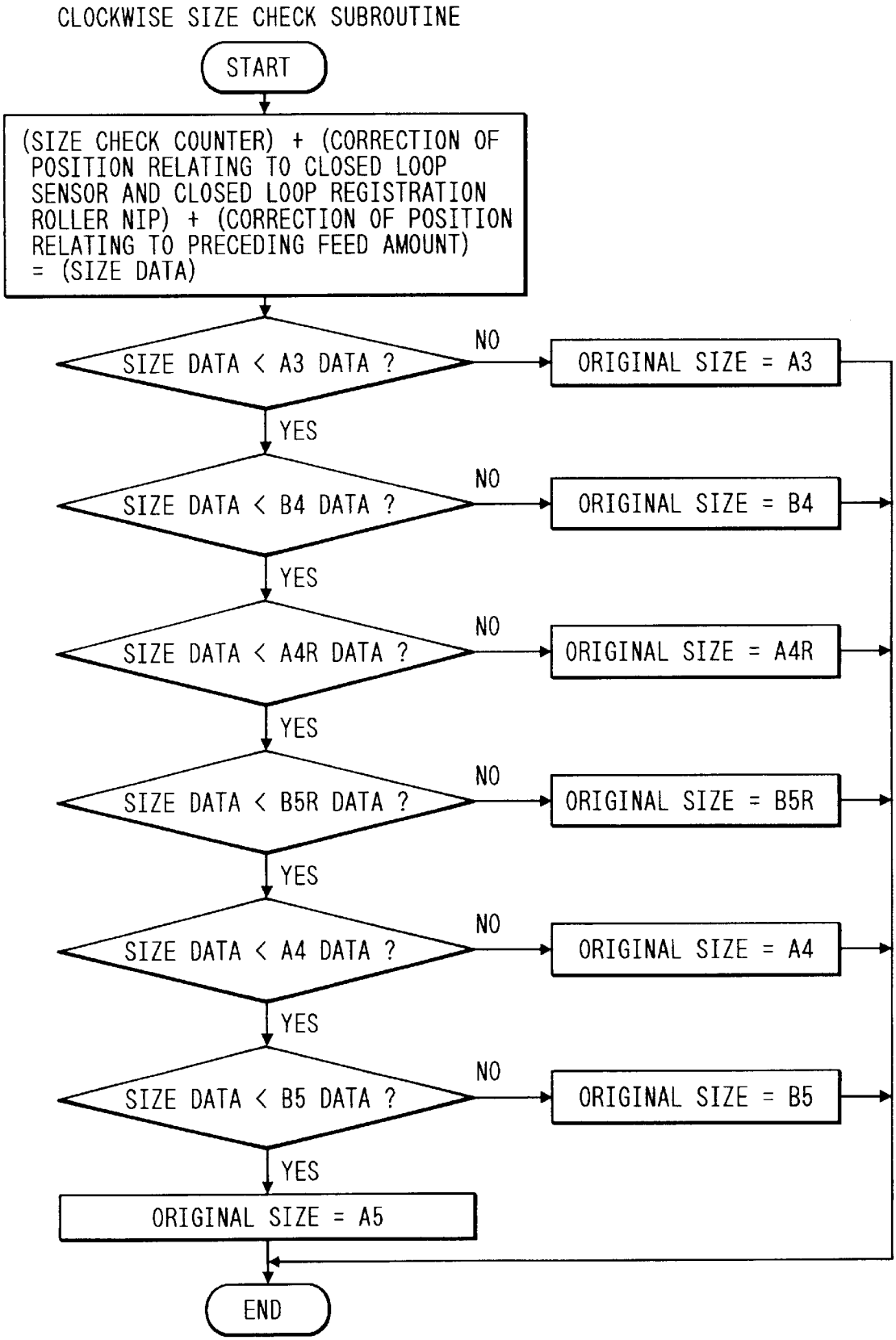
FIG. 43 is a flowchart for a clockwise size check subroutine.

The clockwise size check subroutine will now be explained while referring to FIG. 43.

In the clockwise size check subroutine, the count data that is held by the size check counter, which serves as the original size check means, is compensated for by adding together the distance value from the nip portion of the closed loop registration rollers 11 to the closed loop registration sensor 36 and the preceding value from the nip portion, which is acquired in the clockwise separation processing. The resultant value is a real original size. The original is fed by the closed loop registration rollers 11, and its feeding value exactly matches the count value of the clocks that are sent from the CP registration motor encoder sensor 66. The corrected size data are hereafter employed to determine the size, A5, B5, A4, B5R, A4R, B4, or A3.

(Jogging processing)

Figure 44:
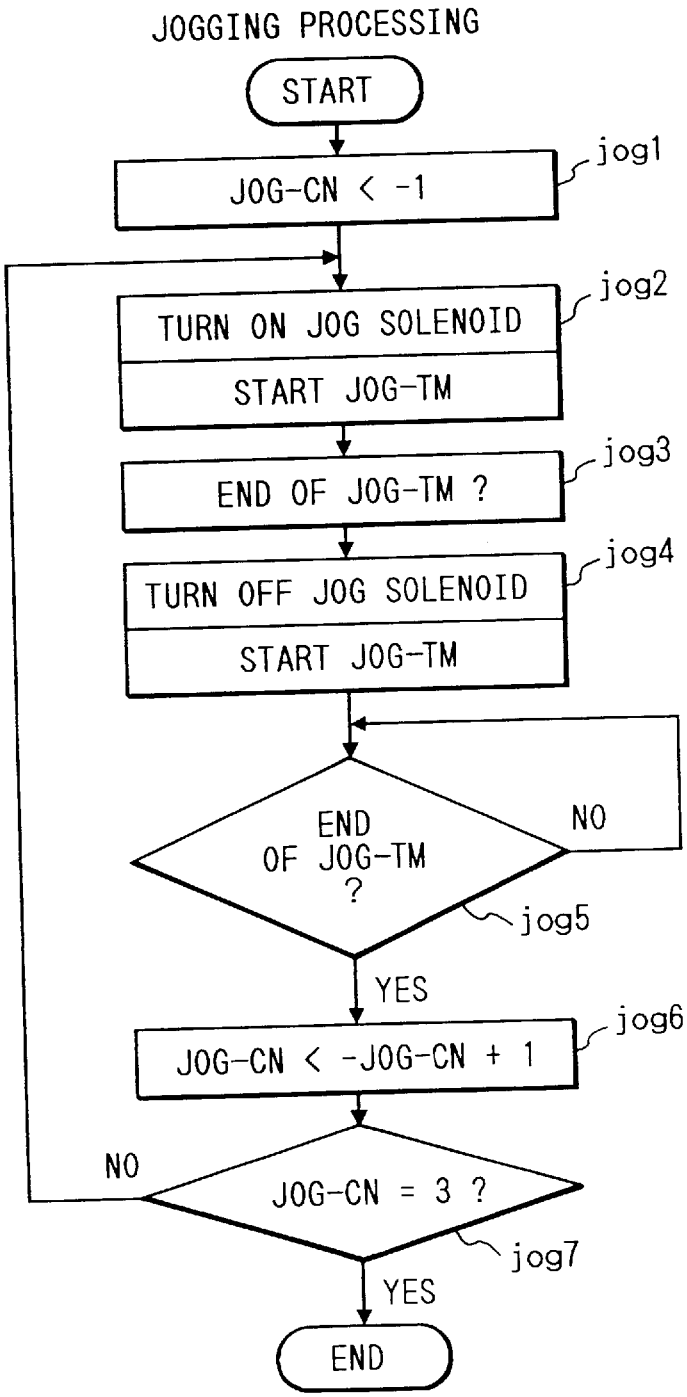
FIG. 44 is a flowchart for jogging processing.

The jogging processing will now be explained while referring to the flowchart in FIG. 44.

In the jogging processing, first, JOG-CN is initialized, which determines the count for the jogging that is to be performed (jog1). When the jogging solenoid 77 is rendered on to push out the jogging guide of a width restriction member, a timer JOG-TM that can be arbitrarily set is also started (jog2). When the set time for the timer JOG-TM has elapsed (jog3), the jogging solenoid 77 is rendered off to return the jogging guide to its original state, and the timer JOG-TM is started in the manner that is described above (jog4). When the set time for the timer has elapsed, the number at which jogging is to be performed is increased (jog5). After the jogging guides have reciprocated three times (jog6), program control returns to (jog2) and the above processing is repeated. Through this processing, the original bundle P is aligned in the direction of its width, and angular repositioning and horizontal registration can be prevented.

(Paper ejection jogging processing)

Figure 45:
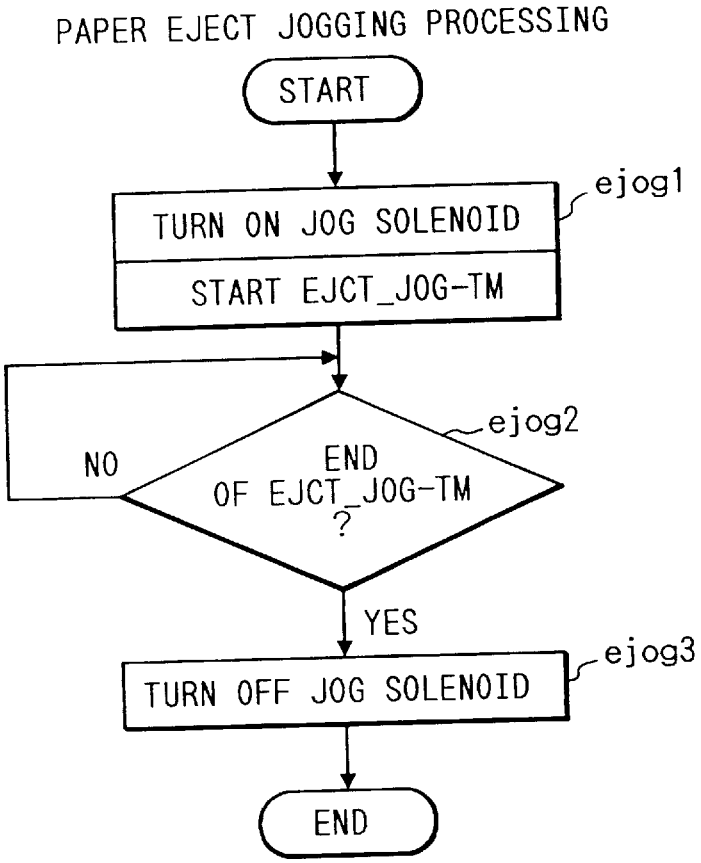
FIG. 45 is a flowchart for paper ejection jogging processing.

The paper ejection jogging processing will now be explained while referring to the flowchart in FIG. 45.

In the paper ejection jogging processing, the jogging solenoid 77 is rendered on so as to push out the jogging guide of the width restriction member, and a timer EJCT_JOG-TM that can be arbitrarily set is also started (ejog1). When the set time for the timer EJCT_JOG-TM has elapsed (ejog2), the jogging solenoid 77 is rendered off to return the jogging guide to its original state (ejog3). Through this processing, the original bundle P is aligned in the direction of its width, and angular repositioning and horizontal registration can be prevented.

(Closed loop ejection jogging processing)

Figure 46:
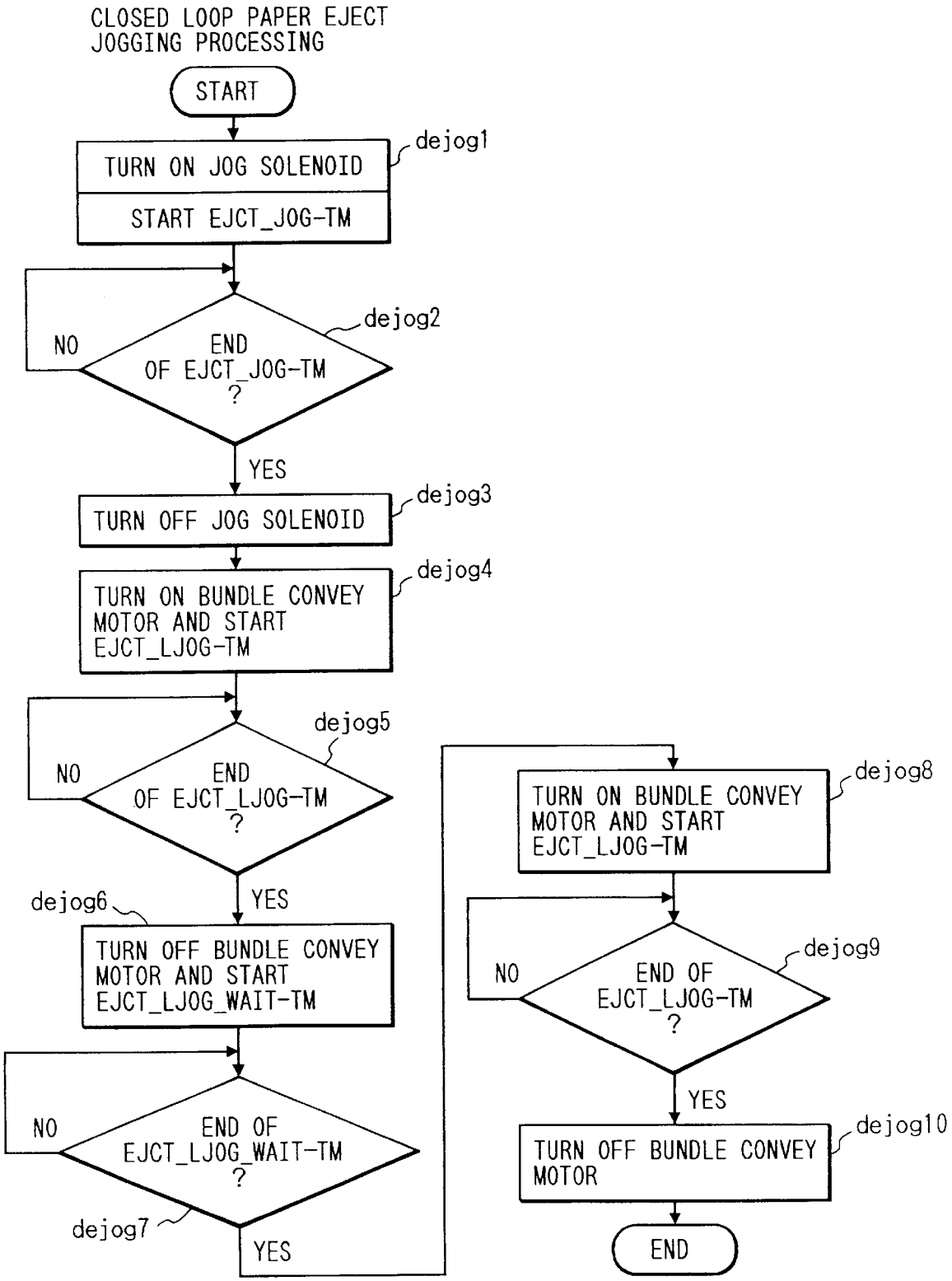
FIG. 46 is a flowchart for closed loop paper ejection jogging processing.

The closed loop paper ejection jogging processing will now be explained while referring to the flowchart in FIG. 46.

In the paper ejection jogging processing, the jogging solenoid 77 is rendered on to push out the jogging guide of the width restriction member, and a timer EJCT_JOG-TM that can be arbitrarily set is also started (dejog1). When the set time for the timer EJCT_JOG-TM has elapsed (dejog2), the jogging solenoid 77 is rendered off to return the jogging guide to its original state (dejog3). Through this processing, the original bundle P is aligned in the direction of its width, and angular repositioning and horizontal registration can be prevented.

Sequentially, the bundle conveying motor 60 begins to rotate in the direction F, and a timer EJCT_LJOG-TM that can be arbitrarily set is also started (dejog4). When the set time for the timer EJCT_LJOG-TM has elapsed (dejog5), the bundle conveying motor 60 is halted and a timer EJCT_LJOG_WAIT-TM that can be arbitrarily set is also started (dejog6). When the set time for the timer EJCT_LJOG_WAIT-TM has elapsed (dejog7), the bundle conveying motor 60 is rendered on and begins to rotate in a direction opposite to direction F, and the timer EJCT_LJOG-TM that can be arbitrarily set is also started (dejog8). When the set time for the timer EJCT_LJOG-TM has elapsed (dejog9), the bundle conveying motor 60 is halted (dejog10).

What is claimed is:

1. An image forming apparatus comprising:

feeding means for sequentially feeding a plurality of originals to an exposure plate and feeding the originals along said exposure plate;

exposure means, which is movable along said exposure plate, for exposing the original on said exposure plate;

image forming means for forming on a sheet an image on the original that is exposed by said exposure means; and control means for providing either a first copying operation, in which the original is fed by said feeding means while said exposure means is not moved, said exposure means performing exposure at a first copying position, or a second copying operation, in which said exposure means is moved while the original is not fed by said feeding means, said exposure means starting exposure at a second position downstream relative to the first copying position in the second copying operation, wherein, when said control means executes a first mode in which the second copying operation is performed following the first copying operation, said feeding means feeds the originals with a first constant distance between a leading end of a preceding original and a leading end of a succeeding original irrespective of a size of the original and positions a succeeding original upstream relative to said exposure means upon a succeeding first copying operation, and wherein, when said control means executes a second mode in which the first copying operation is performed, said feeding means feeds the originals with a second constant distance between a trailing end of a preceding original and a leading end of a succeeding original irrespective of a size of the original.

2. An image forming apparatus according to claim 1, wherein said control means executes the second mode when a number of copies that is set is one, and executes the first mode when a number of copies that is set is more than one.

3. An image forming apparatus according to claim 2, wherein, in the first mode, said control means performs the first copying operation first and then performs the second copying operation a number of times that equals a set copy count—1.

4. An image forming apparatus according to claim 1, wherein an exposure position for said exposure means, for the first copying operation, is near the center of said exposure plate, and wherein the second position for said exposure means, for the second copying operation, is at a downstream end of said exposure plate.

5. An image forming apparatus according to claim 1, wherein said feeding means is a single belt that feeds a plurality of the originals simultaneously.

6. An image forming method comprising:

a feeding step of sequentially feeding a plurality of originals to an exposure plate and feeding the originals along the exposure plate;

an exposure step of exposing the original on the exposure plate by exposure means which is movable along the exposure plate;

an image forming step of forming on a sheet an image on the original that is exposed at said exposure step; and a control step of providing either a first copying operation, in which the original is fed at said feeding step while the exposure means is not moved, the exposure means performing exposure at a first copying position, or a second copying operation, in which the exposure means is moved while the original is not fed at said feeding step, the exposure means starting exposure at a second position downstream relative to the first copying position in said second copying operation, wherein, when said control step is executed a first mode in which said second copying operation is performed following said first copying operation, the originals are fed at said feeding step with a first constant distance between a leading end of a preceding original and a leading end of a succeeding original irrespective of a size of the original and with positioning of a succeeding original upstream relative to the exposure means upon a succeeding first copying operation, and wherein, when said control step is executed a second mode in which said first copying operation is performed, the originals are fed at said feeding step with a second constant distance between a trailing end of a preceding original and a leading end of a succeeding original irrespective of a size of the original.

7. An image forming method according to claim 6, wherein said second mode is executed at said control step when a number of copies that is set is one, and wherein said first mode is executed at said control step when a number of copies that is set is more than one.

8. An image forming method according to claim 7 wherein, in said first mode, at said control step, said first copying operation is performed first and then said second copying operation is performed a number of times that equals a set copy count—1.

9. An image forming method according to claim 6, wherein an exposure position for the exposure means, for said first copying operation, is near the center of the exposure plate, and wherein the second position for the exposure means, for said second copying operation, is at a downstream end of the exposure plate.

10. An image forming method according to claim 6, wherein, at said feeding step, a single belt is employed that feeds a plurality of the originals simultaneously.

* * * * *

UNITED STATES PATENT AND TRADEMARK OFFICE

CERTIFICATE OF CORRECTION

PATENT NO. : 5,893,011

DATED : April 6, 1999

INVENTOR(S) : AKIMARO YOSHIDA, ET AL.

It is certified that error appears in the above-identified patent and that said Letters Patent is hereby corrected as shown below:

Title page, Item [57] ABSTRACT

Line 13, "in (e.g. copies>1) which" should read --(e.g. copies >1) in which".

Column 3

Line 19, "an" should read --a--.

Column 6

Line 22, "then" (second occurrence) should read --than--.

Column 11

Line 2, "11" should read --$\ell_1$.--
Line 14, "$(_{n,n-1})$" should read --$(_{n,n-1})$.--
Line 43, "$P_n$"" should read --$P_n'$--.

Column 19

Line 45, "Sequentially, clockwise paper feeding processing is" should be deleted.

UNITED STATES PATENT AND TRADEMARK OFFICE

CERTIFICATE OF CORRECTION

PATENT NO. : 5,893,011

DATED : April 6, 1999

INVENTOR(S) : AKIMARO YOSHIDA, ET AL.

It is certified that error appears in the above-identified patent and that said Letters Patent is hereby corrected as shown below:

Column 20

Line 2, "the home position for the" should read --the original is moved to the home position for the--.

Column 21

Line 50, "L0<L2-L1" should read --L0≤L2-L1--.

Column 22

Line 59, "1<L3" should read --1≤L3--.

Signed and Sealed this

Fourteenth Day of December, 1999

*Attest:*

*Attesting Officer*

Q. TODD DICKINSON

*Acting Commissioner of Patents and Trademarks*